United States Patent [19]

Ohki et al.

[11] Patent Number: 4,988,613

[45] Date of Patent: Jan. 29, 1991

[54] SILVER HALIDE COLOR PHOTOGRAPHIC MATERIAL

[75] Inventors: Nobutaka Ohki; Hideaki Naruse; Satoshi Nagaoka; Kouichi Hanaki, all of Kanagawa, Japan

[73] Assignee: Fuji Photo Film Co., Ltd., Kanagawa, Japan

[21] Appl. No.: 397,926

[22] Filed: Aug. 24, 1989

[30] Foreign Application Priority Data

| | | | |
|---|---|---|---|
| Aug. 24, 1988 | [JP] | Japan | 63-209808 |
| Aug. 31, 1988 | [JP] | Japan | 63-217290 |
| Sep. 28, 1988 | [JP] | Japan | 63-240699 |

[51] Int. Cl.[5] ..... G03C 7/26; G03C 7/32

[52] U.S. Cl. ..... 430/547; 430/551

[58] Field of Search ..... 430/551, 558, 547

[56] References Cited

U.S. PATENT DOCUMENTS

| | | | |
|---|---|---|---|
| 2,735,765 | 2/1956 | Loria et al. | 430/551 |
| 4,500,630 | 2/1985 | Sato et al. | 430/551 |
| 4,588,679 | 5/1986 | Furutachi | 430/558 |
| 4,735,893 | 4/1988 | Morigaki etal. | 430/551 |
| 4,857,444 | 8/1989 | Hirose et al. | 430/551 |
| 4,906,559 | 3/1990 | Nishijima et al. | 430/551 |

FOREIGN PATENT DOCUMENTS 2043270 3/1971 Fed. Rep. of Germany .

*Primary Examiner*—Richard L. Schilling

*Attorney, Agent, or Firm*—Sughrue, Mion, Zinn, Macpeak & Seas

[57] ABSTRACT

A silver halide color photographic material composed of a support having thereon at least one light-sensitive silver halide emulsion layer containing a color coupler, at least one layer of the material containing a compound represented by formula:

wherein $R^1$, $R^2$, $R^3$, $R^4$, $R^5$ and $R^6$, which may be the same or different, each represents hydrogen, a halogen atom, a sulfo group, a carboxyl group, a cyano group, an alkyl group, an aryl group, an acylamino group, a sulfonamido group, an alkoxy group, an aryloxy group, an alkylthio group, an arylthio group, an acyl group, an acyloxy group, a sulfonyl group, a carbamoyl group, an alkoxycarbonyl group or a sulfamoyl group; provided that $R^1$ and $R^2$, or $R^4$ and $R^5$ may each be linked to form a carbon ring or a heterocyclic ring; and Z represents a single bond or a divalent linking group. The silver halide color photographic material provides an image having an improved white background and gradation, and low minimum image density.

4 Claims, No Drawings

SILVER HALIDE COLOR PHOTOGRAPHIC MATERIAL

FIELD OF THE INVENTION

The present invention relates to a silver halide color photographic material. More particularly, the present invention relates to a silver halide color photographic material which exhibits an improved white background and gradation and a low minimum image density.

BACKGROUND OF THE INVENTION

Color photographic light-sensitive materials of the type developable with a color developing agent, such as paraphenylenediamine, are well known and include silver halide photographic materials containing a color-forming coupler. Techniques for improving white background and adjusting gradation are important factors which affect the image quality. In particular, conventional methods use various hydroquinones to improve white background (i.e., inhibit color fog) in color photographic materials.

For example, methods using straight chain monoalkylhydroquinones are described in U.S. Pat. Nos. 2,728,659 and 3,917,485. Methods using branched monoalkylhydroquinones are described in U.S. Pat. No. 3,700,453, West German Patent Laid-Open No. 2,149,789, and JP-A-No. 50-156438 and JP-A-No. 49-106329 (the term "JP-A" as used herein refers to a "published unexamined Japanese patent application"). Methods using straight chain dialkylhydroquinones are described in U.S. Pat. Nos. 2,728,659 and 2,732,300, British Patent Nos. 752,146 and 1,086,208, and *Chemical Abstracts,* Vol. 58, 6367h. Methods using branched dialkylhydroquinones are described in U.S. Pat. Nos. 3,700,453, 2,732,300 and 4,121,939, British Patent No. 1,086,208, *Chemical Abstracts,* Vol. 58, 6367h, JP-A-No. 50-156438 and JP-B-No. 50-21249 (the term "JP-B" as used herein refers to an "examined Japanese patent publication").

Furthermore, methods using alkylhydroquinones as color stain inhibitors are described in British Patent Nos. 558,258, 557,750 (U.S. Pat. No. 2,360,290), 557,802 and 731,301 (U.S. Pat. No. 2,701,197), U.S. Pat. Nos. 2,336,327, 2,403,721, 2,735,765, and 3,582,333, West German Patent Laid-Open No. 2,505,016 (JP-A-No. 50-110337), and JP-B-No. 56-40816 and JP-B-No. 56-21145.

Various methods have been proposed to inhibit color fog in the color developing solution.

Fog developed in a color developing bath is said to be roughly divided into three types. The first type is attributable to fog in a silver halide emulsion. The second type of fog is developed during the storage of a light-sensitive material between coating and development. The third type is attributable to couplers. In other words, this type of fog results from an indiscriminate reaction with an oxidation product of a developing agent present in a slight amount in a developing solution. It has been known that these types of fog can be prevented by the use of compounds containing a mercapto group, tetraazaindenes or the like. These compounds are disclosed in U.S. Pat. Nos. 3,954,474, 3,982,947, and 4,021,248, JP-B-No. 52-28660, and *Research Disclosure,* No. 17643. However, these compounds containing a mercapto group and tetraazaindenes can eliminate fog to some degree but are not sufficiently effective for the inhibition of color fog.

In recent years, as the demand for improvement in white background and adjustment of gradation has increased, various approaches have been proposed. For example, methods using compounds having a rather small molecular weight among the above-described hydroquinones are disclosed in JP-A-No. 62-239153, JP-A-No. 63-63033 and JP-A-No. 63-80250. However, further improvement in this field is still required.

SUMMARY OF THE INVENTION

An object of the present invention is to provide a silver halide color photographic material which exhibits an improved white background and gradation and a low minimum image density.

Additional objects of the present invention will be apparent from the following detailed description and examples.

It has now been found that these and other objects of the present invention are accomplished with a silver halide color photographic material composed of a support having thereon at least one light-sensitive silver halide emulsion layer containing a color coupler, at least one layer of the material containing a compound represented by formula (I):

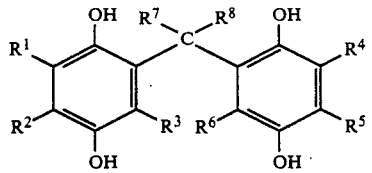

(I)

wherein $R^1$, $R^2$, $R^3$, $R^4$, $R^5$ and $R^6$ each represents a hydrogen atom, a halogen atom, a sulfo group, a carboxyl group, a cyano group, an alkyl group, an aryl group, an acylamino group, a sulfonamido group, an alkoxy group, an aryloxy group, an alkylthio group, an arylthio group, an acyl group, an acyloxy group, a sulfonyl group, a carbamoyl group, an alkoxycarbonyl group or a sulfamoyl group; $R^1$ and $R^2$, and $R^4$ and $R^5$ may be linked to form a carbon ring or a heterocyclic group; $R^7$ represents methyl, ethyl or n-propyl; $R^8$ represents hydrogen, methyl, ethyl or n-propyl; and $R^7$ and $R^8$ may be linked to form a carbon ring or a heterocyclic ring.

DETAILED DESCRIPTION OF THE INVENTION

The present invention will be further described with reference to formula (I).

$R^1$, $R^2$, $R^3$, $R^4$, $R^5$ and $R^6$ each represents hydrogen, a halogen atom (e.g., chlorine, bromine, fluorine), a sulfo group, a carboxyl group, a cyano group, an alkyl group (a $C_{1-20}$ alkyl group, e.g., methyl, t-butyl, cyclohexyl, t-octyl, hexadecyl, benzyl, allyl), an aryl group (a $C_{6-30}$ aryl group, e.g., phenyl, p-tolyl), an acylamino group (a $C_{2-30}$ acylamino group, e.g., acetylamino, benzoylamino), a sulfonamido group (a $C_{1-30}$ sulfonamido group, e.g., methanesulfonamido, benzenesulfonamido), an alkoxy group (a $C_{1-30}$ alkoxy group, e.g., methoxy, butoxy, benzyloxy, dodecyloxy), an aryloxy group (a $C_{6-30}$ aryloxy group, e.g., phenoxy, p-methoxyphenoxy), an alkylthio group (a $C_{1-30}$ alkylthio group, e.g., butylthio, decylthio), an arylthio group (a $C_{6-30}$ arylthio group, e.g., phenylthio, p-hexyloxyphenylthio, an acyl group (a $C_{2-30}$ acyl group, e.g., acetyl, benzoyl, hexanoyl), an acyloxy group (a $C_{1-30}$ acyloxy group, e.g., acetyloxy, benzoyloxy), a sulfonyl group (a $C_{1-30}$ sulfonyl group, e.g., methanesulfonyl, benzenesulfonyl), a carbamoyl group (a $C_{1-30}$ carbamoyl group, e.g., N,N-diethylcarbamoyl, N-phenylcarbamoyl), an alkoxycarbonyl group (a $C_{2-30}$ alkoxycarbonyl group, e.g., methoxycarbonyl, butoxycarbonyl) or a sulfamoyl group (a $C_{0-30}$ sulfamoyl group, e.g., N,N-dipropylsulfamoyl, N-phenylsulfamoyl). Either or both of $R^1$ and $R^2$, and $R^4$ and $R^5$ may be linked to form a carbon ring or a heterocyclic group. $R^7$ represents methyl, ethyl or n-propyl. $R^8$ represents hydrogen or has the same meaning as $R^7$. $R^7$ and $R^8$ may together form a carbon ring or a heterocyclic group.

In formula (I), $R^1$, $R^2$, $R^3$, $R^4$, $R^5$ and $R^6$ may be substituted by alkyl groups, aryl groups, alkoxy groups, aryloxy groups, sulfo groups, carboxyl groups, amido groups, carbamoyl groups, halogen atoms or other commonly known substituents.

The total number of carbon atoms contained in $R^1$ to $R^6$ in formula (I) is in the range of 1 to 40, preferably 3 to 35, more preferably 5 to 25, particularly 8 to 20.

In formula (I), $R^1$ to $R^6$ preferably each represents hydrogen, a halogen atom, an alkyl group, an aryl group, an acylamino group or an alkylthio group, more preferably hydrogen, an alkyl group, an acylamino group or an alkylthio group, and most preferably hydrogen or an alkyl group.

In formula (I), $R^8$ preferably represents hydrogen.

Specific examples of the compound represented by formula (I) are shown below, but the present invention is not to be construed as being limited thereto.

I-(1)

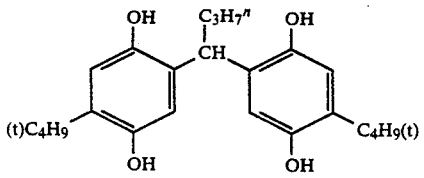

I-(2)

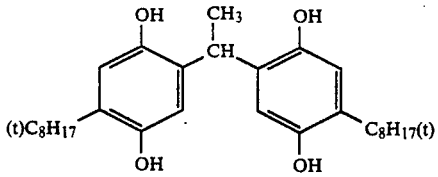

I-(3)

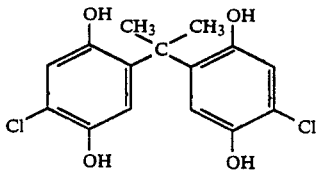

I-(4)

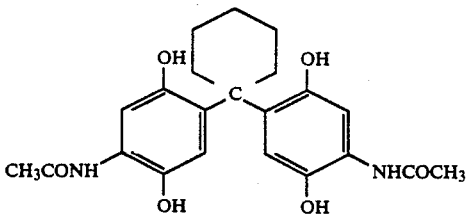

-continued

I-(5)

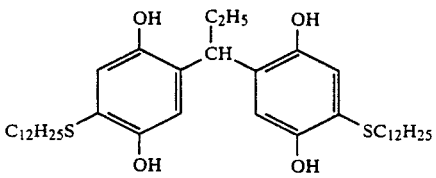

I-(6)

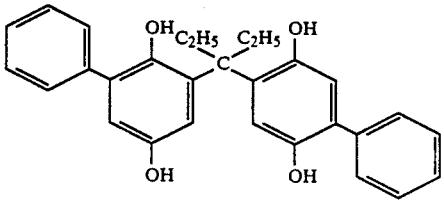

I-(7)

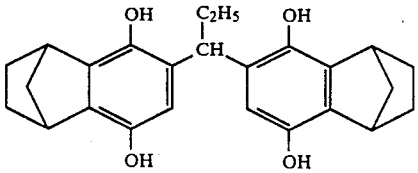

I-(8)

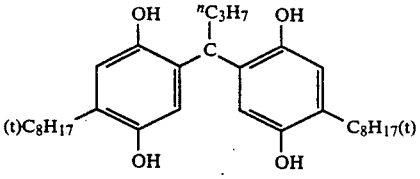

I-(9)

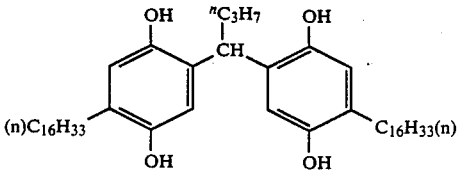

I-(10)

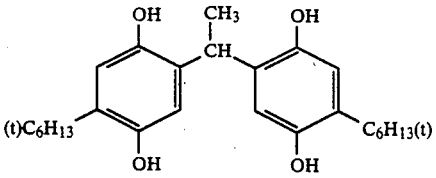

I-(11)

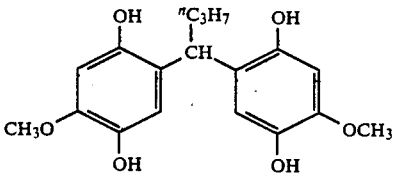

I-(12)

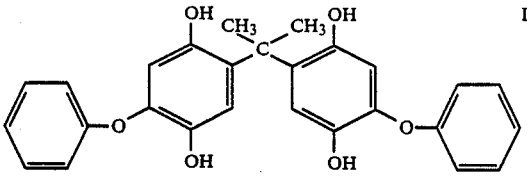

-continued

I-(13)

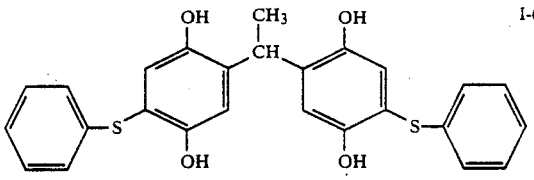

I-(14)

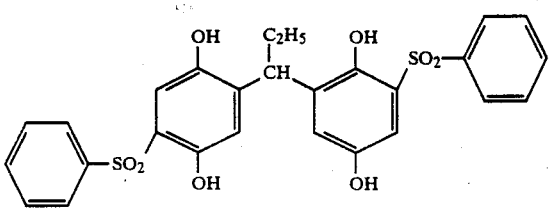

I-(15)

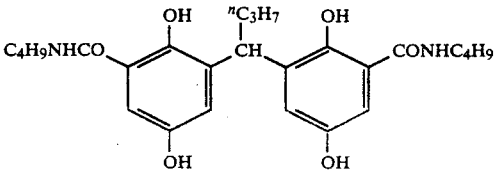

I-(16)

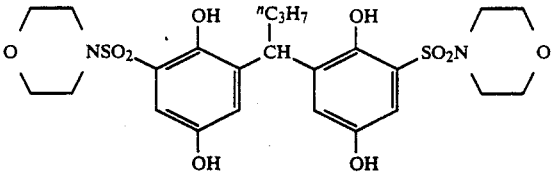

I-(17)

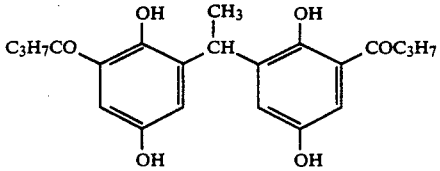

I-(18)

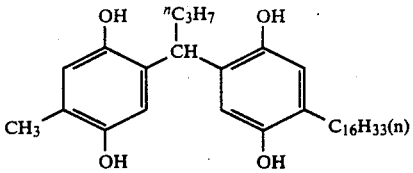

I-(19)

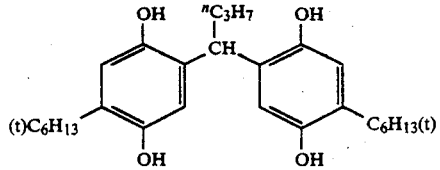

I-(20)

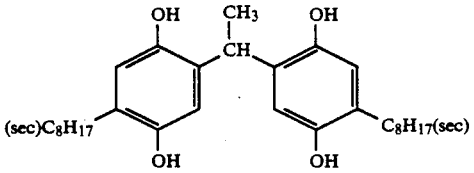

-continued

I-(21)

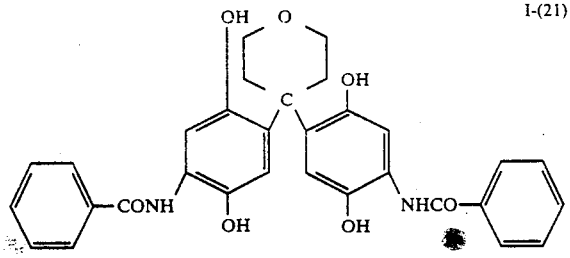

I-(22)

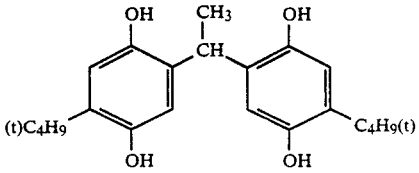

The synthesis of the compound of formula (I) can easily be accomplished in accordance with any method described in U.S. Pat. No. 2,735,765 and JP-B-No. 56-21145.

The amount of the compound of formula (I) incorporated is in the range of $1\times10^{-8}$ to $1\times10^{-2}$ mol/m$^2$, preferably $1\times10^{-7}$ to $1\times10^{-3}$ mol/m$^2$, particularly $1\times10^{-6}$ to $1\times10^{-4}$ mol/m$^2$.

The compound of formula (I) can be incorporated in the emulsion layer, an intermediate layer, protective layer, or backing layer, and is preferably contained in the emulsion layer or an adjacent intermediate layer.

In the present invention, various color couplers can be used to form color images. Such a color coupler is preferably a compound which is substantially nondiffusible itself, and that undergoes coupling reaction with an oxidation product of an aromatic primary amine color developing agent to produce or release a substantially nondiffusible dye. Typical examples of useful color couplers include naphthol or phenol compounds, pyrazolo or pyrazoloazole compounds and open chain or heterocyclic ketomethylene compounds. Specific examples of these cyan, magenta and yellow couplers which can be used in the present invention are described in *Research Disclosure,* Nos. 17643 (December, 1978), p. 25 (VII-D) and 18717 (November, 1979), JP-A-No. 62-215272, and patents cited in these publications.

Typical examples of yellow couplers which can be used in the present invention include oxygen atom-eliminating type and nitrogen atom-eliminating type 2-equivalent yellow couplers. In particular, α-pivaloylacetanilide couplers are excellent in the fastness of formed dyes, especially to light. On the other hand, α-benzoylacetanilide couplers can advantageously provide a high color density.

Suitable 5-pyrazolone magenta couplers for the present invention preferably include 5-pyrazolone couplers in which the carbon atom in the 3-position is substituted by an arylamino or acrylamino group, particularly sulfur atom-eliminating type 2-equivalent couplers.

Further preferred yellow couplers are pyrazoloazole couplers, particularly pyrazolo[5,1-c]-[1,2,4]triazoles as described in U.S. Pat. No. 3,725,067. Imidazo[1,2-b]pyrazoles as described in U.S. Pat. No. 4,500,630 are more preferably used because they provide a dye with a lower secondary yellow absorption and excellent fastness to light. The pyrazolo[1,5-b][1,2,4]-triazole described in U.S. Patent 4,540,654 is particularly preferred.

Examples of cyan couplers which are preferably used in the present invention include the naphthol and phenol couplers described in U.S. Pat. Nos. 2,474,293 and 4,502,212, and phenol cyan couplers in which an ethyl group or higher alkyl group is present in the metaposition of the phenol nucleus as described in U.S. Pat. No. 3,772,002. In addition, 2,5-diacylaminosubstituted phenolic couplers are preferably used because they provide dyes with excellent fastness.

Other examples of color couplers which can be used in the present invention include colored couplers which eliminate unnecessary absorption by the dyes produced in the short wavelength range; couplers which provide dyes with a controlled diffusibility; noncolor couplers, DIR couplers which release a development inhibitor by a coupling reaction, and polymerized couplers.

The amount of each color coupler to be incorporated is typically in the range of 0.001 to 1 mol, and preferably 0.01 to 0.5 mol for the yellow coupler, 0.03 to 0.5 mol for the magenta coupler and 0.002 to 0.5 mol for the cyan coupler, per mol of light-sensitive silver halide in the same layer.

In the present invention, a color improver can be used for the purpose of improving the coloring property of couplers. Typical examples of such a compound are described in JP-A-No. 62-215272, pp. 374 to 391.

A silver halide color photographic material normally has silver halide emulsion layers sensitive to three primary colors, i.e., blue, green and red. These silver halide emulsion layers develop color dye image of yellow, magenta and cyan, respectively, in the subtractive process. Therefore, the color images reproduced greatly depend on the color sensitivity and spectral absorption characteristics of the respective layers.

In general, these characteristics are not theoretically optimal due to limitations on the coloring properties of the compounds used. In particular, the color hue of magenta couplers is important for color reproduction, and has been intensely investigated and improved. Particularly, pyrazoloazole magenta couplers can provide a dye with excellent spectral absorption characteristics.

In order to improve the color hue of 5-pyrazolone magenta couplers, anilino type magenta couplers which exhibit better spectral absorption characteristics than ureido type or acylamino type magenta couplers have been commercially developed as described in JP-A-No. 49-74027 and JP-A-No. 49-111631. Pyrazoloazole type magenta couplers which exhibit reduced secondary absorption have been commercially developed as described in U.S. Pat. No. 3,725,067. Such couplers exhibit less absorption in the blue and red light regions than a color image obtained from 5-pyrazolone type magenta couplers and thus are advantageous in color reproduction. This type of couplers is also advantageous in that the images obtained are resistant to change, probably because they are themselves fast to heat, light and moisture and thus are resistant to decomposition. However, as compared to 5-pyrazolone type magenta couplers, these pyrazoloazole type magenta couplers easily produce magenta stain when they undergo a reaction with an oxidation product of a developing agent formed in a processing solution as a result of development.

Such a stain is particularly remarkable in a direct positive image-forming type silver halide color photographic material (e.g., for a high quality reproduction of originals having image data such as characters and picture). Thus, it has been desired to eliminate such a stain.

As a result of extensive studies, the inventors have found that a further remarkable effect can be obtained by the combination of a compound represented by formula (II) and a certain kind of a pyrazoloazole coupler. Namely, in the second invention of the application, the present color photographic light-sensitive material contains at least one compound represented by formula (II) and at least one magenta coupler represented by formula (III):

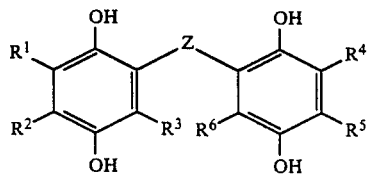

(II)

wherein $R^1$, $R^2$, $R^3$, $R^4$, $R^5$ and $R^6$, which may be the same or different, each represents hydrogen, a halogen atom, a sulfo group, a carboxyl group, a cyano group, an alkyl group, an aryl group, an acylamino group, a sulfonamido group, an alkoxy group, an aryloxy group, an alkylthio group, an arylthio group, an acyl group, an acyloxy group, a sulfonyl group, a carbamoyl group, an alkoxycarbonyl group or a sulfamoyl group; provided that $R^1$ and $R^2$, or $R^4$ and $R^5$ may each be linked to form a carbon ring or a heterocyclic ring; and Z represents a single bond or a divalent linking group.

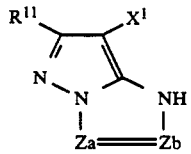

(III)

wherein Za and Zb, which may be the same or different, each represents

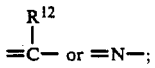

$R^{11}$ and $R^{12}$ each represents hydrogen; and $X^1$ represents hydrogen or a group capable of being eliminated by a coupling reaction with an oxidation product of an aromatic primary amine developing agent (hereinafter "coupling-off group"). If Za=Zb is a carbon-carbon double bond, it may be a part of an aromatic ring. Furthermore, $R^{11}$, $R^{12}$ or $X^1$ may form a dimer or higher polymer.

The second invention is now described in greater detail with reference to formulae (II) and (III).

In formula (II), $R^1$, $R^2$, $R^3$, $R^4$, $R^5$ and $R^6$ each represents hydrogen, a halogen atom (e.g., chlorine, bromine, fluorine), a sulfo group, a carboxyl group, a cyano group, an alkyl group (a $C_{1-20}$ alkyl group, e.g., methyl, t-butyl, cyclohexyl, t-octyl, hexadecyl, benzyl, allyl), an aryl group (a $C_{6-30}$ aryl group, e.g., phenyl, p-tolyl), an acylamino group (a $C_{2-30}$ acylamino group, e.g., acetylamino, benzoylamino), a sulfonamido group (a $C_{1-30}$ sulfonamido group, e.g., methanesulfonamido, benzenesulfonamido), an alkoxy group (a $C_{1-30}$ alkoxy group, e.g., methoxy, butoxy, benzyloxy, dodecyloxy), an aryloxy group (a $C_{6-30}$ aryloxy group, e.g., phenoxy, p-methoxyphenoxy), an alkylthio group (a $C_{1-30}$ alkylthio group, e.g., butylthio, decylthio), an arylthio group (a $C_{6-30}$ arylthio group, e.g., phenylthio, p-hexyloxyphenylthio), an acyl group (a $C_{2-30}$ acyl group, e.g., acetyl, benzoyl, hexanoyl), an acyloxy group (a $C_{1-30}$ acyloxy group, e.g., acetyloxy, benzoyloxy), a sulfonyl group (a $C_{1-30}$ sulfonyl group, e.g., methanesulfonyl, benzenesulfonyl), a carbamoyl group (a $C_{1-30}$ carbamoyl group, e.g., N,N-diethylcarbamoyl, N-phenylcarbamoyl), an alkoxycarbonyl group (a $C_{2-30}$ alkoxycarbonyl group, e.g., methoxycarbonyl, butoxycarbonyl) or a sulfamoyl group (a $C_{0-30}$ sulfamoyl group, e.g., N,N-dipropylsulfamoyl, N-phenylsulfamoyl). Either or both of $R^1$ and $R^2$, and $R^4$ and $R^5$ may be linked to form a carbon ring or a heterocyclic group. Z represents a single bond or a divalent linking group (a $C_{1-60}$ organic group, e.g., methylene, ethylene, p-phenylene,

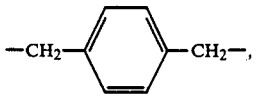

and 1,4-butylene).

In formula (II), $R^1$, $R^2$, $R^3$, $R^4$, $R^5$, $R^6$ and Z may be substituted by alkyl groups, aryl groups, alkoxy groups, aryloxy groups, sulfo groups, carboxyl groups, amido groups, carbamoyl groups, or halogen atoms. The compound represented by formula (II) may form a dimer (i.e., the hydroquinone portion forms a tetramer).

Among compounds represented by formula (II), compounds represented by formula (II-A) are preferred in the present invention.

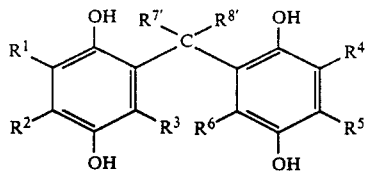

(II-A)

wherein $R^1$, $R^2$, $R^3$, $R^4$, $R^5$ and $R^6$ have the same definition as in formula (II). $R^{7'}$ and $R^{8'}$ each represents hydrogen, a substituted or unsubstituted alkyl group (a $C_{1-30}$ alkyl group, e.g., methyl, isopropyl, undecyl, benzyl), a substituted or unsubstituted aryl group (a $C_{6-30}$ aryl group, e.g., phenyl, p-tolyl), or a substituted or unsubstituted heterocyclic group (a $C_{1-30}$ heterocyclic group, e.g., pyridine-2-yl), and $R^{7'}$ and $R^{8'}$ may be linked to form a carbon ring or a heterocyclic group.

In formula (II-A), $R^1$, $R^2$, $R^3$, $R^4$, $R^5$ and $R^6$ may be substituted by alkyl groups, aryl groups, alkoxy groups, aryloxy groups, sulfo groups, carboxyl groups, amido groups, carbamoyl groups, halogen atoms or other commonly known substituents.

Specific examples of the compound represented by formula (II) are I-(1) to I-(22) described hereinbefore and those shown below.

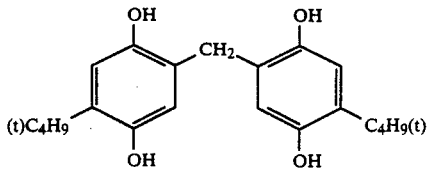

I-(23)

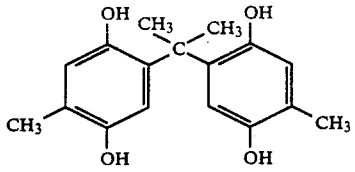

I-(24)

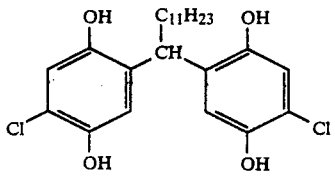

I-(25)

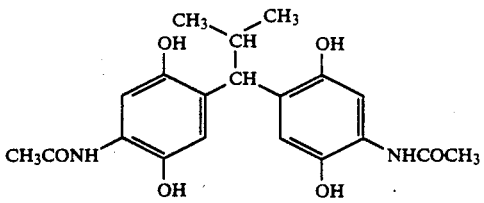

I-(26)

-continued
I-(27)
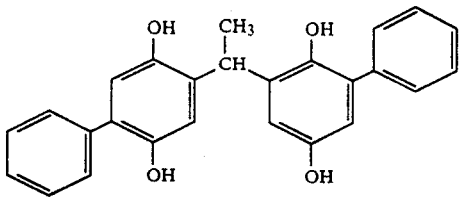
I-(28)
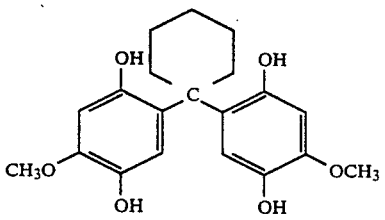
I-(29)
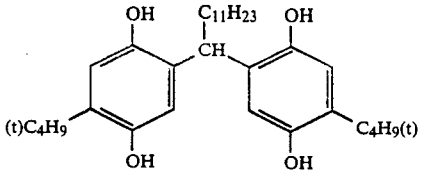
I-(30)
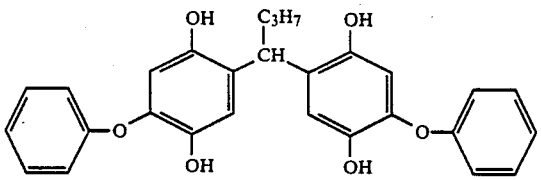
I-(31)
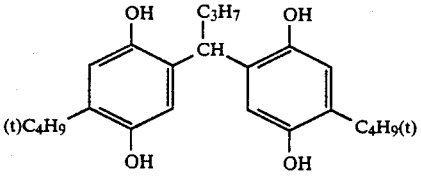
I-(32)
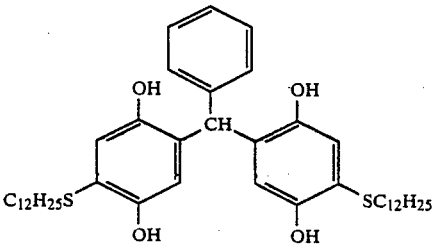
I-(33)
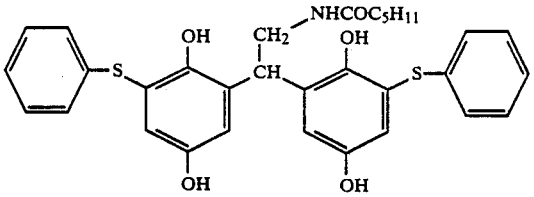

-continued
I-(34)
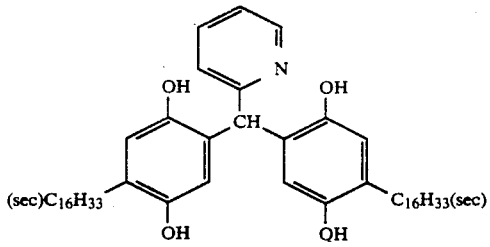
I-(35)
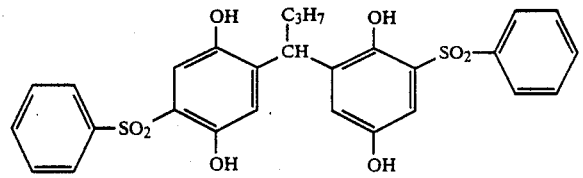
I-(36)
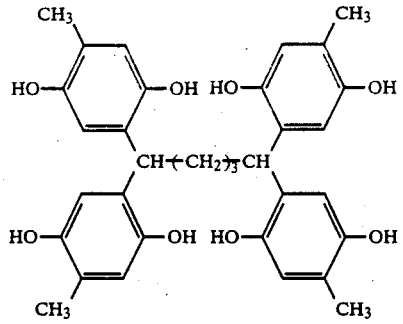
I-(37)
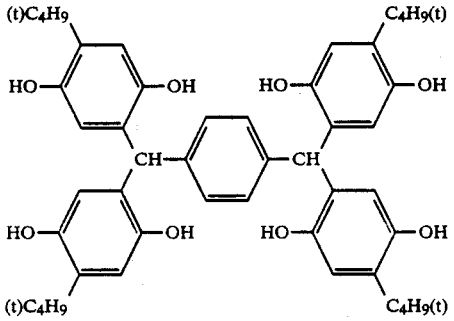
I-(38)
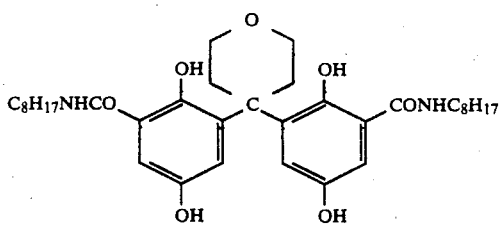
I-(39)
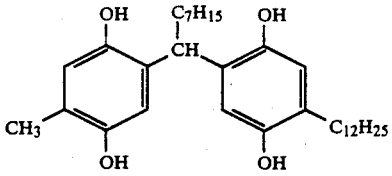

-continued
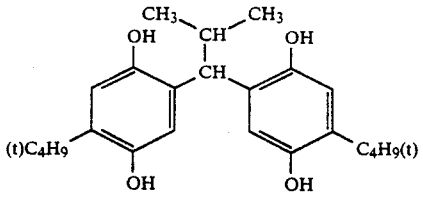
I-(40)
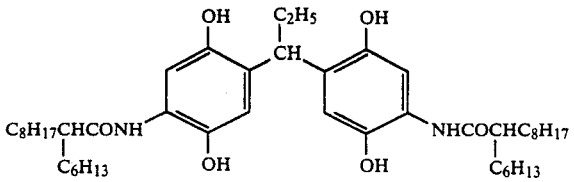
I-(41)
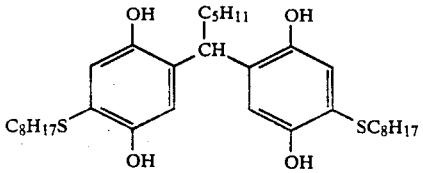
I-(42)
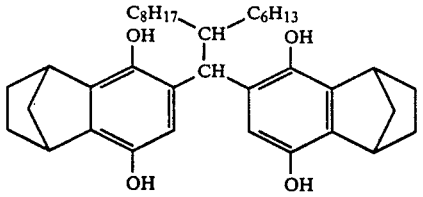
I-(43)
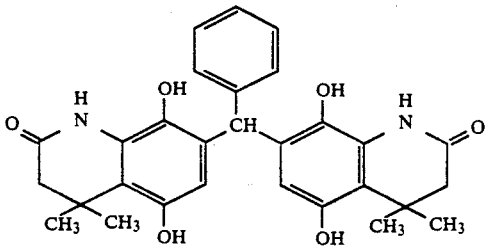
I-(44)
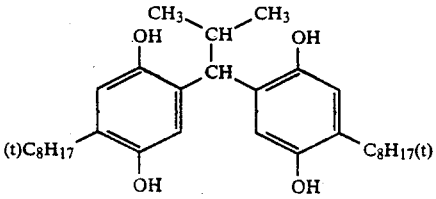
I-(45)
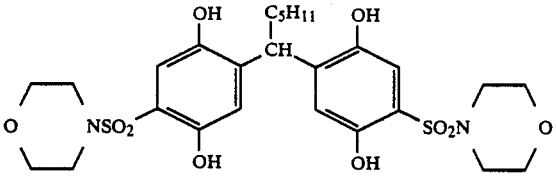
I-(46)

-continued
I-(47)
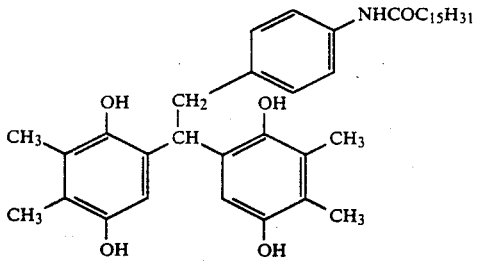
I-(48)
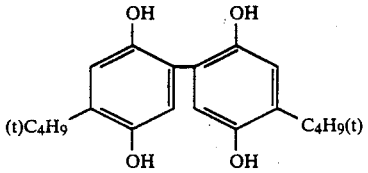
I-(49)
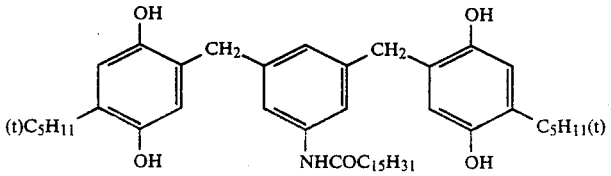
I-(50)
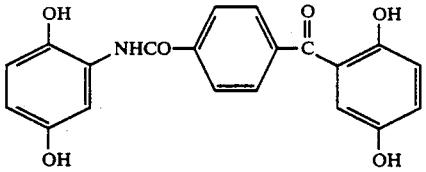
I-(51)
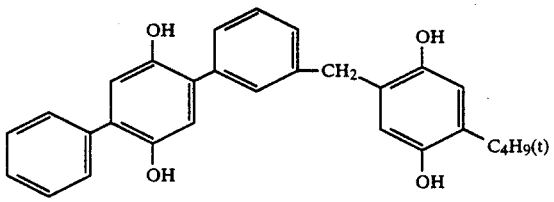
I-(52)
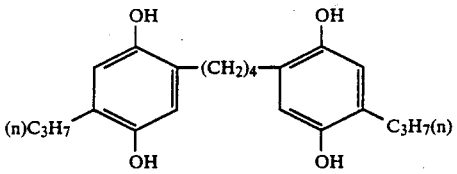
I-(53)
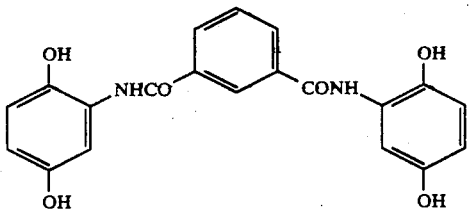
I-(54)
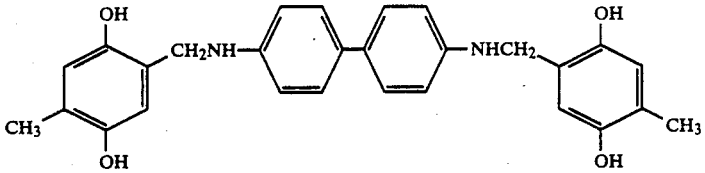

-continued

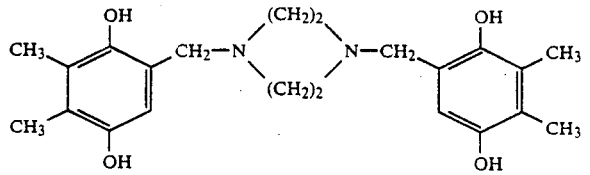

I-(55)

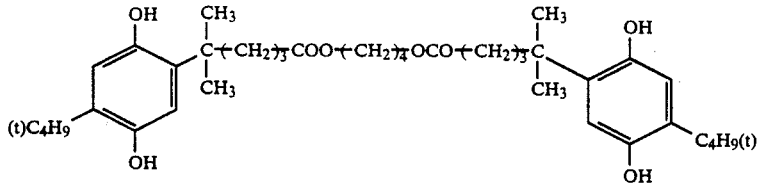

I-(56)

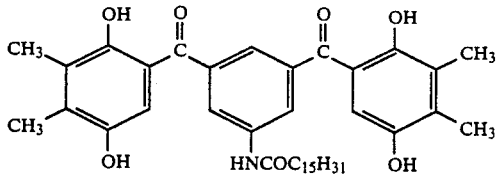

I-(57)

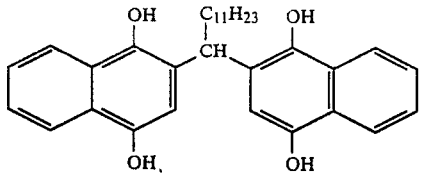

I-(58)

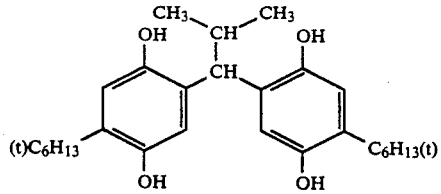

I-(59)

Preferred pyrazoloazole magenta couplers represented by formula (III) are those represented by formulae (IIIa), (IIIb), (IIIc), (IIId) and (IIIe):

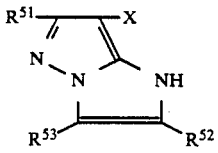

(IIIa)

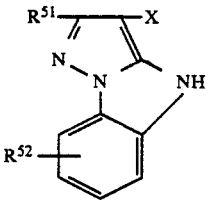

(IIIb)

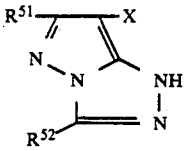

(IIIc)

-continued

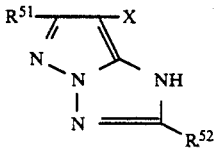

(IIId)

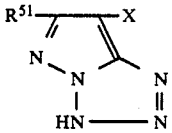

(IIIe)

Among the couplers represented by formulae (IIIa) to (IIIe), those represented by formulae (IIIa), (IIIc) and (IIId) are preferred.

In formulae (IIIa) to (IIIe), $R^{51}$, $R^{52}$ and $R^{53}$ may be the same or different and each represents hydrogen, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, a silyloxycarbonylamino group, a sulfonamido group, a carbamoyl group, an acyl group, a sulfamoyl group, a sulfonyl group, a sulfinyl group, an alkoxycarbonyl group or an aryloxycarbonyl group. Particularly preferred among these groups represented by $R^{51}$, $R^{52}$ and $R^{53}$ are an alkyl group, an alkoxy group, an alkylthio group, an aryl group, an aryloxy group, an arylthio group, an acylamino group and an anilino group. X represents hydrogen, a halogen atom, a carboxyl group or a group which is bonded to the carbon atom in the coupling position via oxygen, nitrogen or sulfur and undergoes coupling elimination. $R^{51}$, $R^{52}$, $R^{53}$ or X may represent a divalent group to form a bis compound.

The present color coupler may be in the form of a polymer coupler in which the coupler residual group represented by formula (IIIa), (IIIb), (IIIc), (IIId) or (IIIe) is present in the main chain or side chain thereof. Particularly, polymers derived from vinyl monomers containing the portion represented by these general formulae are preferred. In this case, $R^{51}$, $R^{52}$, $R^{53}$ or X represents a vinyl group or a connecting group.

If the group represented by formula (IIIa), (IIIb), (IIIc), (IIId) or (IIIe) is contained in a vinyl monomer, examples of the connecting group represented by $R^{51}$, $R^{52}$, $R^{53}$ or X include groups formed by the combination of alkylene groups (e.g., substituted or unsubstituted alkylene group, such as methylene, ethylene, 1,10-decylene, $-CH_2CH_2OCH_2CH_2-$); phenylene groups (e.g., a substituted or unsubstituted phenylene group, such as 1,4-phenylene, 1,3-phenylene,

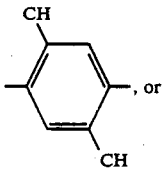

or

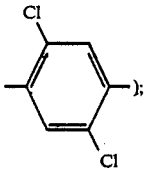

—NHCO—; —CONH—; —O—; —OCO—; and aralkylene groups (e.g.,

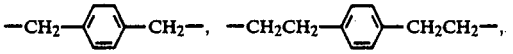

or

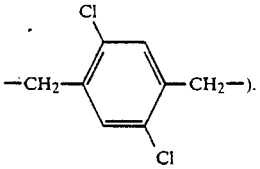

Examples of suitable connecting groups include —NHCO—, $-CH_2CH_2-$,

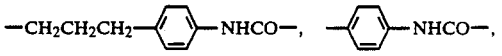

$-CH_2CH_2NHCO-$,

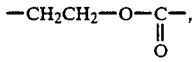

—CONH—$CH_2CH_2NHCO$—, $-CH_2CH_2O-CH_2CH_2-NHCO-$, and

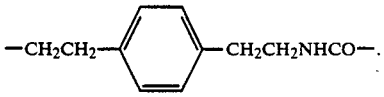

The vinyl group may contain other substituents than those represented by formulae (IIIa) to (IIIe). Such suitable substituents include hydrogen, chlorine, and $C_{1-4}$ lower alkyl groups (e.g., methyl, ethyl).

The monomer containing the group represented by formula (IIIa), (IIIb), (IIIc), (IIId) or (IIIe) may form a copolymerizable polymer with a noncoloring ethylenic monomer, i.e., one that does not couple with an oxidation product of an aromatic primary amine developing agent.

As is well known in the art of polymer color couplers, the noncoloring ethylenically unsaturated monomer to be copolymerized with a solid water-insoluble monomeric coupler can be selected such that the physical properties and/or chemical properties of the copolymer to be formed, i.e., solubility, compatibility with a binder for photographic colloidal composition such as gelatin, flexibility and thermal stability are favorably affected.

The polymer coupler to be used in the present invention may be water-soluble or water-insoluble. Particularly preferred among these polymer couplers are polymer coupler latexes.

Particularly preferred among the groups represented by $R^{51}$ and $R^{52}$ are an alkyl group, an alkoxy group, an alkylthio group, an aryl group, an aryloxy group, an arylthio group, an acylamino group and an anilino group.

Specific examples of the compound represented by formula (III) are shown below, but the present invention is not to be construed as being limited thereto.

III-(1)
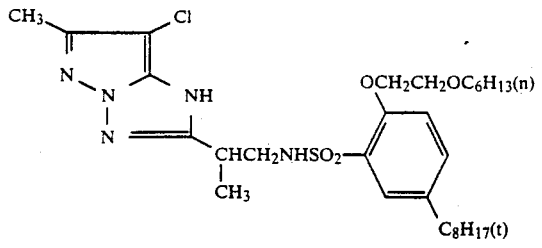
III-(2)
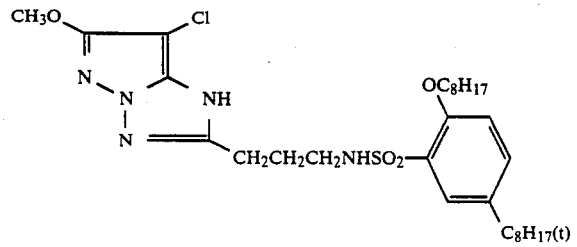
III-(3)
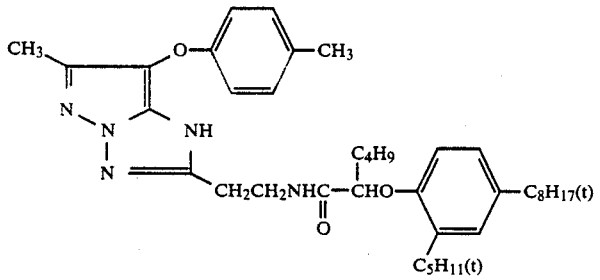
III-(4)
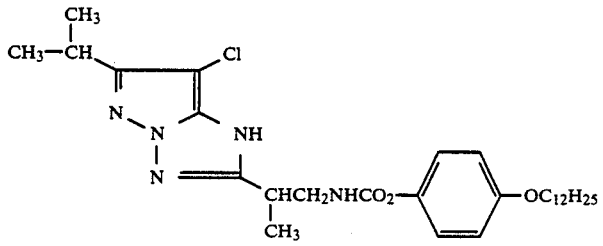
III-(5)
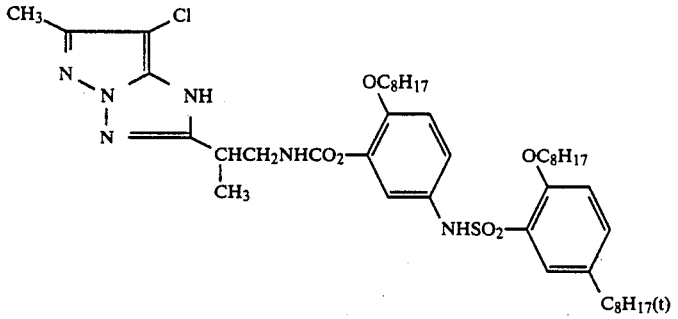
III-(6)
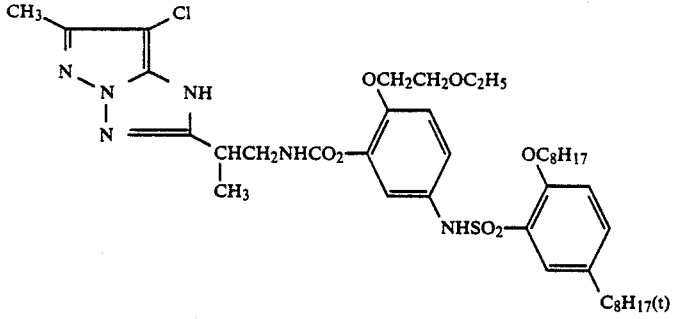

-continued
III-(7)
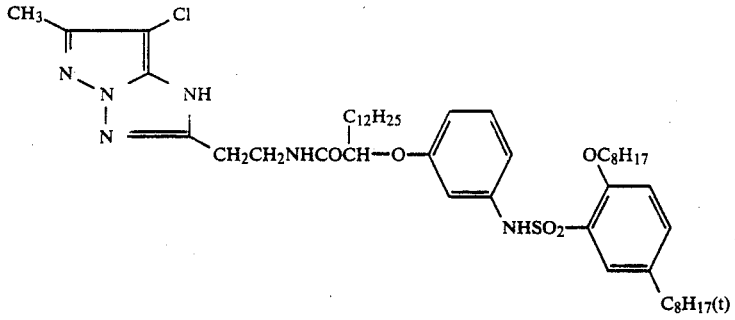
III-(8)
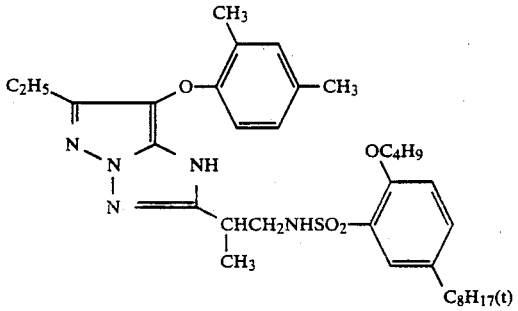
III-(9)
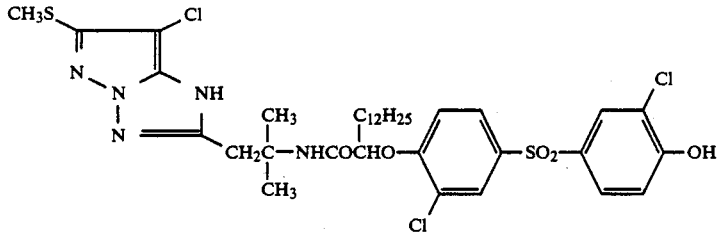
III-(10)
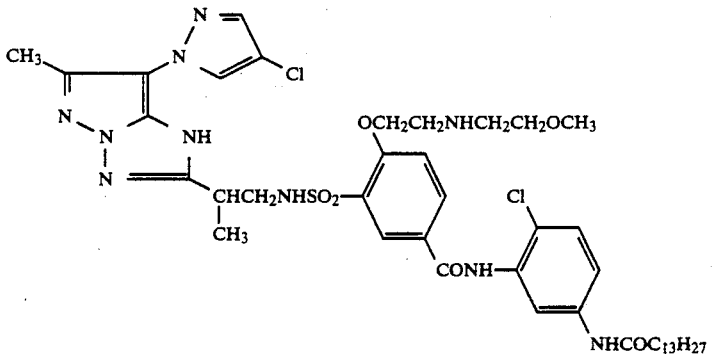
III-(11)
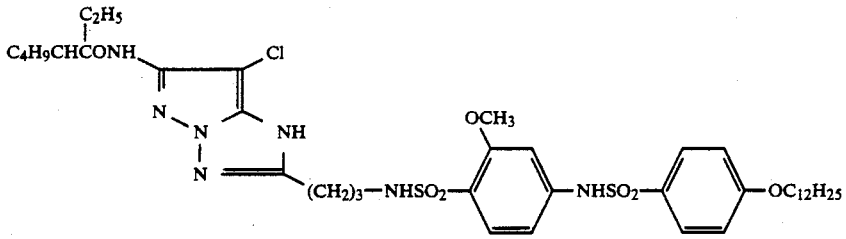

-continued
III-(12)
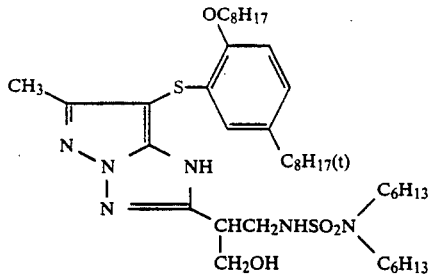
III-(13)
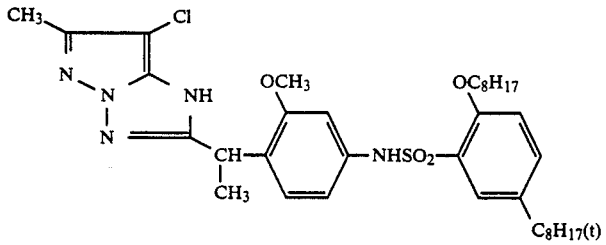
III-(14)
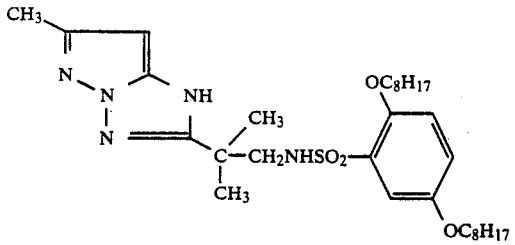
III-(15)
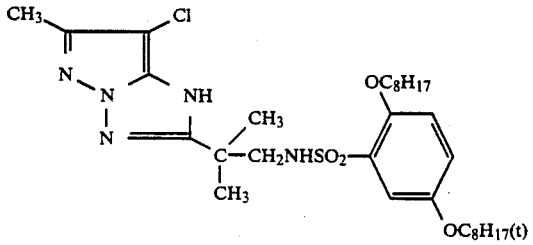
III-(16)
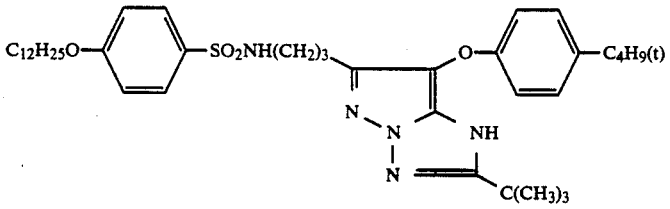
III-(17)
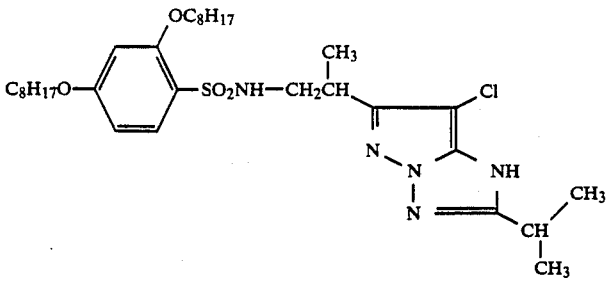

-continued
III-(18)
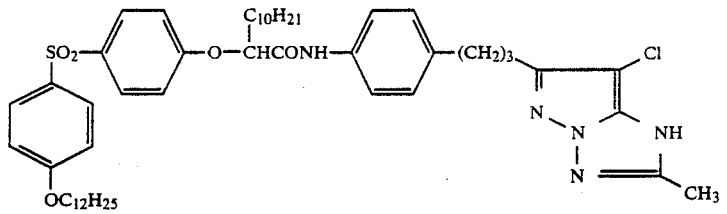
III-(19)
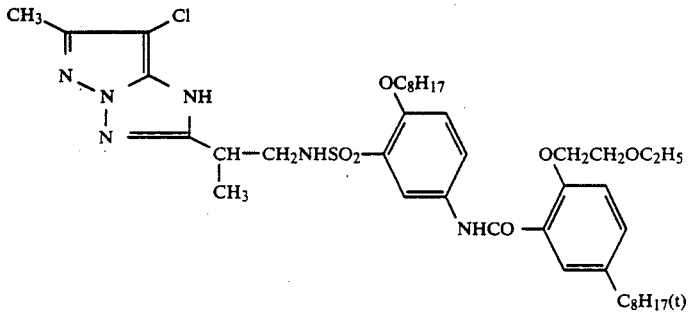
III-(20)
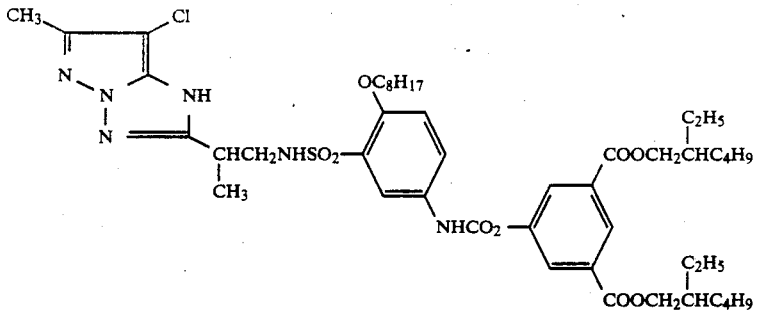
III-(21)
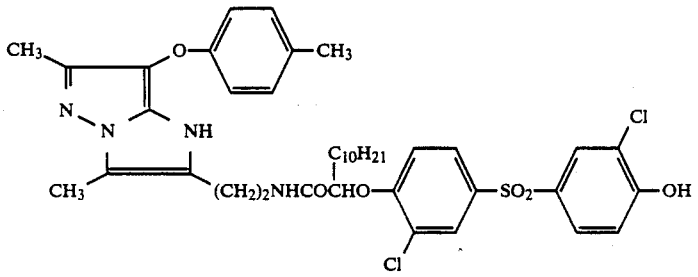
III-(22)
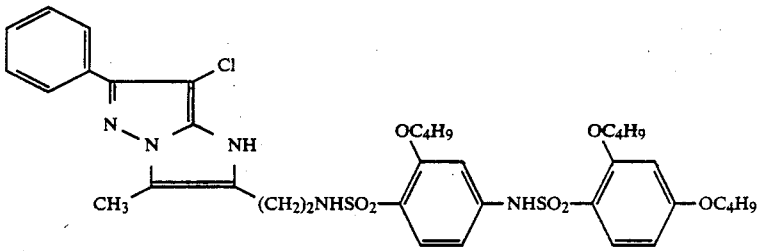
III-(23)
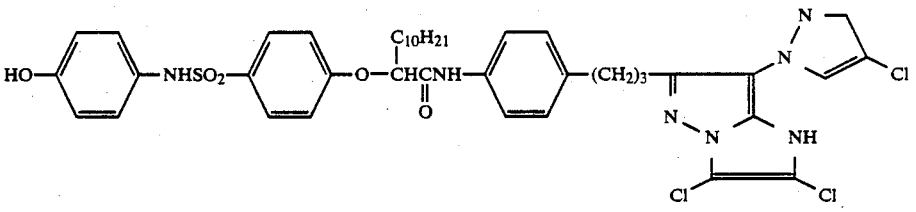

-continued
III-(24)
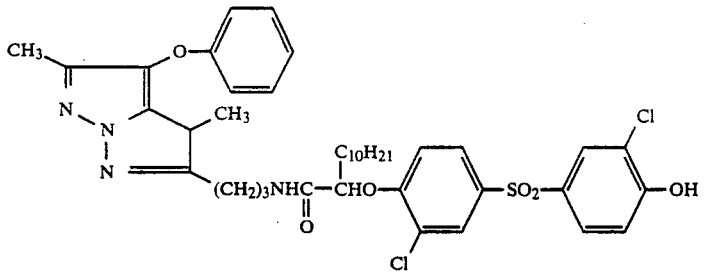
III-(25)
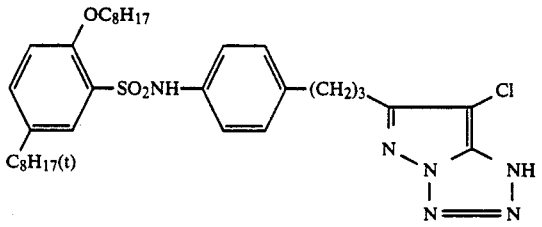
III-(26)
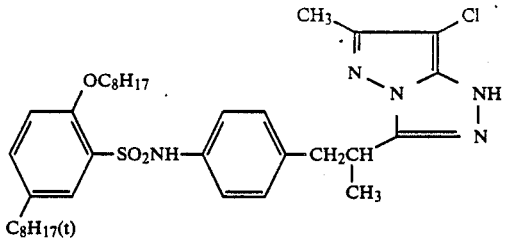
III-(27)
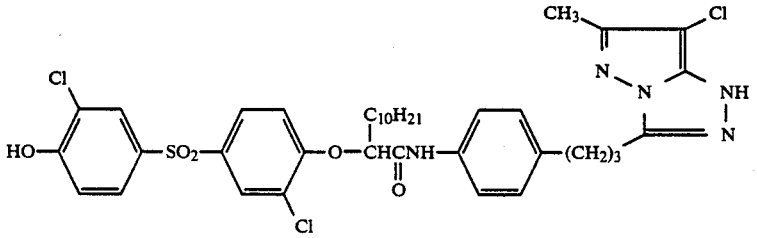
III-(28)
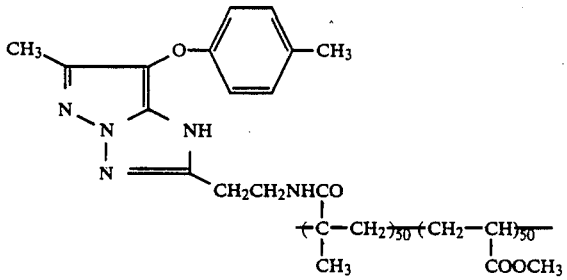
III-(29)
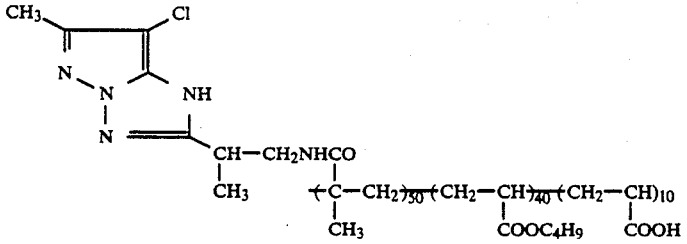

-continued
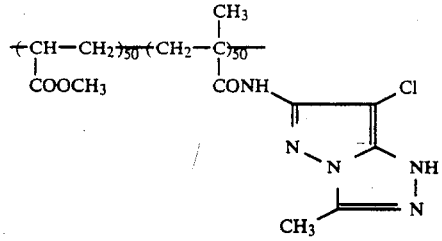
III-(30)
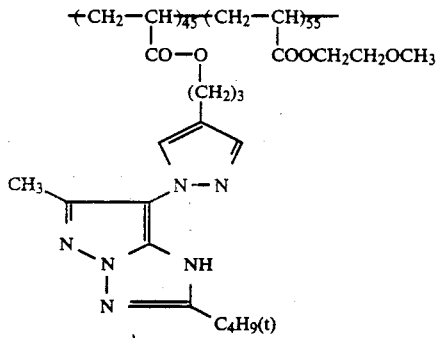
III-(31)
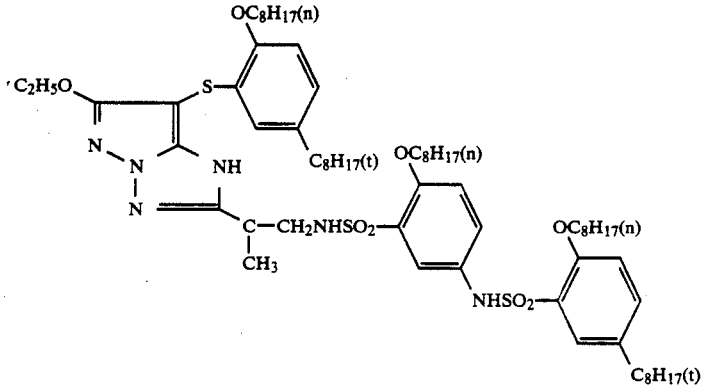
III-(32)
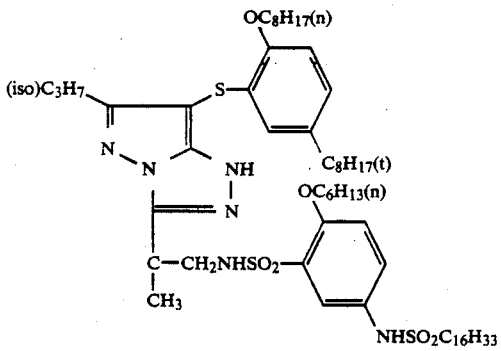
III-(33)

-continued
III-(34)
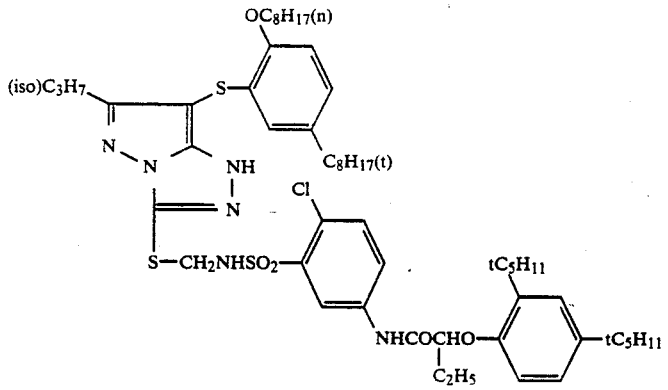
III-(35)
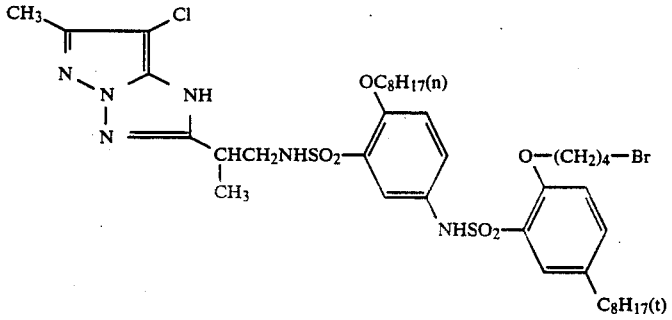
III-(36)
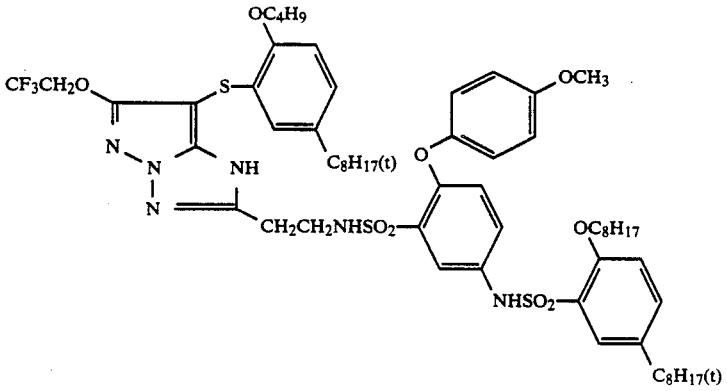
III-(37)
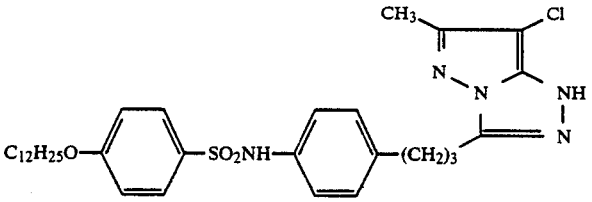
III-(38)
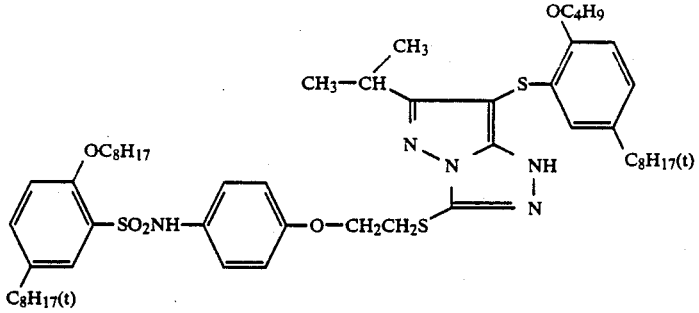

-continued
III-(39)
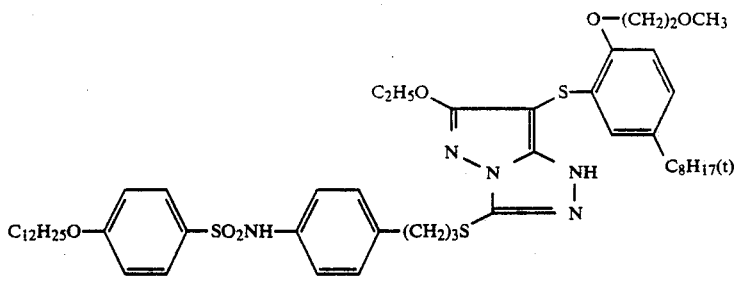
III-(40)
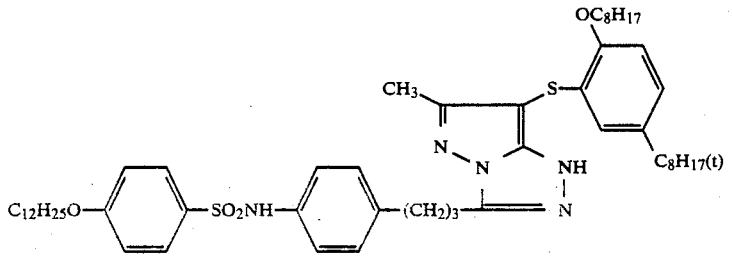
III-(41)
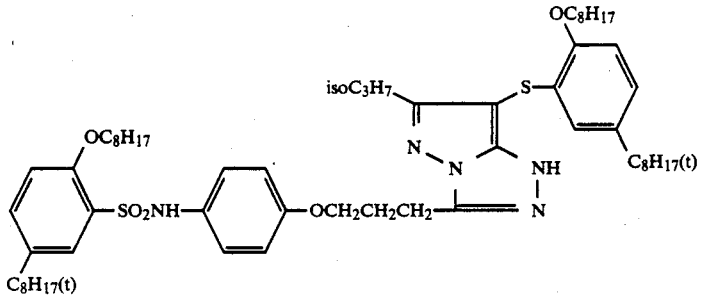
III-(42)
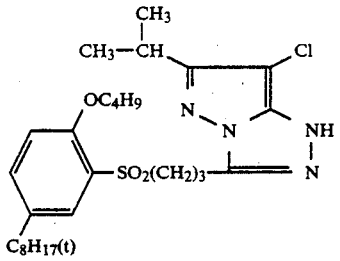
III-(43)
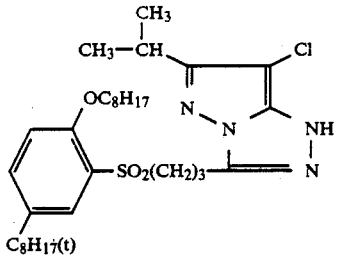

-continued
III-(44)
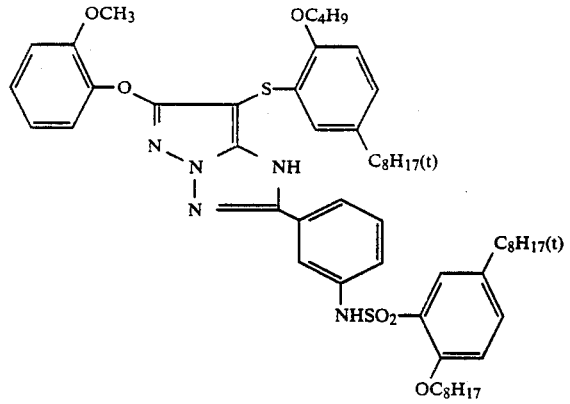
III-(45)
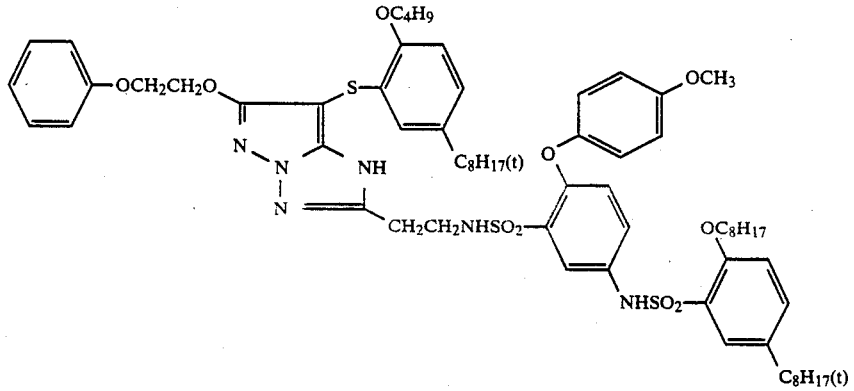
III-(46)
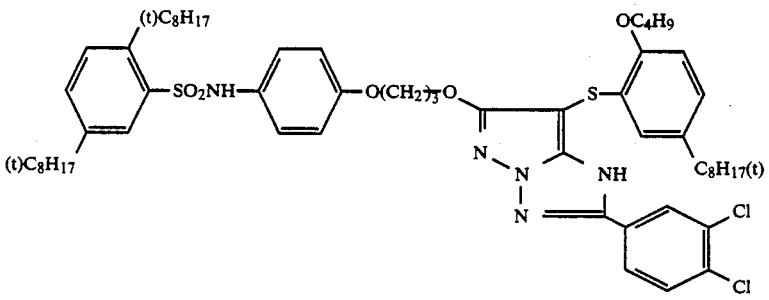
III-(47)
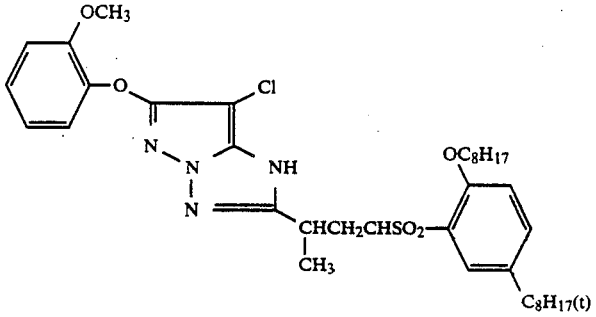
III-(48)
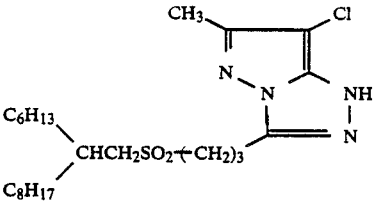

Examples of the couplers represented by formulae (IIIa) to (IIIe) and syntheses thereof are described in the following publications.

Examples of compounds represented by formula (IIIa) are described in JP-A-No. 59-162548. Examples of compounds represented by formula (IIIb) are described in JP-A-No. 59-171956. Examples of compounds represented by formula (IIIc) are described in JP-A-No. 60-33552. Examples of compounds represented by formula (IIId) are described in U.S. Pat. No. 3,061,432. Examples of compounds represented by formula (IIIe) are described in U.S. Pat. No. 3,725,067.

Highly coloring ballast groups as described in JP-A-No. 58-42045, JP-A-No. 59-177553, JP-A-No. 59-174836, JP-A-No. 59-177554, JP-A-No. 59-177557, JP-A-No. 59-177556 and JP-A-No. 59-177555 can be present in any of the compounds represented by formulae (IIIa) to (IIIe).

In the present silver halide color photographic material, other color couplers used in combination with the magenta couplers represented by formula (III) preferably include yellow couplers represented by formula (IV) and cyan couplers represented by formula (V). When these specific yellow, magenta and cyan couplers are combined, it is possible to further improve the resistance to deterioration caused by the processing solution when incorporated in the light-sensitive material, when used in combination with a compound of formula (III). When specific yellow or cyan couplers are incorporated in the present color light-sensitive material, a trichromatic light-sensitive material having suitable properties with an excellent brown color ballast can be obtained as compared to when other yellow or cyan couplers are used.

The yellow coupler which is particularly preferably used in the present invention is represented by formula (IV):

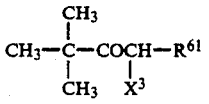

(IV)

wherein $R^{61}$ represents a substituted or unsubstituted N-phenylcarbamoyl group; and $X^3$ represents a group capable of being eliminated by a reaction with an oxidation product of an aromatic primary amine color developing agent.

Examples of substituents contained in the phenyl group in the N-phenylcarbamoyl group represented by $R^{61}$ include aliphatic groups (e.g., methyl, allyl, cyclopentyl), heterocyclic groups (e.g., 2-pyridyl, 2-furyl, 6-quinolyl), aliphatic oxy groups (e.g., methoxy, 2-methoxyethoxy, 2-propenyloxy), aromatic oxy groups (e.g., 2,4-di-tert-amylphenoxy, 4-cyanophenoxy, 2-chlorophenoxy), acyl groups (e.g., acetyl, benzoyl), ester groups (e.g., butoxycarbonyl, hexadecyloxycarbonyl, phenoxycarbonyl, dodecyloxy, carbonylmethoxycarbonyl, acetoxy, benzoyloxy, tetradecyloxysulfonyl, hexadecanesulfonyloxy), amido groups (e.g., acetylamino, dodecanesulfonamido, α-(3,4-di-tert-pentylphenoxy)butanamido, γ-(2,4-di-tert-pentylphenoxy)-butanamido, N-tetradecylcarbamoyl, N,N-dihexylcarbamoyl, N-butanesulfamoyl, N-methyl-N-tetradecanesulfamoyl), imido groups (e.g., succinimido, N-hydantoinyl, 3-hexadecenylsuccinimido), ureido groups (e.g., phenylureido, N,N-dimethylureido, N-[3-(2,4-di-tert-pentylphenoxy)propyl]ureido), aliphatic or aromatic sulfonyl groups (e.g., methanesulfonyl, phenylsulfonyl, dodecanesulfonyl, 2-butoxy-5-tert-octylbenzenesulfonyl), aliphatic or aromatic thio groups (e.g., phenylthio, ethylthio, hexadecylthio, 4-(2,4-di-tert-phenoxyacetamido)benzylthio), hydroxyl groups, sulfonic acid groups, and halogen atoms (e.g., fluorine, chlorine, bromine). When there are two or more such substituents, they may be the same or different.

In formula (IV), $X^3$ represents a coupling-off group. Examples of such a coupling-off group include halogen atoms (e.g., fluorine, chlorine, bromine), alkoxy groups (e.g., dodecyloxy, dodecyloxycarbonylmethoxy, methoxycarbamoylmethoxy, carboxypropyloxy, methanesulfonyloxy), aryloxy groups (e.g., 4-methylphenoxy, 4-tert-butylphenoxy, 4-methanesulfonylphenoxy, 4-(4-benzyloxyphenylsulfonyl)phenoxy, 4-(4-hydroxyphenylsulfonyl)phenoxy, 4-methoxycarbonylphenoxy), acyloxy groups (e.g., acetoxy, tetradecanoyloxy, benzoyloxy), sulfonyloxy groups (e.g., methanesulfonyloxy, toluenesulfonyloxy), amido groups (e.g., dichloroacetylamino, methanesulfonylamino, trinonyl phosphonamido), alkoxycarbonyloxy groups (e.g., ethoxycarbonyloxy, benzyloxycarbonyloxy), aryloxycarbonyloxy groups (e.g., phenoxycarbonyloxy), aliphatic or aromatic thio groups (e.g., phenylthio, dodecylthio, benzylthio, 2-butoxy-5-tertoctylphenylthio, 2,5-octyloxyphenyl, 2-(2-ethoxyethoxy)-5-tert-octylphenylthio, tetrazolylthio), imido groups (e.g., succinimido, hydantoinyl, 2,4-dioxoxazolidine-3-yl, 3-benzyl-4-ethoxyhydantoin-1-yl, 3-benzylhydantoin-1yl, 1-benzyl-2-phenyl-3,5-dioxo-1,2,4-triazolidine-4-yl, 3-benzyl-4-ethoxyhydantoin-1-yl), and N-heterocyclic groups (e.g., 1-pyrazolyl, 1-benzotriazolyl, 5-chloro-1,2,4-triazole-1-yl). These eliminatable groups may contain photographically useful groups.

$R^{61}$ and $X^3$ in formula (IV) may form a dimer or higher polymer.

Specific examples of yellow couplers represented by formula (IV) are shown below, but the present invention is not to be construed as being limited thereto.

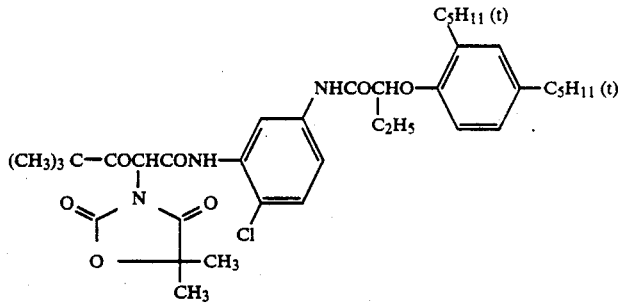

(Y-1)

-continued
(Y-2)
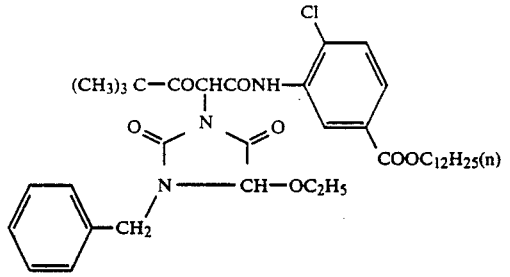
(Y-3)
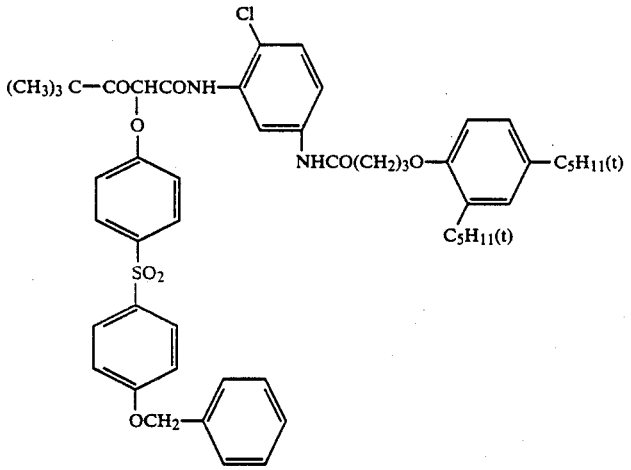
(Y-4)
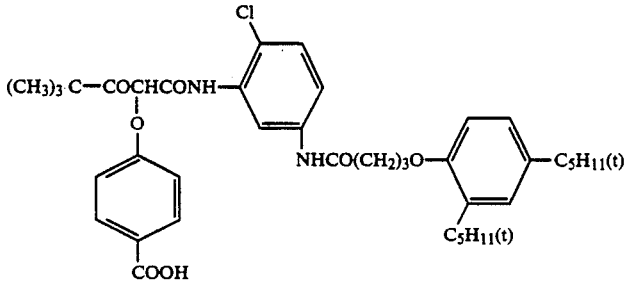
(Y-5)
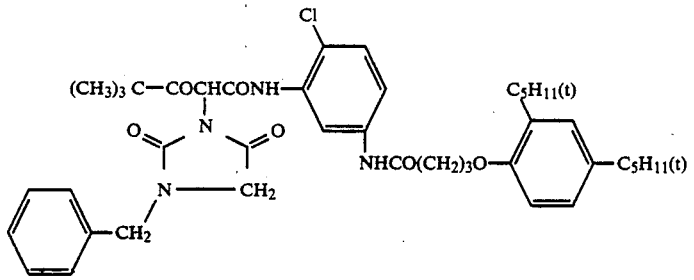
(Y-6)
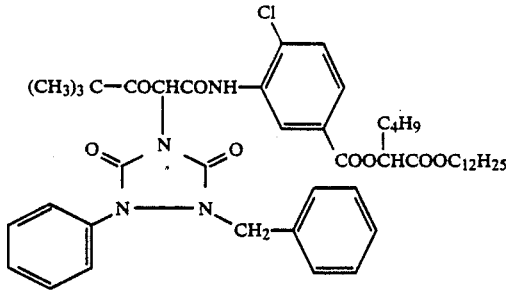

-continued
(Y-7)
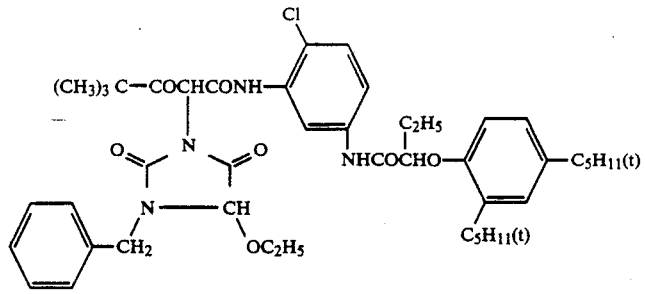
(Y-8)
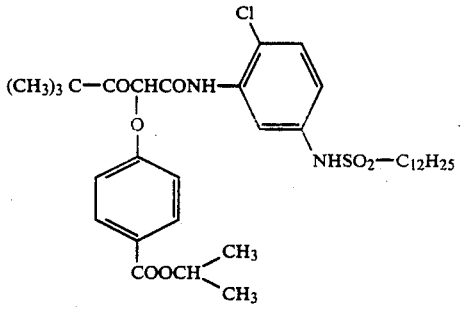
(Y-9)
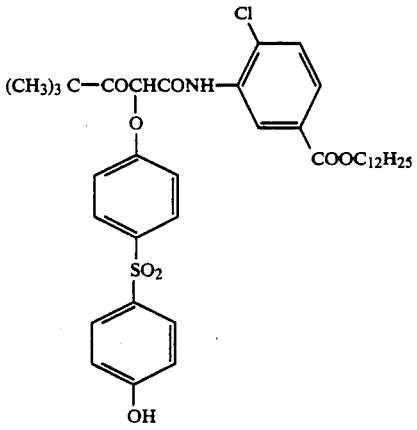
(Y-10)
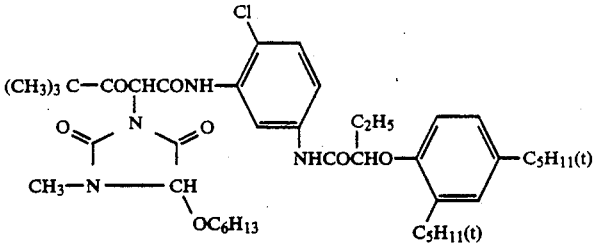

-continued
(Y-11)
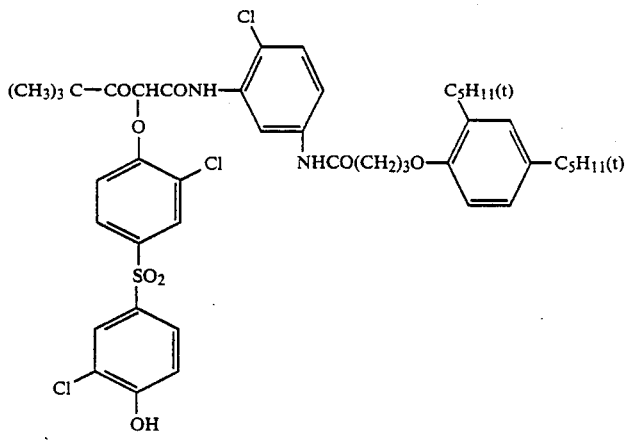
(Y-12)
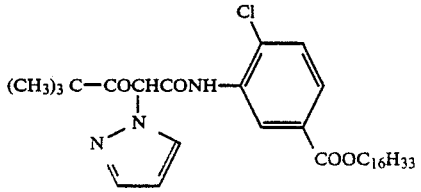
(Y-13)
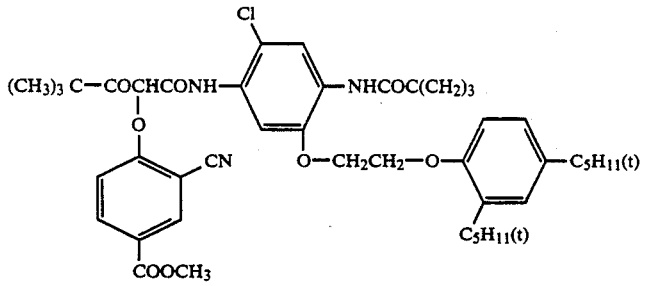
(Y-14)
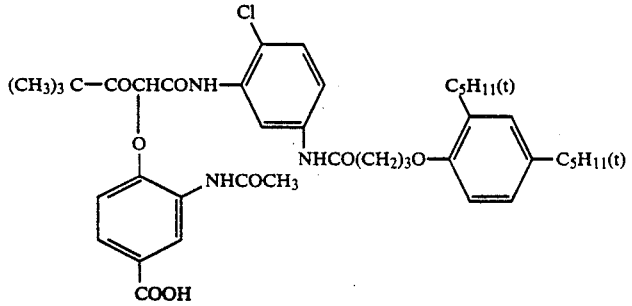
(Y-15)
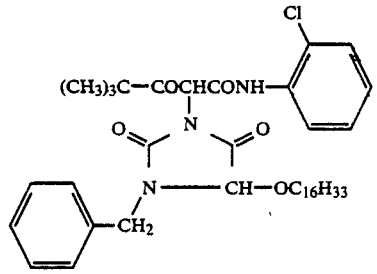
The cyan coupler which is particularly preferably used in the present invention is represented by formula (V):

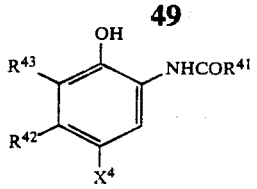

(V)

wherein $R^{41}$ represents an alkyl group, an aryl group, an amino group or a heterocyclic group; $R^{42}$ represents an acylamino group or an alkyl group containing two or more carbon atoms; and $R^{43}$ represents hydrogen, a halogen atom, an alkyl group or an alkoxy group. $R^{43}$ may be bonded to $R^{42}$ to form a ring.

$X^4$ represents hydrogen, or a coupling-off group, i.e., a halogen atom or a group capable of being eliminated upon reaction with an oxidation product of an aromatic primary amine color developing agent.

In formula (V), examples of $C_{1-32}$ alkyl groups represented by $R^{41}$ include methyl, butyl, tridecyl, cyclohexyl and allyl groups. Examples of aryl groups represented by $R^{41}$ include phenyl and naphthyl groups. Examples of heterocyclic groups represented by $R^{41}$ include 2-pyridyl and 2-furyl groups.

If $R^{41}$ is an amino group, it is preferably a phenyl-substituted amino group which may contain substituents.

$R^{41}$ may be further substituted by substituents selected from the group consisting of an alkyl group, an aryl group, an alkyloxy or aryloxy group (e.g., methoxy, dodecyloxy, methoxyethoxy, phenyloxy, 2,4-di-tert-amylphenoxy, 3-tert-butyl-4-hydroxyphenyloxy, naphthyloxy), a carboxyl group, an alkylcarbonyl or arylcarbonyl group (e.g., acetyl, tetradecanoyl, benzoyl), an alkyloxycarbonyl or aryloxycarbonyl group (e.g., methoxycarbonyl, phenoxycarbonyl), an acyloxy group (e.g., acetyl, benzoyloxy), a sulfamoyl group (e.g., N-ethylsulfamoyl, N-octadecylsulfamoyl), a carbamoyl group (e.g., N-ethylcarbamoyl, N-methyl-dodecylcarbamoyl), a sulfonamido group (e.g., methanesulfonamido, benzenesulfonamido), an acylamino group (e.g., acetylamino, benzamido, ethoxycarbonylamino, phenylaminocarbonylamino), an imido group (e.g., succinimido, hydantoinyl), a sulfonyl group (e.g., methanesulfonyl), a hydroxyl group, a cyano group, a nitro group, and a halogen atom.

In formula (V), $X^4$ represents hydrogen or a coupling-off group. Examples of such a coupling-off group include a halogen atom (e.g., fluorine, chlorine, bromine), an alkoxy group (e.g., dodecyloxy, methoxycarbamoylmethoxy, carboxypropyloxy, methylsulfonylethoxy), an aryloxy group (e.g., 4-chlorophenoxy, 4-methoxyphenoxy), an acyloxy group (e.g., acetoxy, tetradecanoyloxy, benzoyloxy), a sulfonyloxy group (e.g., methanesulfonyloxy, toluenesulfonyloxy), an amido group (e.g., dichloroacetylamino, methanesulfonylamino, toluenesulfonylamino), an alkoxycarbonyloxy group (e.g., ethoxycarbonyloxy, benzyloxycarbonyloxy), an aryloxycarbonyloxy group (e.g., phenoxycarbonyloxy), an aliphatic or aromatic thio group (e.g., phenylthio, tetrazolylthio), an imido group (e.g., succinimido, hydantoinyl), an N-heterocyclic group (e.g., 1-pyrazolyl, 1-benzotriazolyl), and an aromatic azo group (e.g., phenylazo). These eliminatable groups may contain photographically useful groups.

$R^{41}$ or $R^{42}$ in formula (V) may form a dimer or a higher polymer.

Specific examples of cyan couplers represented by formula (V) are shown below, but the present invention is not to be construed as being limited thereto.

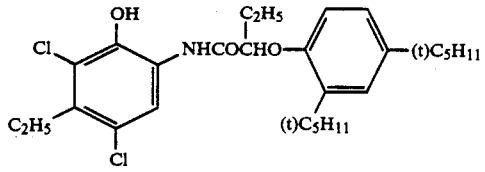

(C-1)

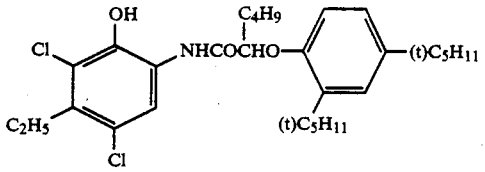

(C-2)

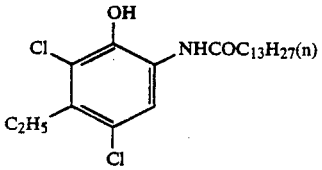

(C-3)

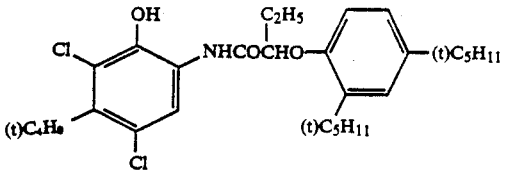

(C-4)

-continued
(C-5)
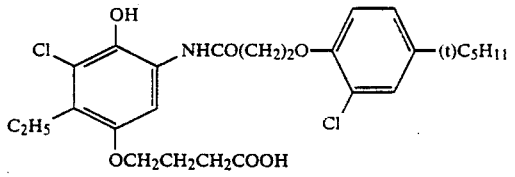
(C-6)
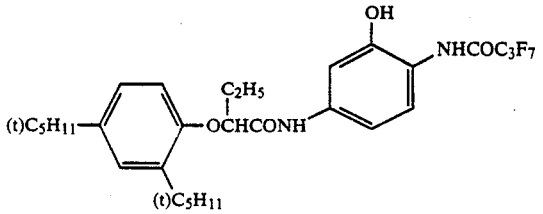
(C-7)
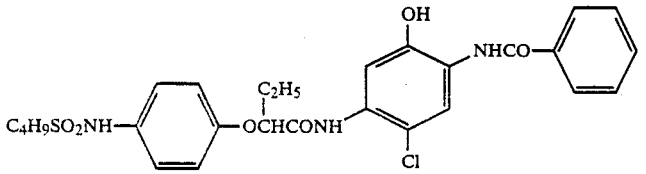
(C-8)
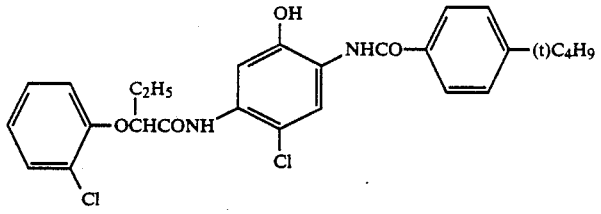
(C-9)
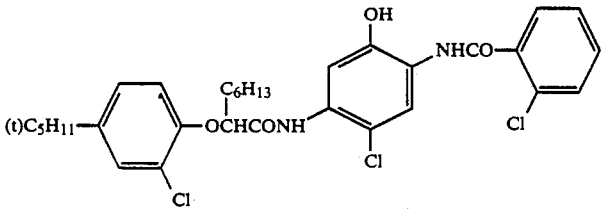
(C-10)
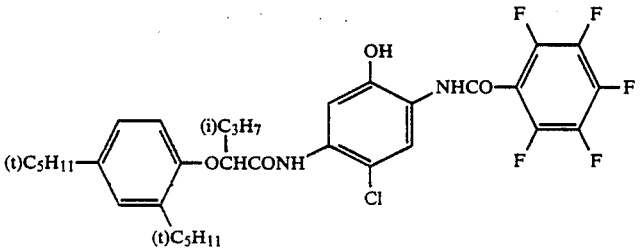
(C-11)
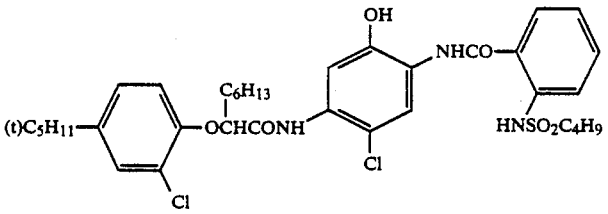

-continued
(C-12)
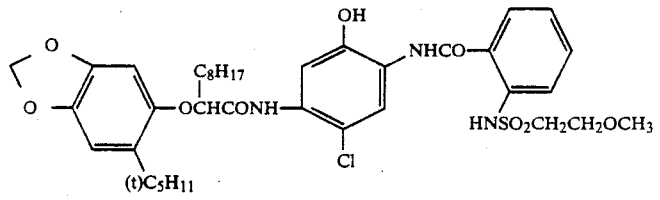
(C-13)
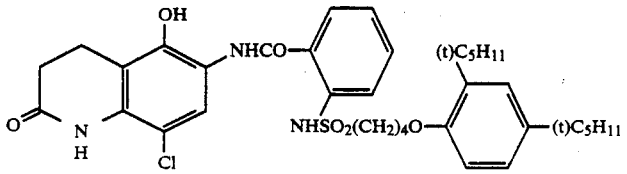
(C-14)
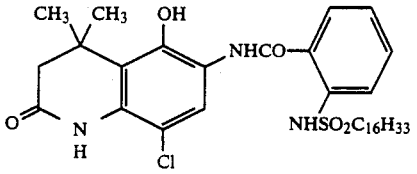
(C-15)
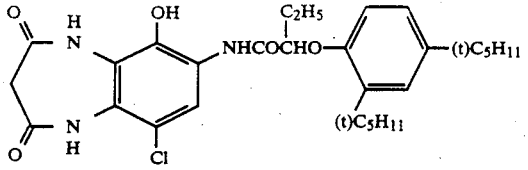
(C-16)
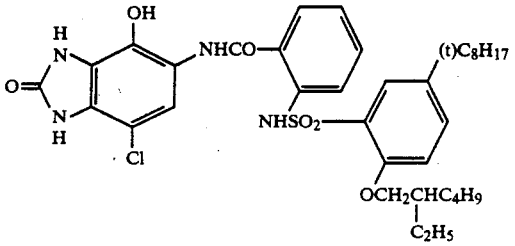
(C-17)
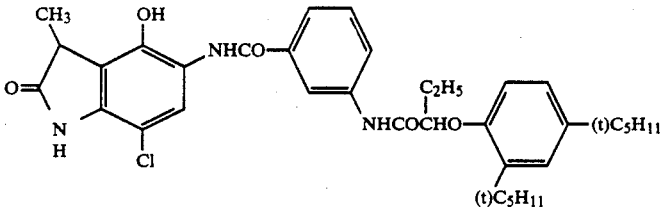
(C-18)
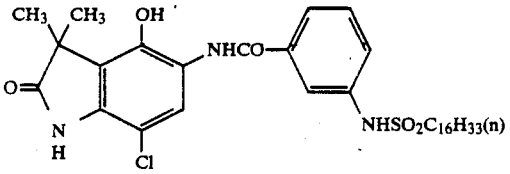
(C-19)
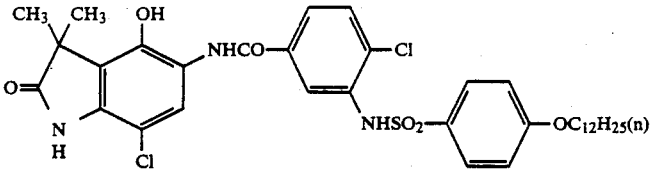

-continued
(C-20)
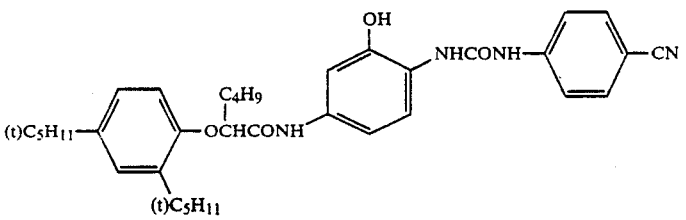
(C-21)
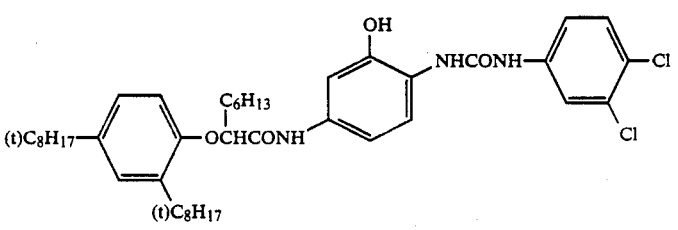
(C-22)
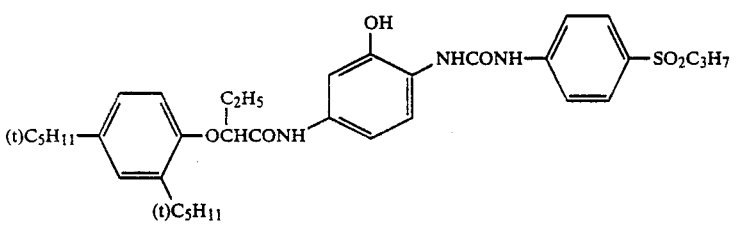
(C-23)
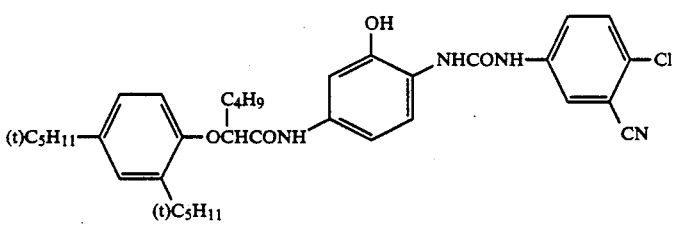
(C-24)
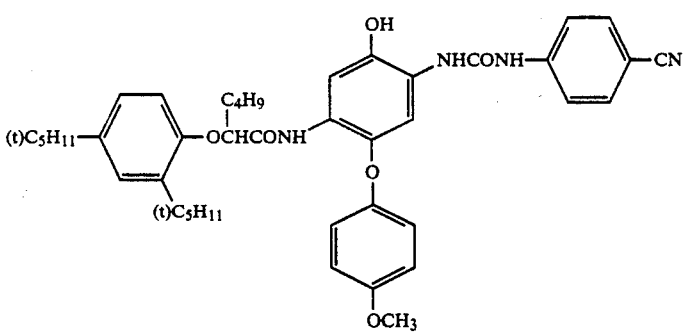
(C-25)
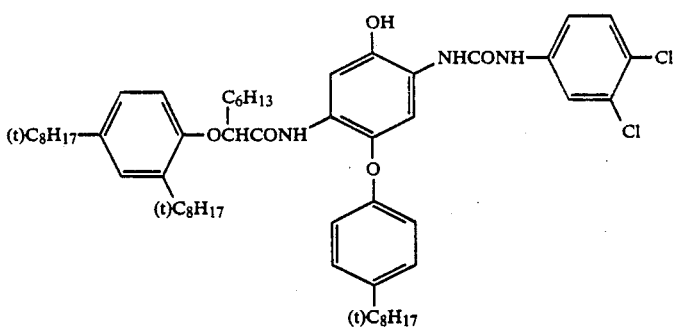

-continued

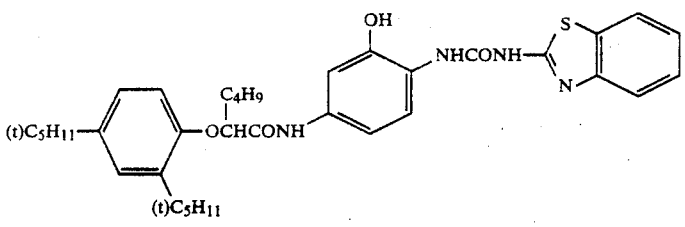

(C-26)

The amount of the coupler represented by each of formulae (III), (IV) and (V) incorporated is normally in the range of $1\times10^{-3}$ to $5\times10^{-1}$ mol, and preferably $5\times10^{-2}$ to $5\times10^{-1}$ mol per mol of silver in the same emulsion layer.

The silver halide in the photographic emulsion layers of the photographic materials of this invention may be any of silver bromide, silver iodobromide, silver iodochlorobromide, silver chlorobromide, and silver chloride.

Silver halide grains in the photographic emulsions may be regular grains having a regular crystal form, such as a cubic form, an octahedral form, and a tetradecahedral form, or those having an irregular crystal form such as a spherical form, those having a crystal defect such as a twinning plane, or those having a combination of these crystal forms. Mixtures of grains having various crystal forms may also be used.

The silver halide grains may be either fine grains of about 0.1 μm or smaller in diameter or large grains having a projected area diameter of up to about 10 μm, and the emulsion may be either a monodisperse emulsion having a narrow size distribution or a polydisperse emulsion having a broad size distribution.

The silver halide emulsions which can be used in the present invention can be prepared by known processes as disclosed, e.g., in *Research Disclosure,* Vol. 176, No. 17643, pp. 22 and 23 "I. Emulsion Preparation and Types" (December, 1978), ibid., Vol. 187, No. 18716, p. 648 (November, 1979).

The photographic emulsion used in the present invention can be prepared according to the processes described in P. Glafkides, *Chimie et Physique Photographique,* (Paul Montel, 1967), G. F. Duffin, *Photographic Emulsion Chemistry,* (Focal Press, 1966), and V. L. Zelikman et al., *Making and Coating Photographic Emulsion,* (Focal Press, 1964). In more detail, the emulsion can be prepared by any of the acid process, the neutral process and the ammonia process. The reaction can be carried out by any of a single jet process, a double jet process or a combination thereof. A method in which grains are formed in the presence of excess silver ions ("reverse mixing" method) may be used. Further, a controlled double jet process, in which the pAg of a liquid phase in which silver halide grains are formed is maintained constant, may also be used. According to the controlled double jet process, a silver halide emulsion having a regular crystal form and an almost uniform grain size can be obtained.

The emulsion can be subjected to physical ripening in the presence of a known silver halide solvent (e.g., ammonia, potassium thiocyanate, and thioethers and thione compounds described in U.S. Pat. No. 3,271,157 and JP-A-51-12360, JP-A-53-82408, JP-A-53-144319, JP-A-54-100717, and JP-A-54-155828). This technique also provides a silver halide emulsion having a regular crystal form and a uniform grain size distribution.

The silver halide emulsion containing the above-described regular grains can be obtained by controlling pAg and pH values during grain formation, as described in *Photographic Science and Engineering,* Vol. 6, pp. 159 to 165 (1962), *Journal of Photographic Science,* Vol. 12, pp. 242 to 251 (1964), U.S. Pat. No. 3,655,394, and British Patent No. 1,413,748.

The monodisperse emulsion which can be used in the present invention typically includes silver halide grains having a mean grain size of about 0.05 μm or greater, at least 95% by weight of which fall within a size range of ±40% of the mean grain size, and particularly having silver halide grains having a mean grain size of from 0.15 to 2 μm, at least 95% by weight or number of which fall within a size range of ±20% of the mean grain size. Processes for preparing such monodisperse emulsions are described in U.S. Pat. Nos. 3,574,628 and 3,655,394, and British Patent No. 1,413,748. The monodisperse emulsions described in JP-A-48-8600, JP-A-51-39027, JP-A-51-83097, JP-A-53-137133, JP-A-54-48521, JP-A-54-99419, JP-A-58-37635, and JP-A-58-49938 can also be used.

Tabular grains having an aspect ratio of 5 or more can also be used in the present invention. The tabular grains can be prepared easily by the processes described in Gutoff, *Photographic Science and Engineering,* Vol. 14, pp. 248 to 257 (1967), U.S. Pat. Nos. 4,434,226, 4,414,310, 4,433,048 and 4,439,520, and British Patent No. 2,112,157. Use of the tabular grains improves covering power and efficiency of color sensitization by sensitizing dyes, as described in detail in U.S. Pat. No. 4,434,226.

Grains having a crystal form controlled by use of a sensitizing dye or a certain additive during grain formation can also be used.

The individual silver halide crystals may have either a homogeneous structure or a heterogeneous structure composed of a core and an outer shell differing in halogen composition, or may have a layered structure. These emulsion grains are disclosed in British Patent No. 1,027,146 and U.S. Pat. Nos. 3,505,068 and 4,444,877. Further, the grains may have fused thereto a silver halide having a different halogen composition or a compound other than silver halide, e.g., silver thiocyanate or lead oxide. These emulsion grains are disclosed in U.S. Pat. Nos. 4,094,684, 4,142,900, 4,349,622, 4,395,478, 4,433,501, 4,463,087, 3,656,962 and 3,852,067, and JP-A-59-162540.

Additionally, grains having an internal latent image type structure which are obtained by forming sensitivity specks (e.g., $Ag_2S$, $Ag_n$, Au) on crystal surfaces by chemical sensitization, followed by further growth of silver halide are also useful.

During silver halide grain formation or physical ripening, a cadmium salt, a zinc salt, a lead salt, a thallium salt, an iridium salt or a complex thereof, a rhodium salt or a complex thereof, or an iron salt or a complex thereof may be present in the system.

These various emulsions may be either of the surface latent image type in which a latent image is predominantly formed on the surface of grains or of the internal latent image type in which a latent image is predominantly formed in the inside of the grains.

Further, the emulsion may be a direct reversal emulsion. The direct reversal emulsion may be any of the solarization type, the internal latent image type, the light fogged type, and the type using a nucleating agent, and a combination thereof.

Among them, it is preferred to use a non-prefogged internal latent image type emulsion and to fog it by light before or during processing or by use of a nucleating agent to thereby obtain a direct positive image.

In direct positive color light-sensitive materials, it is necessary to represent gradation in a narrower exposure range than ordinary negative positive light-sensitive materials. Thus, light-sensitive materials which provide a better white background are desired. Furthermore, since direct positive color light-sensitive materials are often processed by users themselves, a strict demand for prevention of pollution by processing solution exists. Therefore, the present invention is preferably applied to direct positive color light-sensitive materials.

In the third invention of the present application, the present color photographic light-sensitive material is a direct positive color light-sensitive material in which at least one of the silver halide emulsion layers is an internal latent image type silver halide emulsion layer which is not previously fogged and at least one layer of said material comprises a compound represented by formula (II) described hereinbefore.

Among compounds represented by formula (II), compounds represented by formula (II-A) described hereinbefore are preferred.

Methods are well known of imagewise exposing an internal latent image type silver halide emulsion which is not previously fogged to light, and then subjecting the emulsion to surface development after or while it is subjected to fogging to obtain a direct positive image.

The term "internal latent image silver halide photographic emulsion" as used herein means a silver halide photographic emulsion of the type which contains light-sensitive nuclei mainly inside silver halide grains and forms latent images mainly inside the silver halide grains upon exposure.

Various such emulsions are known in the art, including those described in U.S. Pat. Nos. 2,592,250, 2,466,957, 2,497,875, 2,588,982, 3,317,322, 3,761,266, 3,761,276 and 3,796,577, and British Patent Nos. 1,151,363, 1,150,553 and 1,011,062.

These known methods make it possible to prepare a photographic light-sensitive material with a relatively high sensitivity for direct positive type light-sensitive materials.

The details of the above-described mechanism for the formation of direct positive images are described in T. H. James, *The Theory of the Photographic Process*, (4th Ed.), Chapter 7, pp. 182 to 193, and U.S. Pat. No. 3,761,276.

Light-sensitive materials containing a direct positive emulsion are normally developed while being subjected to fogging and thus are susceptible to an increase in minimum image density (Dmin).

A hydroquinone derivative is often added to the system in order to eliminate this disadvantage, as described in JP-A-63-80250. However, ordinary hydroquinone derivatives are not sufficiently effective and cause a drop in maximum image density Dmax.

In accordance with the present invention, a direct positive color photographic light-sensitive material which exhibits low Dmin, an improved contrast in the toe gradation and high Dmax can be obtained.

The non-prefogged internal latent image type silver halide emulsion is an emulsion containing silver halide grains whose surface is not previously fogged, and which form a latent image mainly in the inside thereof. More specifically, a silver halide emulsion is coated on a transparent support to a given coverage and exposed to light for a fixed time of from 0.01 to 10 seconds. The exposed sample is developed in Developer A having the following formulation (internal developer) at 20° C. for 6 minutes, and the maximum density is measured by a conventional measurement method. A similarly exposed sample is developed in Developer B having the following formulation (surface developer) at 18° C. for 5 minutes, and the maximum density is measured. Preferred internal latent image type silver halide emulsions are those having a former maximum density at least 5, more preferably at least 10, times the latter maximum density.

| | |
|---|---|
| Internal Developer A: | |
| Metol | 2 g |
| Sodium Sulfide (anhydrous) | 90 g |
| Hydroquinone | 8 g |
| Sodium Carbonate (monohydrate) | 52.5 g |
| KBr | 5 g |
| KI | 0.5 g |
| Water to make | 1 liter |
| Surface Developer B: | |
| Metol | 2.5 g |
| l-Ascorbic Acid | 10 g |
| $NaBO_2.4H_2O$ | 35 g |
| KBr | 1 g |
| Water to make | 1 liter |

Specific examples of internal latent image type emulsion include conversion type silver halide emulsions as described in British Patent No. 1,011,062 and U.S. Pat. Nos. 2,592,250 and 2,456,943 and core/shell type silver halide emulsions. The core/shell type silver halide emulsions include those described in JP-A-47-32813, JP-A-47-32814, JP-A-52-134721, JP-A-52-156614, JP-A-53-60222, JP-A-53-66218, JP-A-53-66727, JP-A-55-127549, JP-A-57-136641, JP-A-58-70221, JP-A-59-208540, JP-A-59-216136, JP-A-60-247237, JP-A-61-2148, JP-A-61-3137 and JP-A-62-194248, JP-B-56-18939, JP-B-58-1412, JP-B-58-1415, JP-B-58-6935 and JP-B-58-108528, U.S. Pat. Nos. 3,206,313, 3,317,322, 3,761,266, 3,761,276, 3,850,637, 3,923,513, 4,035,185, 4,395,478 and 4,504,570, European Patent No. 0,017,148, and *Research Disclosure*, No. 16345 (November, 1977).

Removal of soluble silver salts from an emulsion after physical ripening can be achieved by a noodle washing method, a flocculation sedimentation method, and an ultrafiltration method, and the like.

The emulsion used in the present invention is usually subjected to physical ripening, chemical ripening, and spectral sensitization. Additives to be used in these steps are described in *Research Disclosure*, No. 17643 (December, 1978) and ibid., No. 18716 (November, 1979).

In using direct positive light-sensitive materials in the present invention, fogging is effected by a "light fogging method" and/or a "chemical fogging method" as described below. Exposure of the entire surface in the light fogging method, i.e., fogging exposure, in the present invention is conducted during development processing after imagewise exposure and/or during development processing. Namely, an imagewise exposed light-sensitive material is exposed to light while it is dipped in a developer or a prebath of a developer, or after being taken out from the developer or the prebath but before it is desired, preferably while it is in the developer.

A light source having a wavelength within the sensitive wavelengths of the light-sensitive material can be used for fogging exposure. In general, any of a fluorescent lamp, a tungsten lamp, a xenon lamp, and sunlight is employable. Specific methods for fogging exposure are described, e.g., in British Patent No. 1,151,363, JP-B-45-12710, JP-B-45-12709 and JP-B-58-6936, and JP-A-48-9727, JP-A-56-137350, JP-A-57-129438, JP-A-58-62652, JP-A-58-60739, JP-A-59-70223 (corresponding to U.S. Pat. No. 4,440,851), and JP-A-58-120248 (corresponding to European Patent No. 89101A2). In the case of light-sensitive materials having light sensitivity in the whole wavelength region, for example, color light-sensitives, a light source having high color rendition properties (as close to white as possible) as described in JP-A-56-137350 and JP-A-58-70223 is suitable. The intensity of illumination suitably ranges from 0.01 to 2,000 lux, preferably from 0.05 to 30 lux, more preferably from 0.05 to 5 lux. It is desirable to use a lower intensity of illumination as the sensitivity of the emulsions used in the light-sensitive material is increased. The intensity of illumination can be controlled by varying the luminous intensity of the light source, reducing light by means of various filters, or varying the distance between the light-sensitive material and the light source or the angle between the light-sensitive material and the light source. Further, the intensity of illumination of fogging light can be increased from low to high either continuously or stepwise.

It is recommended that the light-sensitive material is irradiated with light after it is dipped in a developer or a prebath thereof and the liquid sufficiently penetrates into the emulsion layers. The time from the penetration of the liquid to light fog exposure is generally in the range of from 2 seconds to 2 minutes preferably from 5 seconds to 1 minute, more preferably from 10 to 30 seconds.

The exposure time for fogging usually ranges from 0.01 second to 2 minutes, preferably from 0.1 second to 1 minute, more preferably from 1 to 40 seconds.

A nucleating agent to be used in the "chemical fogging method" in the present invention can be incorporated into the light-sensitive material or a processing solution, and preferably into the light-sensitive material.

The term "nucleating agent" as used herein means a substance acting during surface development processing of an internal latent image type silver halide emulsion not having been previously fogged to form a direct positive image. In the present invention, fogging using the nucleating agent is particularly preferred.

In cases where the nucleating agent is incorporated into the light-sensitive material, it is preferably added into the internal latent image type silver halide emulsion layer. It may also be added to other layers, for example, an intermediate layer, a subbing layer, and a backing layer, as long as the nucleating agent added is diffused during coating or processing to be adsorbed onto silver halide grains.

In cases where the nucleating agent is added to a processing solution, it may be added to a developer or a prebath of a lower pH value as described in JP-A-58-178350.

Two or more kinds of nucleating agents may be used in combination.

The nucleating agent which is preferably used in the present invention includes compounds represented by formulae (N-I) and (N-II):

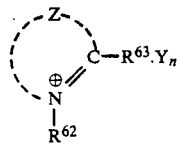

(N-I)

wherein Z, which may have a substituent, represents a nonmetallic atomic group necessary to form a 5- or 6-membered heterocyclic ring; $R^{62}$ represents an aliphatic group; $R^{63}$ represents a hydrogen atom, an aliphatic group or an aromatic group; $R^{62}$ or $R^{63}$ may have a substituent; $R^{63}$ may be connected to the heterocyclic ring formed by Z to form a ring; provided that at least one of $R^{62}$, $R^{63}$ and Z contains an alkynyl group, an acyl group, a hydrazine group, or a hydrazone group, or $R^{62}$ and $R^{63}$ form a 6-membered ring to form a dihydropyridinium skeleton; at least one of $R^{62}$, $R^{63}$, and substituents of Z may contain a group accelerating adsorption onto silver halide; Y represents a counter ion required for charge balance; and n is 0 or 1.

Specific examples of compounds represented by formula (N-I) are as follows, but the present invention is not to be construed as being limited thereto:

(N-I- 1): 5-Ethoxy-2-methyl-1-propargylquinolinium bromide (N-I- 2): 2,4-Dimethyl-2-propargylquinolinium bromide (N-I- 3): 3,4-Dimethyldihydropyrido[2,1-b]-benzothiazolium bromide (N-I- 4): 6-Ethoxythiocarbonylamino-2-methyl-1-propargylquinolinium trifluoromethanesulfonate (N-I- 5): 6-(5-Benzotriazolecarboxamido)-2-methyl-1-propargylquinolinium trifluoromethanesulfonate (N-I- 6): 6-(5-Mercaptotetrazole-1-yl)-2-methyl-1-propargylquinolinium iodide (N-I- 7): 6-Ethoxythiocarbonylamino-2-(2-methyl-1-propenyl)-1-propargylquinolinium trifluoromethanesulfonate (N-I- 8): 10-Propargyl-1,2,3,4-tetrahydroacrylidinium trifluoromethanesulfonate (N-I- 9): 7-Ethoxythiocarbonylamino-10-propargyl-1,2,3,4-tetrahydroacrylidinium trifluoromethanesulfonate (N-I-10): 7-[3-(5-Mercaptotetrazole-1-yl)benzamido]-10-propargyl-1,2,3,4-tetrahydroacrylidinium perchlorate (N-I-11): 7-(5-Mercaptotetrazole-1-yl)-9-methyl-10-propargyl-1,2,3,4-tetrahydroacrylidinium bromide (N-I-12): 7-Ethoxythiocarbonylamino-10-propargyl-1,2-dihydroacrylidinium trifluoromethanesulfonate (N-I-13): 10-Propargyl-7-[3-(1,2,3,4-thiatriazole-5-ylamino)benzamido]-1,2,3,4-tetrahydroacrylidinium perchlorate (N-I-14): 7-(3-Cyclohexylmethoxythiocarbonylaminobenzamido)-10-propargyl-1,2,3,4-tetrahydroacrylidinium trifluoromethanesulfonate (N-I-15): 7-(3-Ethoxythiocarbonylaminobenzamido)-10-propargyl-1,2,3,4-tetrahydroacrylidinium trifluoromethanesulfonate (N-I-16): 7-[3-(3-Ethoxythiocarbonylaminophenyl-)ureido]-10-propargyl-1,2,3,4-tetrahydroacrylidinium trifluoromethanesulfonate (N-I-17): 7-(3-Ethoxythiocarbonylaminobenzenesulfonamido)-10-propargyl-1,2,3,4-tetrahydroacrylidinium trifluoromethanesulfonate (N-I-18): 7-[3-{3-[3-(5-Mercaptotetrazole-1-yl)phenyl]-ureido}benzamido]-10-propargyl-1,2,3,4-tetrahydroacrylidinium trifluoromethanesulfonate (N-I-19): 7-[3-(5-Mercapto-1,3,4-thiadiazole-1-ylamino)-benzamido]-10-propargyl-1,2,3,4-tetrahydroacrylidinium trifluoromethanesulfonate (N-I-20): 7-[3-(3-Butylthioureido)benzamido]-10-propargyl-1,2,3,4-tetrahydroacrylidinium trifluoromethanesulfonate

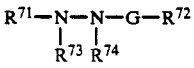

(N-II)

wherein $R^{71}$ represents an aliphatic group, an aromatic group or a heterocyclic group; $R^{72}$ represents hydrogen, an alkyl group, an aralkyl group, an aryl group, an alkoxy group, an aryloxy group or an amino group; G represents a carbonyl group, a sulfonyl group, a sulfoxy group, a phospholyl group or an iminomethylene group

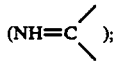

and $R^{73}$ and $R^{74}$, which may be the same or different, each represents hydrogen or one of $R^{73}$ and $R^{74}$ represents hydrogen and the other represents an alkylsulfonyl group, an arylsulfonyl group or an acyl group; provided that a hydrazone structure

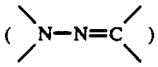

containing G, $R^{72}$, $R^{74}$ and hydrazine nitrogen may be formed. The above-described groups may be substituted by substituents, if possible.

Specific examples of compounds represented by formula (N-II) are as follows, but the present invention is not to be construed as being limited thereto:

(N-II- 1): 1-Formyl-2-{4-[3-(2-methoxyphenyl)ureido]-phenyl}hydrazine (N-II- 2): 1-Formyl-2-{4-[3-{3-[3-(2,4-di-tert-pentylphenoxy)propyl]ureidophenylsulfonylamino]phenyl} hydrazine (N-II- 3): 1-Formyl-2-{4-[3-(5-mercaptotetrazole-1-yl)benzamido]phenyl}hydrazine (N-II- 4): 1-Formyl-2-[4-{3-[3-(5-mercaptotetrazole-1-yl)phenyl]hydrazine (N-II- 5): 1-Formyl-2-[4-{3-[N-(5-mercapto-4-methyl-1,2,4-triazole-3-yl)carbamoyl]propanamido}phenyl]-hydrazine (N-II- 6): 1-Formyl-2-{4-[3-{N-[4-(3-mercapto-1,2,4-triazole-4-yl)phenyl]carbamoyl}propanamido]-phenyl}hydrazine N-II- 7): 1-Formyl-2-[4-{3-[5-mercapto-1,3,4-thiadiazole-2-yl)carbamoyl]propanamido}phenyl]hydrazine (N-II- 8): 2-[4-(Benzotriazole-5-carboxamido)phenyl]-1-formylhydrazine (N-II- 9): 2-[4-{3-[N-(benzotriazole-5-carboxamido)carbamoyl]propanamido}phenyl]-1-formylhydrazine (N-II-10): 1-Formyl-2-{4-[1-(N-phenylcarbamoyl)thiosemicarbazido]phenyl}hydrazine (N-II-11): 1-Formyl-2-{4-[3-(3-phenylthioureido)benzamido]phenyl}hydrazine (N-II-12): 1-Formyl-2-[4-(3-hexylureido)phenyl]hydrazine (N-II-13) 1-Formyl-2-{4-[3-(5-mercaptotetrazole-1-yl)benzenesulfonamido]phenyl}hydrazine (N-II-14): 1-Formyl-2-{4-[3-{3-[3-(5-mercaptotetrazole-1-yl)phenyl]ureido}benzenesulfonamido]phenyl}hydrazine (N-II-15): 1-Formyl-2-[4-{3-[3-(2,4-di-tert-pentylphenoxy)propyl]ureido}phenyl]hydrazine The above-described nucleating agent can be incorporated in the light-sensitive material or a solution for processing the light-sensitive material, and is preferably in the light-sensitive material.

In the case where the nucleating agent is incorporated in the light-sensitive material, it is preferably incorporated in the internal latent image type silver halide emulsion layer. The nucleating agent may be incorporated in other layers, e.g., an intermediate layer, subbing layer or backing layer so far as it is dispersed and adsorbed by silver halide grains during coating or processing. In the case where the nucleating agent is incorporated in the processing solution, it may be incorporated in the developing solution or a prebath with a low pH as described in JP-A-58-178350.

In the case where the nucleating agent is incorporated in the light-sensitive material, the amount incorporated is preferably in the range of $10^{-8}$ to $10^{-2}$ mol, particularly $10^{-7}$ to $10^{-3}$ mol per mol of silver halide.

In the case where the nucleating agent is incorporated in the processing solution, the amount incorporated is preferably in the range of $10^{-5}$ to $10^{-1}$ mol/-liter, preferably $10^{-4}$ to $10^{-2}$ mol/liter.

In order to further promote the effects of the above-described nucleating agent, the following nucleation accelerators can be used.

Nucleation accelerators include tetraazaindenes, triazaindenes and pentaazaindenes containing at least one mercapto group which may be optionally substituted by an alkaline metal atom or ammonium group, and compounds described in JP-A-63-106656 (pp. 6 to 16).

Specific examples of suitable nucleation accelerators are described below, but the present invention is not to be construed as being limited thereto:

(B- 1): 3-Mercapto-1,2,4-triazolo[4,5-a]pyridine (B- 2): 3-Mercapto-1,2,4-triazolo[4,5-a]pyrimidine (B- 3): 5-Mercapto-1,2,4-triazolo[1,5-a]pyrimidine (B- 4): 7-(2-Dimethylaminoethyl)-5-mercapto-1,2,4-triazolo[1,5-a]pyrimidine (B- 5): 3-Mercapto-7-methyl-1,2,4-triazolo[4,5-a]-pyrimidine (B- 6): 3,6-Dimercapto-1,2,4-triazolo[4,5-b]pyridazine (B- 7): 2-Mercapto-5-methylthio-1,3,4-thiadiazole (B- 8): 3-Mercapto-4-methyl-1,2,4-triazole (B- 9): 2-(3-Dimethylaminopropylthio)-5-mercapto-1,3,4-thiadiazole hydrochloride (B-10): 2-(2-Morpholinoethylthio)-5-mercapto-1,3,4-thiadiazole hydrochloride The nucleation accelerator can be incorporated in the light-sensitive material or the processing solution, preferably in the light-sensitive material. In the case where the nucleation accelerator is incorporated in the light-sensitive material, it is preferably incorporated in the internal latent image type silver halide emulsion layer or other hydrophilic colloidal layers (e.g., intermediate layer or protective layer), particularly in the silver halide emulsion layer or its adjacent layers.

Known photographic additives which can be used in the present invention are summarized in the following table.

| | Additives | RD 17643 | RD 18716 |
|---|---|---|---|
| 1. | Chemical Sensitizers | Page 23 | Page 648, right column |
| 2. | Sensitivity Increasing Agents | — | Page 648, right column |
| 3. | Spectral Sensitizers, Supersensitizers | Pages 23–24 | Page 648, right column to page 649, right column |
| 4. | Brightening Agents | Page 24 | — |
| 5. | Antifoggants and Stabilizers | Pages 24–25 | Page 649, right column |
| 6. | Light Absorbers, Filter Dyes, Ultraviolet Absorbers | Pages 25–26 | Page 649, right column to page 650, left column |
| 7. | Antistaining Agents | Page 25, right column | Page 650, left to right columns |
| 8. | Dye Image Stabilizers | Page 25 | — |
| 9. | Hardeners | Page 26 | Page 651, left column |
| 10. | Binders | Page 26 | Page 651, left column |
| 11. | Plasticizers, Lubricants | Page 27 | Page 650, right column |
| 12. | Coating Aids, Surface Active Agents | Pages 26–27 | Page 650, right column |
| 13. | Antistatic Agents | Page 27 | Page 650, right column |

The incorporation of the present coupler in the emulsion layer can be accomplished by dissolving the coupler in a high boiling organic solvent and/or a low boiling organic solvent, subjecting the solution to emulsion dispersion in gelatin or another hydrophilic colloid aqueous solution by high speed agitation in a homogenizer, mechanical atomization in a colloid mill or ultrasonic process, and then incorporating the dispersion in the emulsion layer. In this case, the high boiling organic solvent is not necessary. The compounds described in JP-A-62-215272 (pp. 440 to 467) are preferably used.

The dispersion of the present coupler in the hydrophilic colloid can be accomplished by a method as described in JP-A-62-215272 (pp. 468 to 475).

The light-sensitive material prepared according to the present invention may contain as a color fog inhibitor or a color stain inhibitor a hydroquinone derivative, an aminophenol derivative, amine, a gallic acid derivative, a catechol derivative, an ascorbic acid derivative, a colorless coupler, a sulfonamidophenol derivative or the like. Typical examples of such a color fog inhibitor or a color stain inhibitor are described in JP-A-62-215272 (pp. 600 to 663).

The light-sensitive material of the present invention can contain any conventional discoloration inhibitors. Typical examples of organic discoloration inhibitors include hydroquinones, 6-hydroxychromans, 5-hydroxycoumarans, spirochromans, p-alkoxyphenols, hindered phenols such as bisphenols, gallic acid derivatives, methylenedioxybenzenes, aminophenols, hindered amines, and ether or ester derivatives obtained by silylating or alkylating phenolic hydroxyl groups thereof. Metal complexes such as (bissalicylamidoxymato)nickel complex and (bis-N,N-dialkyldithiocarbamato)nickel complex can also be used.

Compounds containing both hindered amine and hindered phenol structures in the same molecule as described in U.S. Pat. No. 4,268,593 have a good effect of inhibiting deterioration of yellow dyes due to heat, light and moisture. Spiroindanes as described in JP-A56-159644 and hydroquinonediether- or monoether-substituted chromans as described in JP-A-55-89835 have a good effect of inhibiting deterioration of magenta dyes, particularly due to light.

Typical examples of these discoloration inhibitors are described in JP-A-62-215272 (pp. 401 to 440). These compounds can be incorporated in the light-sensitive layer in the form of a coemulsion with the respective color coupler in an amount of 5 to 100% by weight based on the color coupler.

The inhibition of deterioration of cyan dyes due to heat and light, particularly due to light, can be effectively accomplished by the incorporation of an ultraviolet absorber in the opposite layers adjacent to the cyan dye layer. The ultraviolet absorber can also be incorporated in a hydrophilic colloid layer such as protective layer. Typical examples of such an ultraviolet absorber are described in JP-A-62-215272 (pp. 391 to 400).

As a binder or protective colloid for the emulsion layer or intermediate layer in the present light-sensitive material gelatin can be advantageously used. Other hydrophilic colloids also can be used.

The light-sensitive materials of the invention can further contain dyes for preventing irradiation or halation, ultraviolet absorbents, plasticizers, fluorescent brightening agents, matting agents, air fogging inhibitors, coating aids, hardening agents, antistatic agents, slip agents, and so on. Typical examples of these additives are described in *Research Disclosure*, No. 17643, pp. 25 to 27, VIII to XIII (December, 1978) and ibid., No. 18716, pp. 647–651 (November, 1979).

The present invention also includes multilayer multicolor photographic materials having at least two layers differing in spectral sensitivity on a support. The multilayer multicolor photographic materials usually comprise a support having provided thereon at least one red-sensitive emulsion layer, at least one green-sensitive emulsion layer, and at least one blue-sensitive emulsion layer. The order of these layers may be varied as desired. A preferred order of the layers is red-sensitive, green-sensitive and blue-sensitive layers from the support or green-sensitive, red-sensitive and blue-sensitive layers from the support. Each of these emulsion layers may be composed of two or more emulsion layers differing in sensitivity. A light-insensitive layer may be present among two or more emulsion layers having the same color sensitivity. It is typical a red-, green- or blue-sensitive emulsion layer contains a cyan-, magenta- or yellow-dye-forming coupler, respectively. Other combinations may also be used, if desired.

For the purpose of increasing the maximum image density, decreasing the minimum image density, improving the preservability of the light-sensitive material or accelerating development, the present light-sensitive material can contain hydroquinones (e.g., compounds described in U.S. Pat. Nos. 3,227,552 and 4,279,987), chromans (e.g., compounds described in U.S. Pat. No. 4,268,621, JP-A-54-103031, and *Research Disclosure,* No. 18264 (June, 1979), pp. 333 and 334), quinones (e.g., compounds described in *Research Disclosure,* No. 21206 (December, 1981), pp. 433 and 434), amines (e.g., compounds described in U.S. Pat. No. 4,150,993 and JP-A58-174757), oxidizers (e.g., compounds described in JP-A-60-260039, and *Research Disclosure,* No. 16936 (May, 1978), pp. 10 and 11), catechols (e.g., compounds described in JP-A-55-21013 and JP-A-55-65944), compounds which release a nucleating agent upon development (e.g., compounds described in JP-A-60-107029), thioureas (e.g., compounds described in JP-A-60-95533), and spiroindanes (e.g., compounds described in JP-A-55-65944).

In addition to the silver halide emulsion layers, the light-sensitive materials of the invention preferably contain auxiliary layers, such as a protective layer, an intermediate layer, a filter layer, an antihalation layer, a backing layer, a white reflective layer, and the like.

The photographic emulsion layers and other layers in the photographic materials of the invention are coated on a support, such as the supports described in *Research Disclosure,* No. 17643, p. 28 VII (December, 1978), European Patent No. 0,102,253, and JP-A-61-97655. The method of coating described in *Research Disclosure,* No. 17643, pp. 28 and 29, XV can be used.

The present invention is applicable to various types of color light-sensitive materials, such as color reversal films for slides or television, color reversal papers, and instant color films. The present invention is also applicable to black-and-white light-sensitive materials utilizing three color mixing as described in *Research Disclosure,* No. 17123 (July, 1978).

Color developers to be used for development processing of light-sensitive materials according to the present invention preferably include alkaline aqueous solutions containing, as a main component, an aromatic primary amine developing agent. Useful color developing agents include aminophenol compounds, and preferably p-phenylenediamine compounds. Typical examples of the latter are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides or p-toluenesulfonates thereof. These compounds may be used in combination of two or more thereof.

The color developer generally contains pH buffers, such as carbonates, borates or phosphates of alkali metals, and developing inhibitors or antifoggants, such as bromides, iodides, benzimidazoles, benzothiazoles and mercapto compounds. If desired, the color developer may further contain various preservatives, e.g., hydroxylamine, diethylhydroxylamine, hydrazine sulfites, phenylsemicarbazides, triethanolamine, catecholsulfonic acids, and triethylenediamine (1,4-diazabicyclo[2,2,-2]octane); organic solvents, e.g., ethylene glycol and diethylene glycol; development accelerators, e.g., benzyl alcohol, polyethylene glycol, quaternary ammonium salts, and amines; color forming couplers; competing couplers; fogging agents, e.g., sodium boron hydride; auxiliary developing agents, e.g., 1-phenyl-3-pyrazolidone; viscosity imparting agents; various chelating agents exemplified by aminopolycarboxylic acids, aminopolyphosphonic acids, alkylphosphonic acids, and phosphonocarboxylic acids, e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N-tetramethylenephosphonic acid, and ethylenediaminedi(o-hydroxyphenylacetic acid), and salts thereof.

Reversal processing is usually carried out by black-and-white development followed by color development. Black-and-white developers to be used can contain one or more known black-and-white developing agents, such as dihydroxybenzenes, e.g., hydroquinone, 3-pyrazolidones, e.g., 1-phenyl-3-pyrazolidone, and aminophenols, e.g., N-methyl-p-aminophenol.

The color developer or black-and-white developer usually has a pH of from 9 to 12. The replenishment rate of the developer is usually 3 liter or less per $m^2$ of the light-sensitive material, though depending on the type of the color photographic material to be processed. The replenishment rate may be reduced to 500 ml/$m^2$ or less by decreasing the bromide ion concentration in the replenisher. When the replenishment rate is reduced, it is preferred to reduce the area of the liquid surface in contact with air in the processing tank to thereby prevent evaporation and air oxidation of the liquid. The replenishment rate can also be reduced by suppressing accumulation of the bromide ion in the developer.

The photographic emulsion layer after color development is usually subjected to bleaching. Bleaching may be effected simultaneously with fixation (i.e., blix), or these two steps may be carried out separately. For speeding up processing, bleaching may be followed by blix. Further, any of an embodiment wherein two blix baths in series are used, an embodiment wherein blix is preceded by fixation, and an embodiment wherein blix is followed by bleaching may be selected. Bleaching agents include compounds of polyvalent metals, e.g., iron (III), cobalt (III), chromium (VI), and copper (II), peracids, quinones, nitroso compounds, and the like. Typical examples of these bleaching agents are ferricyanides; bichromates; organic complex salts of iron (III) or cobalt (III), such as complex salts with aminopolycarboxylic acids, e.g., ethylenediaminetetraacetic acid, diethylenetriaminepentaacetic acid, cyclohexanediaminetetraacetic acid, methyliminodiacetic acid, 1,3-diaminopropanetetraacetic acid, or citric acid, tartaric acid, or malic acid; persulfates; hydrobromic acid salts; permanganates; and nitrobenzenes. Of these, aminopolycarboxylic acid iron (III) complex salts such as (ethylenediaminetetraacetato)iron (III) complex salts and persulfates are preferred in view of speeding up of processing and conservation of the environment. In particular, (ethylenediaminetetraacetato)iron (III) complex salts are useful in both of a bleaching solution and a blix solution. The bleaching or blix solution usually has a pH of from 5.5 to 8. For speeding up processing, it is possible to use a lower pH value.

The bleaching bath, blix bath or a prebath thereof can contain, if desired, a bleaching accelerator. Examples of useful bleaching accelerators are compounds having a mercapto group or a disulfide group as described in U.S. Pat. No. 3,893,858, West German Patent Nos. 1,290,812 and 2,059,988, JP-A-53-32736, JP-A-53-57831, JP-A-53-37418, JP-A-53-72623, JP-A-53-95630, JP-A-53-95631, JP-A53-104232, JP-A-53-124424, JP-A-53-141623 and JP-A-53-28426, *Research Disclosure,* No. 17129 (July, 1978); thiazolidine derivatives as described in JP-A-50-140129, thiourea derivatives as described in JP-B-45-8506, JP-A-52-20832 and JP-A-53-32735, and U.S. Pat. No. 3,706,561; iodides as described in West German Patent No. 1,127,715 and JP-A-58-16235; polyoxyethylene compounds as described in West German Patent Nos. 966,410 and 2,748,430; polyamine compounds as described in JP-B-45-8836; the compounds described in JP-A-49-42434, JP-A-49-59644, JP-A-53-94927, JP-A-54-35727, JP-A-55-26506 and JP-A-58-163940; and bromine ions. Preferred among them are compounds having a mercapto group or a disulfide group because of their great acceleratory effects. In particular, the compounds disclosed in U.S. Pat. No. 3,893,858, West German Patent No. 1,290,812 and JP-A-53-95630 are preferred. The compounds disclosed in U.S. Pat. No. 4,552,834 are also preferred. These bleaching accelerators may be incorporated into the light-sensitive material. These bleaching accelerators are particularly effective for blix processing of color light-sensitive materials for photographing.

Fixing agents used for fixation include thiosulfates, thiocyanates, thioethers, thioureas, and a large amount of iodides. The thiosulfates are usually employed, with ammonium thiosulfate being most widely used. Sulfites, bisulfites or carbonyl bisulfite adducts are suitably used as preservatives for the blix bath.

The desilvered silver halide color photographic materials of the invention are typically subjected to washing and/or stabilization. The quantity of water used in the washing can be selected from a broad range depending on the characteristics of the light-sensitive material (for example, the kind of couplers, etc.), the end use of the light-sensitive material, the temperature of washing water, the number of washing tanks (number of stages), the replenishment system (e.g., counter flow system or direct flow system), and other various factors. Of these factors, the relationship between the number of washing tanks and the quantity of water in a multistage counter flow system is described in *Journal of the Society of Motion Picture and Television Engineers,* Vol. 64, pp. 248 to 253 (May, 1955).

According to the multistage counter flow system described in the above article, although the requisite amount of water can be greatly reduced, bacteria grow due to an increase of the retention time of water in the tank, and floating masses of bacteria stick to the light-sensitive material. In the present invention, in order to cope with this problem, the method of reducing calcium and magnesium ion concentrations described in JP-A-62-288838 can be used very effectively. Further, it is also effective to use isothiazolone compounds or thiabendazoles described in JP-A-578542, chlorine type bactericides, e.g., chlorinated sodium isocyanurate, benzotriazole, and bactericides described in Hiroshi Horiguchi, *Bokin Bobaizai no Kaqaku,* Eisei Gijutsu Gakkai (ed.), *Biseibutsu no Mekkin, Sakkin, Bobai Gijutsu,* and Nippon Bokin Bobai Gakkai (ed), *Bokin Bobaizai Jiten.*

The washing water has a pH of from 4 to 9, preferably from 5 to 8. The temperature of the water and the washing time can be selected from broad ranges depending on the characteristics and end use of the light-sensitive material, but usually range from 15° to 45° C. in temperature and from 20 seconds to 10 minutes in time, preferably from 25° to 40° C. in temperature and from 30 seconds to 5 minutes in time. The light-sensitive material of the invention may be directly processed with a stabilizer in place of the washing step. For the stabilization, any of the known techniques described in JP-A-57-8543, JP-A-58-14834 and JP-A-60-220345 can be used.

The washing step may be followed by stabilization, if desired. For example, a stabilizing bath containing formalin and a surface active agent may be used as a final bath for color light-sensitive materials for photographing. This stabilizing bath may also contain various chelating agents or bactericides.

The overflow accompanying replenishment of the washing bath and/or stabilizing bath can be reused in other steps such as desilvering.

The present silver halide color light-sensitive material can contain a color developing agent for the purpose of simplifying and accelerating the processing. Such a color developing agent can be incorporated in the form of a precursor thereof. Examples of such a precursor include indoaniline compounds as described in U.S. Pat. No. 3,342,597, Schiff base type compounds as described in U.S. Pat. No. 3,342,599, and *Research Disclosure,* Nos. 14850 and 15159, aldol compounds as described in *Research Disclosure,* No. 13924, metal complexes as described in U.S. Pat. No. 3,719,492, and urethane compounds as described in JP-A-53-135628.

The present silver halide color light-sensitive material can optionally contain various 1-phenyl-3pyrazolidones for the purpose of accelerating color development. Typical examples of such compounds are described in JP-A-56-64339, JP-A-57-144547, and JP-A-58-115438.

The various processing solutions are used at a temperature of 10° to 50° C. The standard temperature range at which the processing solutions are used is from 33° to 38° C. A higher temperature range can be used to accelerate the processing, so that the processing time can be shortened. A lower temperature range can be used to improve the image quality or the preservability of the processing solution. In order to save silver incorporated in the light-sensitive material, a processing using cobalt intensification or hydrogen peroxide intensification as described in West German Patent No. 2,226,770 and U.S. Pat. No. 3,674,499 can be employed.

The present invention is now described in greater detail with reference to the following example, but the present invention is not to be construed as being limited thereto. Unless otherwise indicated, all parts, percents and ratios are by weight.

EXAMPLE 1

A color photographic light-sensitive material having a polyethylene laminated (on both sides) paper support (thickness: 100 μm) having coated on the surface side thereof the first to fourteenth layers shown below and on the back side thereof the fifteenth to sixteenth layers shown below was prepared. The polyethylene layer on the side coated with the first layer contained titanium oxide as a white pigment and a trace amount of ultramarine as a bluing dye (the chromaticity of the surface of the support according to the L*, a*, b* system was 88.0, −0.20 and −0.75).

Composition of Light-Sensitive Layers

The components and coating amounts (unit: g/m$^2$, hereinafter the same) are shown below. The emulsion used in each layer was prepared in accordance with the method for preparing an emulsion EM1 described later, but the emulsion used in the fourteenth layer was a Lippmann emulsion not subjected to surface chemical sensitization.

| | |
|---|---|
| 1st Layer: Antihalation Layer | |
| Black Colloidal Silver | 0.10 |
| Gelatin | 0.70 |
| 2nd Layer: Intermediate Layer | |
| Gelatin | 0.70 |
| 3rd Layer: Low Sensitivity Red-Sensitive Layer | |
| Silver Bromide (mean grain size: 0.25 μm, size distribution (coefficient of variation): 8%, octahedral) Spectrally Sensitized with Red Sensitizing Dyes (ExS-1, ExS-2 and ExS-3) | 0.04 |
| Silver Bromochloride (silver chloride: 5 mol %, mean grain size: 0.40 μm, size distribution: 10%, octahedral) Spectrally Sensitized with Red Sensitizing Dyes (ExS-1, ExS-2 and ExS-3) | 0.08 |
| Gelatin | 1.00 |
| Cyan Coupler (1/1/0.2 mixture of ExC-1, ExC-2, ExC-3) | 0.30 |
| Discoloration Inhibitor (Cpd-1, Cpd-2, Cpd-3 and Cpd-4 in equal ratios) | 0.18 |
| Stain Inhibitor (Cpd-5) | 0.003 |
| Coupler Dispersing Medium (Cpd-6) | 0.03 |
| Coupler Solvent (Solv-1, Solv-2 and Solv-3 in equal ratios) | 0.12 |
| 4th Layer: High Sensitivity Red-Sensitive Layer | |
| Silver Bromide (mean grain size: 0.60 μm, size distribution: 15%, octahedral) Spectrally Sensitized with Red Sensitizing Dyes (ExS-1, ExS-2 and ExS-3) | 0.14 |
| Gelatin | 1.00 |
| Cyan Coupler (1/1/0.2 mixture of ExC-1, ExC-2, ExC-3) | 0.30 |
| Discoloration Inhibitor (Cpd-1, Cpd-2, Cpd-3 and Cpd-4 in equal ratios) | 0.18 |
| Coupler Dispersing Medium (Cpd-5) | 0.03 |
| Coupler Solvent (Solv-1, Solv-2 and Solv-3 in equal ratios) | 0.12 |
| 5th Layer: Intermediate Layer | |
| Gelatin | 1.00 |
| Discoloration Inhibitor (Cpd-7) | 0.08 |
| Color Stain Inhibitor Solvent (Solv-4 and Solv-5 in equal ratios) | 0.16 |
| Polymer Latex (Cpd-8) | 0.10 |
| 6th Layer: Low Sensitivity Green-Sensitive Layer | |
| Silver Bromide (mean grain size: 0.25 μm, size distribution: 8%, octahedral) Spectrally Sensitized with Green Sensitizing Dye ExS-4) | 0.04 |
| Silver Bromide (mean grain size: 0.5 μm, size distribution: 10%, octahedral) Spectrally Sensitized with Green Sensitizing Dye (ExS-4) | 0.06 |
| Gelatin | 0.80 |
| Magenta Coupler (ExM-1, ExM-2 and ExM-3 in equal ratios) | 0.11 |
| Discoloration Inhibitor (Cpd-9, Cpd-26 in equal ratios) | 0.15 |
| Stain Inhibitor (Cpd-10, Cpd-11, Cpd-12 and Cpd-13 in equal ratios) | 0.025 |
| Coupler Dispersing Medium (Cpd-6) | 0.05 |
| Coupler Solvent (Solv-4 and Solv-6 in equal ratios) | 0.15 |
| 7th Layer: High Sensitivity Green-Sensitive Layer | |
| Silver Bromide (mean grain size: 0.65 μm, size distribution: 16%, octahedral) Spectrally Sensitized with Green Sensitizing Dye (ExS-4) | 0.10 |
| Gelatin | 0.80 |
| Magenta Coupler (ExM-1, ExM-2 and ExM-3 in equal ratios) | 0.11 |
| Stain Inhibitor (10/7/7/1 mixture of Cpd-10, Cpd-11, Cpd-12 and Cpd-13) | 0.025 |
| Coupler Dispersing Medium (Cpd-6) | 0.05 |
| Coupler Solvent (Solv-4 and Solv-6 in equal ratios) | 0.15 |
| 8th Layer: Intermediate Layer | |
| The same as 5th layer. | |
| 9th Layer: Yellow Filter Layer | |
| Yellow Colloidal Silver | 0.12 |
| Gelatin | 0.07 |
| Discoloration Inhibitor (Cpd-7) | 0.03 |
| Discoloration Inhibitor Solvent (Solv-4 and Solv-5 in equal ratios) | 0.10 |
| Polymer Latex (Cpd-8) | 0.07 |
| 10th Layer: Intermediate Layer | |
| The same as the 5th layer. | |
| 11th Layer: Low Sensitivity Blue-Sensitive Layer | |
| Silver Bromide (mean grain size: 0.40 μm, size distribution: 8%, octahedral) Spectrally Sensitized with Blue Sensitizing Dyes (ExS-5 and ExS-6) | 0.07 |
| Silver Bromide (mean grain size: 0.60 μm, size distribution: 11%, octahedral) Spectrally Sensitized with Blue Sensitizing Dyes (ExS-5 and ExS-6) | 0.14 |
| Gelatin | 0.80 |
| Yellow Coupler (ExY-1 and ExY-2 in equal ratios) | 0.35 |
| Discoloration Inhibitor (Cpd-14) | 0.10 |
| Stain Inhibitor (1/5 mixture of Cpd-5 and Cpd-15) | 0.007 |
| Coupler Dispersing Medium (Cpd-6) | 0.05 |
| Coupler Dispersing Medium | 0.05 |
| Coupler Solvent (Solv-2) | 0.10 |
| 12th Layer: High Sensitivity Blue-Sensitive Layer | |
| Silver Bromide (mean grain size: 0.85 μm, size distribution: 18%, octahedral) Spectrally Sensitized with Blue Sensitizing Dyes (ExS-5 and ExS-6) | 0.15 |
| Gelatin | 0.60 |
| Yellow Coupler (ExY-1 and ExY-2 in equal ratios) | 0.30 |
| Discoloration Inhibitor (Cpd-14) | 0.10 |
| Stain Inhibitor (1/5 mixture of Cpd-5 and Cpd-15) | 0.007 |
| Coupler Dispersing Medium (Cpd-5) | 0.05 |
| Coupler Solvent (Solv-2) | 0.10 |
| 13th Layer: Ultraviolet Absorbing Layer | |
| Gelatin | 1.00 |
| Ultraviolet Absorbent (Cpd-2, Cpd-4 and Cpd-16 in equal ratios) | 0.50 |
| Discoloration Inhibitor (Cpd-7 and Cpd-17 in equal ratios) | 0.03 |
| Dispersing Medium (Cpd-6) | 0.02 |
| Ultraviolet Absorbent Solvent (Solv-2 and Solv-7 in equal ratios) | 0.08 |
| Antiirradiating Dye (10/10/13/15/20 mixture of Cpd-18, Cpd-19, Cpd-20, Cpd-21 and Cpd-27) | 0.02 |
| 14th Layer: Protective Layer | |
| Fine Silver Chlorobromide Grains (silver chloride: 97 mol %, mean grain size: 0.2 μm) | 0.03 |
| Acryl-Modified Copolymer of Polyvinyl Alcohol | 0.01 |
| Polymethyl Methacrylate Particles (mean particle size: 2.4 μm) and Silicon Oxide (mean particle size: 5 μm) | 0.05 |

-continued

| | |
|---|---|
| Gelatin | 1.80 |
| Gelatin Hardening Agent (H-1 and H-2) | 0.18 |
| 15th Layer: Backing Layer | |
| Gelatin | 2.50 |
| Ultraviolet Absorbent (Cpd-2, Cpd-4 and Cpd-16 in equal ratios) | 0.50 |
| Dye (Cpd-18, Cpd-19, Cpd-20, Cpd-21 and Cpd-27 in equal ratios) | 0.06 |
| 16th Layer: Backing Protective Layer | |
| Polymethyl Methacrylate Particles (average particle size: 2.4 μm) and Silicon Oxide (mean particle size: 5 μm in equal ratios) | 0.05 |
| Gelatin | 2.00 |
| Gelatin Hardening Agent (H-1 and H-2 in equal ratios) | 0.14 |

Preparation of Emulsion EM1:

An aqueous solution of potassium bromide and an aqueous solution of silver nitrate were simultaneously added to an aqueous gelatin solution at 75° C. while vigorously stirring over a period of 15 minutes to obtain octahedral silver bromide grains having a mean grain size of 0.40 μm. To the emulsion were successively added 3,4-dimethyl-1,3-thiazoline-2-thione, sodium thiosulfate and chloroauric acid (tetrahydrate) in amounts of 0.3 g, 6 mg and 7 mg, respectively, followed by heating at 75° C. for 80 minutes to effect chemical sensitization. The thus-obtained grains were used as a core and allowed to grow under the same precipitation environment as in the previous grain formation to finally obtain a monodisperse octahedral core/shell silver bromide emulsion having a mean grain size of 0.7 μm. The coefficient of variation of the grain size was about 10%. To the emulsion were added 1.5 mg of sodium thiosulfate and 1.5 mg of chloroauric acid (tetrahydrate) each per mol of silver, followed by heating at 60° C. for 60 minutes to effect chemical sensitization to obtain an internal latent image type silver halide emulsion.

Each of the light-sensitive layers further contained $10^{-3}$% by weight of ExZK-1 and $10^{-2}$% by weight of ExZK-2 as nucleating agents based on silver halide and $10^{-2}$% by weight of Cpd-22 as a nucleation accelerator. Furthermore, each layer contained Alkanol XC (produced by Du Pont) and a sodium alkylbenzenesulfonate as emulsifying and dispersing assistant, a succinic ester and Magefac F-120 (produced by Dai-Nippon Ink & Chemicals, Inc.) as a coating aid. In the silver halide- or colloidal silver-containing layers, Cpd-23, Cpd-24, Cpd-25) were used as stabilizer. The material was designated as Sample 101. The compounds used in this example are shown below.

Cpd-1

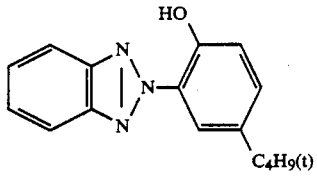

Cpd-2

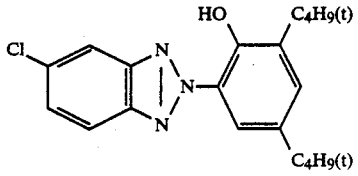

Cpd-3

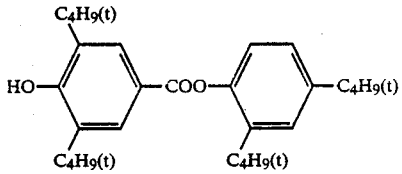

Cpd-4

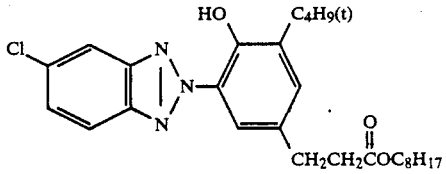

Cpd-5

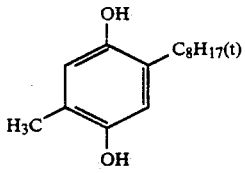

Cpd-6

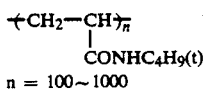

n = 100~1000

-continued
Cpd-7
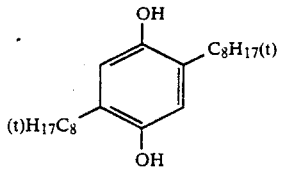
Cpd-8
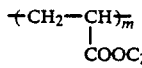
(mean molecular weight about 30,000)
Cpd-9
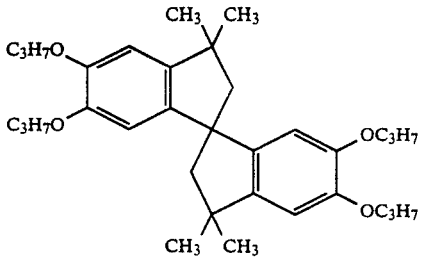
Cpd-10
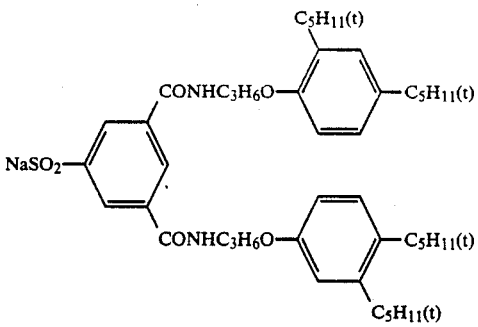
Cpd-11
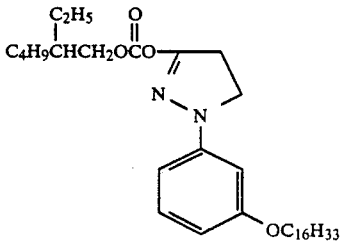
Cpd-12
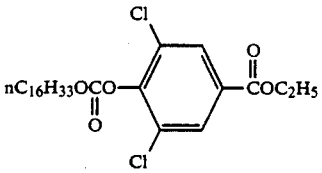
Cpd-13
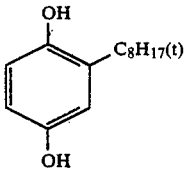
Cpd-14
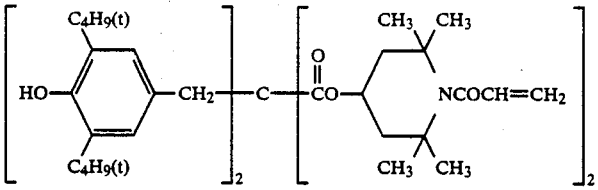

-continued
Cpd-15
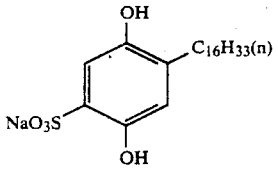
Cpd-16
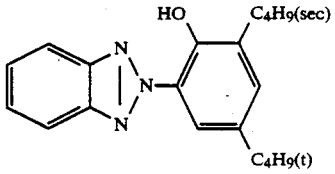
Cpd-17
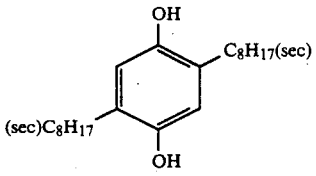
Cpd-18
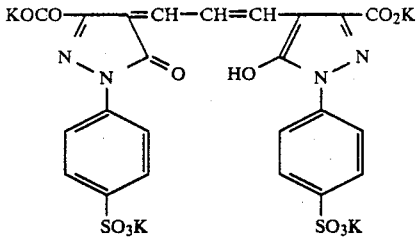
Cpd-19
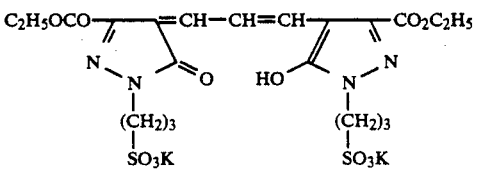
Cpd-20
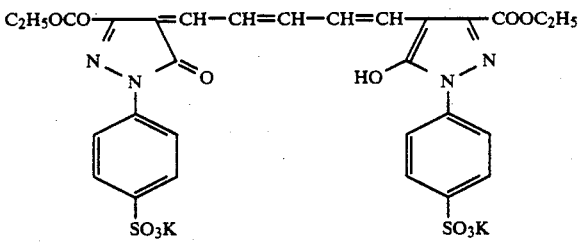
Cpd-21
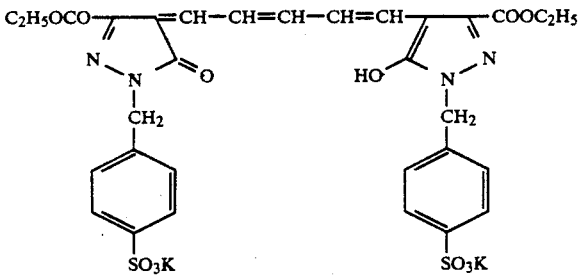
Cpd-22
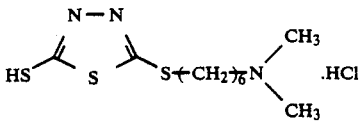

-continued
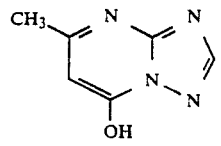
Cpd-23
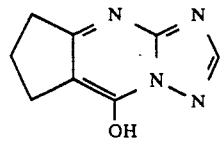
Cpd-24
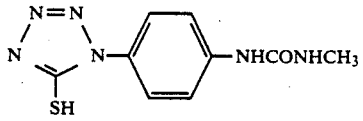
Cpd-25
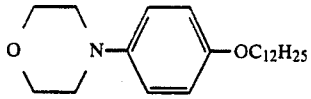
Cpd-26
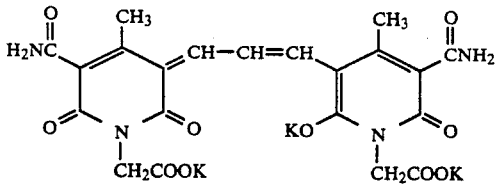
Cpd-27
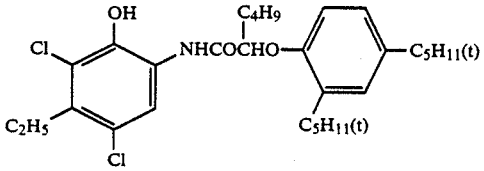
EXC-1
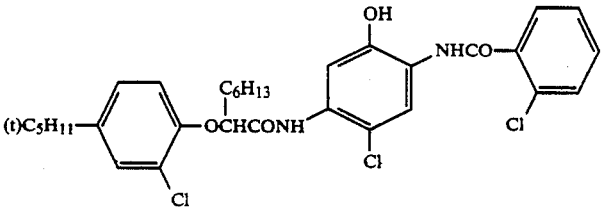
EXC-2
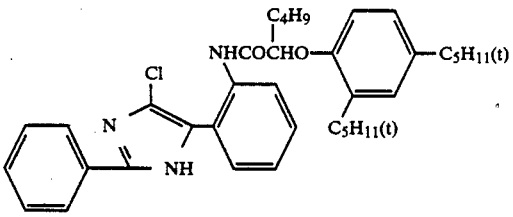
EXC-3

-continued
EXM-1
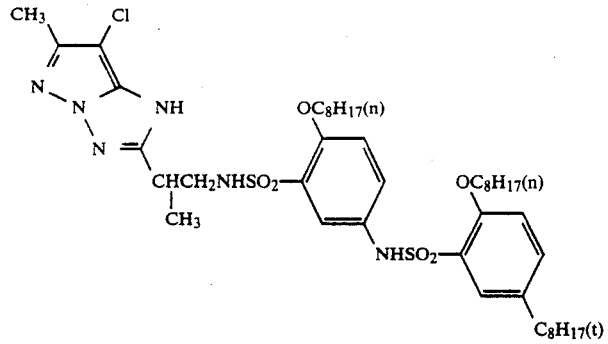
EXM-2
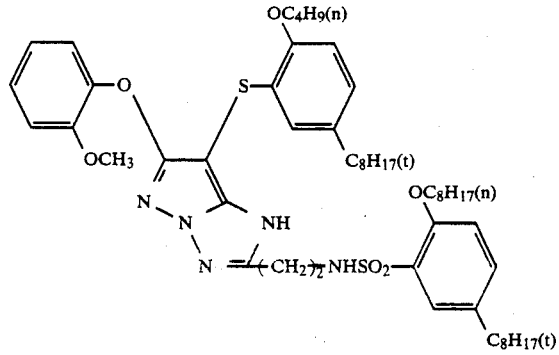
EXM-3
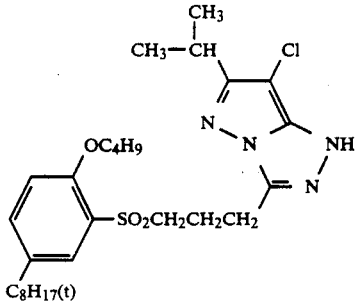
EXY-1
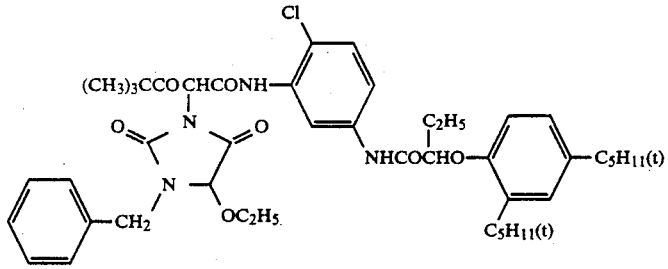
EXY-2
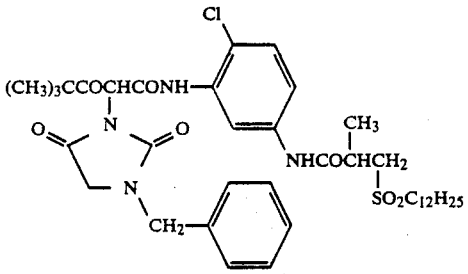
Solv-1: Di(2-ethylhexyl)sebacate
Solv-2: Trinonyl phosphate
Solv-3: Di(3-methylhexyl)phthalate
Solv-4: Tricresyl phosphate
Solv-5: Dibutyl phthalate
Solv-6: Trioctyl phosphate
Solv-7: Di(2-ethylhexyl)phthalate
H-1: 1,2-Bis(vinylsulfonylacetamido)ethane H-2: 4,6-Dichloro-2-hydroxy-1,3,5-triazine sodium salt ExZK-1: 7-[3-(5-Ethoxythiocarbonylaminobenzamido]-9-methyl-10-propargyl-1,2,3,4-tetrahydroacrydinium trifluoromethanesulfonate ExZK-2: 2-[4-{3-[3-{3-[5-{3-[2-Chloro-5-(1-dodecyl oxycarbonylethoxycarbonyl)phenylcarbamoyl]-4-hydroxy-1-naphthylthio}tetrazole-1-yl]phenyl}-ureido]benzenesulfonamido}phenyl]-1-formyl-hydrazine

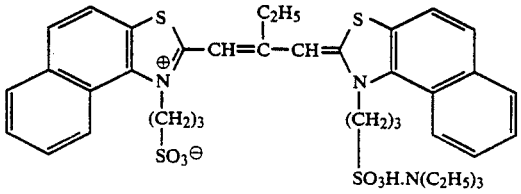

ExS-1

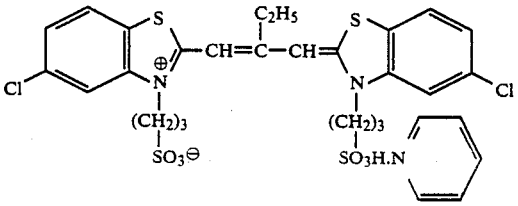

ExS-2

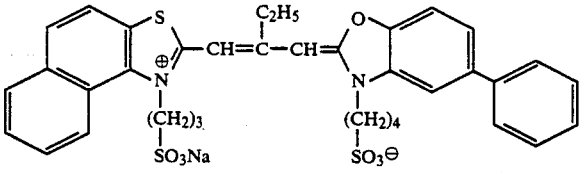

ExS-3

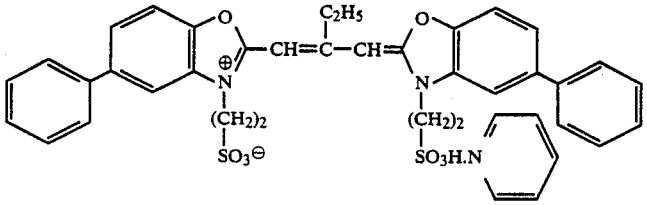

ExS-4

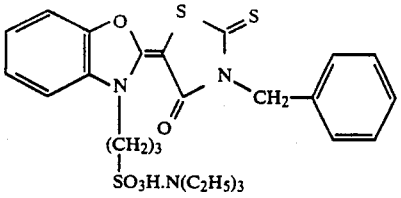

ExS-5

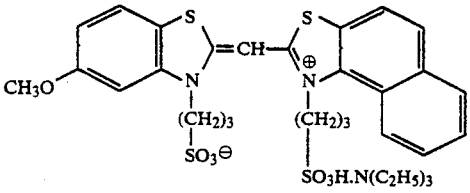

ExS-6

Samples 102 to 112 in which the compounds shown in Table 1 were incorporated in the sixth and seventh layers were then prepared.

TABLE 1

| Sample No. | Compound Incorporated in 6th and 7th Layers |
|---|---|
| 102 | Comparative Compound (A-1) |
| 103 | Comparative Compound (A-2) |
| 104 | Comparative Compound (A-3) |
| 105 | Comparative Compound (A-4) |
| 106 | Invention Compound I-(1) |
| 107 | Invention Compound I-(2) |
| 108 | Invention Compound I-(5) |
| 109 | Invention Compound I-(8) |
| 110 | Invention Compound I-(10) |
| 111 | Invention Compound I-(19) |
| 112 | Invention Compound I-(22) |

The amount of each of the compounds incorporated in the 6th and 7th layers was $9.0\times10^{-6}$ mol/m$^2$ Comparative Compounds (A-1) to (A-4) set forth in Table 1 are conventionally used in silver halide light-sensitive materials as follows:

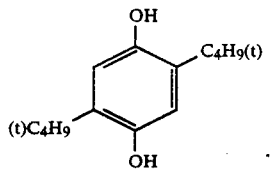

(A-1)

(Compound described in JP-A-63-63033)

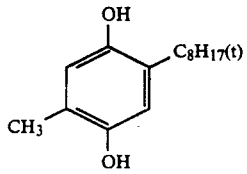

(A-2)

(Compound (1) described in JP-A-52-146235)

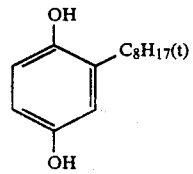

(A-3)

(Compound (d) described in JP-A-49-106329)

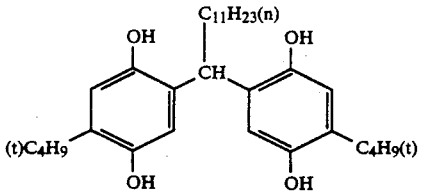

(A-4)

(Compound (5) described in JP-B-56-21145)

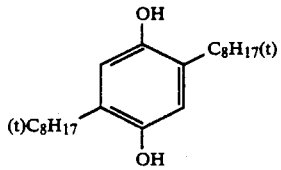

(A-5)

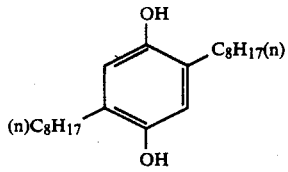

(A-6)

Silver Halide Color Photographic Material Samples 101 to 112 thus prepared were then exposed to light (3,200° K., 1/10 sec, 10 CMS), and continuously processed in an automatic developing machine in the following manner until the accumulated replenished amount of the processing solution reached 3 times the tank volume:

| Processing Step | Time (sec) | Temperature (°C.) | Tank Volume for Running Solution (liter) | Replenishment Rate* (ml/m²) |
|---|---|---|---|---|
| Color Development | 135 | 38 | 15 | 300 |
| Blix | 40 | 33 | 3 | 300 |
| Washing (1) | 40 | 33 | 3 | — |
| Washing (2) | 40 | 33 | 3 | 320 |

-continued

| Processing Step | Time (sec) | Temperature (°C.) | Tank Volume for Running Solution (liter) | Replenishment Rate* (ml/m²) |
|---|---|---|---|---|
| Drying | 30 | 80 | | |

The washing water was replenished by a counter flow system in which the overflow from washing bath (2) was fed to washing bath (1). In this case, the amount of the blix solution which was carried over from the blix bath to washing bath (1) was 35 ml/m², the replenishment rate of the washing water being 9.1 times the amount of the blix solution carried over.

The respective processing solution had the following compositions.

| | Running Solution | Replenisher |
|---|---|---|
| Color Developer: | | |
| D-Sorbitol | 0.15 g | 0.20 g |
| Sodium Naphthalenesulfonate-Formalin Condensate | 0.15 g | 0.20 g |
| Ethylenediaminetetrakis-methylenesulfonic acid | 1.5 g | 1.5 g |
| Diethylene Glycol | 12.0 ml | 12.0 ml |
| Benzyl Alcohol | 13.5 ml | 18.0 ml |
| Potassium Bromide | 0.80 g | 0.80 g |
| Benzotriazole | 0.003 g | 0.004 g |
| Sodium Sulfite | 2.4 g | 3.2 g |
| N,N-Bis(carboxymethyl)-hydrazine | 6.0 g | 8.0 g |
| D-Glucose | 2.0 g | 2.4 g |
| Triethanolamine | 6.0 g | 8.0 g |
| N-Ethyl-N-(methanesulfonamido-ethyl)-3-methyl-4-aminoaniline Sulfate | 6.4 g | 8.5 g |
| Potassium Carbonate | 30.0 g | 25.0 g |
| Fluorescent Brightening (diaminostilbene type) | 1.0 g | 1.2 g |
| Water to make | 1,000 ml | 1,000 ml |
| pH (25° C.) | 10.50 | 11.00 |
| Blix Solution: | | |
| Disodium Ethylenediamine-tetraacetate (dihydrate) | 4.0 g | Same as running solution |
| Ammonium (Ethylenediamine-tetraacetato)Iron (III) (dihydrate) | 70.0 g | Same as running solution |
| Ammonium Thiosulfate (700 g/liter) | 180 ml | Same as running solution |
| Sodium p-Toluenesulfonate | 20.0 g | Same as running solution |
| Sodium Bisulfite | 20.0 g | Same as running solution |
| 5-Mercapto-1,3,4-triazole | 0.5 g | Same as running solution |
| Ammonium Sulfate | 10.0 g | Same as running solution |
| Water to make | 1,000 ml | Same as running solution |
| pH (25° C.) | 6.20 | |

Washing Water:

Prepared for both the running solution and the replenisher by passing tap water through a mixed bed column packed with an H-type strongly acidic cation exchange resin ("Amberlite IR-120B, produced by Rohm & Haas Co.) and an OH-type anion exchange resin ("Amberlite IR-400", produced by the same company) to reduce calcium and magnesium ion concentrations each to 3 mg/liter, and then adding to the resulting water 20 mg/liter of sodium dichloroisocyanuate and 1.5 g/liter of sodium sulfate. The pH of the resulting solution was in the range of from 6.5 to 7.5.

The results of magenta color image density measurement are set forth in Table 2.

TABLE 2

| Sample No. | Remarks | Toe Gradation* | Minimum Image Density (Dmin) |
|---|---|---|---|
| 101 | Comparison | 1.32 | 0.14 |
| 102 | " | 1.80 | 0.12 |
| 103 | " | 1.69 | 0.13 |
| 104 | " | 1.75 | 0.12 |
| 105 | " | 1.77 | 0.12 |
| 106 | Invention | 2.21 | 0.11 |
| 107 | " | 2.14 | 0.10 |
| 108 | " | 2.30 | 0.11 |
| 109 | " | 2.23 | 0.10 |
| 110 | " | 2.19 | 0.10 |
| 111 | " | 2.26 | 0.10 |
| 112 | " | 2.19 | 0.11 |

*Mean gradation between Dmin +0.1 and Dmin +0.6

The results set forth in Table 2 show that the present Samples 106 to 112 were excellent in high toe gradation and low Dmin.

EXAMPLE 2

Samples 202 to 212 were prepared in the same manner as in Sample 101 except that the amount of the respective compounds incorporated in the third and fourth layers were each $2.2\times10^{-5}$ mol/m$^2$. These samples were then subjected to the same processing steps as in Example 1. These samples were then measured for cyan color image density together with Sample 101. Results similar to those of Example 1 were obtained.

EXAMPLE 3

Multilayer color photographic papers were prepared by coating the following layer compositions on a paper support laminated with polyethylene on both sides thereof. The coating solutions were prepared as follows: Preparation of First Layer Coating Solution:

19.1 g of Yellow Coupler (ExY), 4.4 g of Dye Stabilizer (Cpd-31) and 1.8 g of Dye Stabilizer (Cpd-37) were dissolved in 27.2 cc of ethyl acetate and 4.1 g of Solvents (Solv-33) and (Solv-36) each. The solution was then emulsion dispersed in 185 cc of a 10% aqueous solution of gelatin containing 8 cc of 10% sodium dodecylbenzenesulfonate. A blue-sensitive sensitizing dye shown below was added to a sulfur-sensitized silver bromochloride emulsion (⅓ (Ag ratio) mixture of an emulsion (silver bromide content: 80.0 mol%, cubic, mean grain size: 0.85 μm, coefficient of fluctuation: 0.08) and an emulsion (silver bromide content: 80.0 mol %, cubic, mean grain size: 0.62 μm, coefficient of fluctuation: 0.07)) in an amount of $5.0\times10^{-4}$ mol. The previously prepared emulsion dispersion and the emulsion thus prepared were mixed to prepare the first layer coating solution having the following composition. The coating solutions for the second layer to the seventh layer were prepared in the same manner as in the first layer coating solution. As a gelatin hardener for each layer there was used 1-oxy-3,5-dichloro-s-triazine sodium salt.

As spectral sensitizing dyes for the various layers the following compounds were used:

Blue-Sensitizing Emulsion Layer

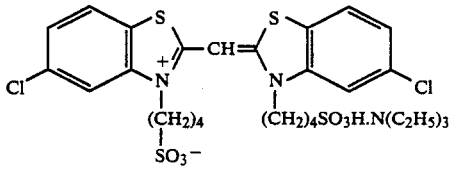

($5.0\times10^{-4}$ mol per mol of silver halide)

Green-Sensitive Emulsion Layer

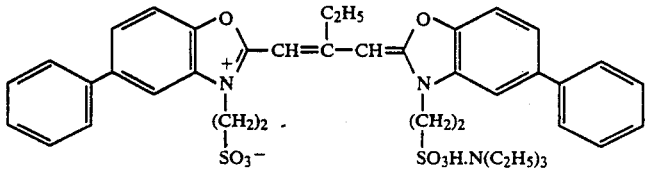

($4.0\times10^{-4}$ mol per mol of silver halide)

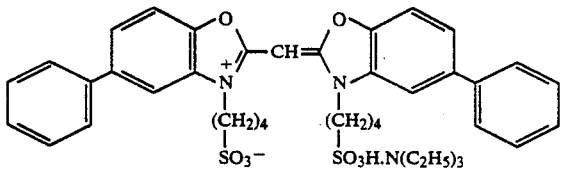

($7.0\times10^{-5}$ mol per mol of silver halide)

Red-Sensitive Emulsion Layer

-continued

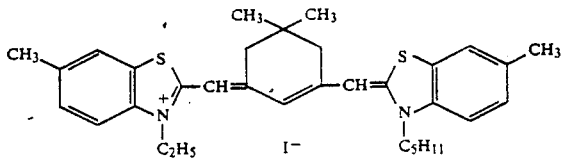

(0.9 × $10^{-4}$ mol per mol of silver halide)

To the red-sensitive emulsion layer was added the following compound in an amount of $2.6\times10^{-3}$ mol per mol of silver halide:

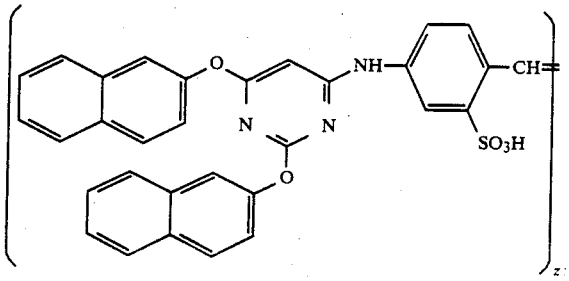

To the blue-sensitive emulsion layer, green-sensitive emulsion layer and red-sensitive emulsion layer were added 1-(5-methylureidophenyl)-5-mercaptotetrazole in amounts of $4.0\times10^{-6}$ mol, $3.0\times10^{-5}$ mol and $1.0\times10^{-5}$ mol per mol of silver halide, respectively, and 2-methyl-5-t-octylhydroquinone in amounts of $8\times10^{-3}$ mol, $2\times10^{-2}$ mol and $2\times10^{-2}$ mol per mol of silver halide.

To the blue-sensitive emulsion layer and green-sensitive emulsion layer was added 4-hydroxy-6-methyl-1,3,3a,7-tetraazaindene in amounts of $1.2\times10^{-2}$ mol and $1.1\times10^{-2}$ mol per mol of silver halide.

For the purpose of inhibiting irradiation, the following dyes were incorporated in the light-sensitive materials:

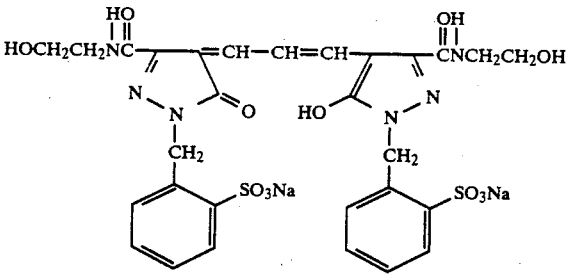

and

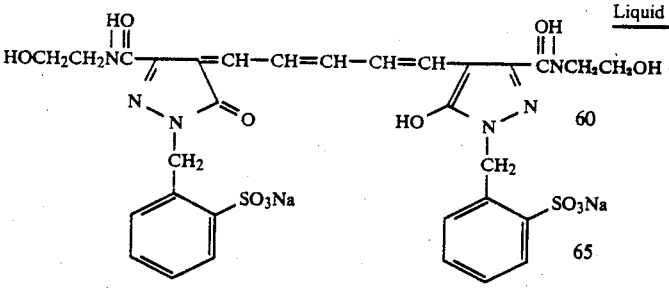

Layer Structure:

The compound of each layer is shown below. The figures indicate the respective coating amounts (g/m²). The coating amount of the silver halide emulsion is expressed in terms of the amount of silver.

Support:

Polyethylene Laminated Paper (containing a white pigment ($TiO_3$) and a bluing dye ultramarine) in the polyethylene layer on the side coated with the first layer).

| | |
|---|---|
| 1st Layer | |
| Silver Halide Emulsion (AgBr: 80 mol %) | 0.26 |
| Gelatin | 1.83 |
| Yellow Coupler (ExY-1) | 0.83 |
| Dye Image Stabilizer (Cpd-31) | 0.19 |
| Dye Image Stabilizer (Cpd-37) | 0.08 |
| Solvent (Solv-33) | 0.18 |
| Solvent (Solv-36) | 0.18 |
| 2nd Layer: Color Stain Inhibiting Layer | |
| Gelatin | 0.99 |
| Color Stain Inhibitor (Cpd-35) | 0.08 |
| Solvent (Solv-31) | 0.16 |
| Solvent (Solv-34) | 0.08 |
| 3rd Layer: Green-Sensitive Layer | |
| Silver Bromochloride Emulsion (AgBr: 90 mol %, cubic, 1/1 (Ag molar ratio) mixture of grains having a mean grain size of 0.47 μm and grains having a mean grain size of 0.36 μm, coefficient of fluctuation: 0.12 and 0.09) | 0.16 |
| Gelatin | 1.79 |
| Magenta Coupler (ExM) | 0.32 |
| Dye Image Stabilizer (Cpd-33) | 0.20 |
| Dye Image Stabilizer (Cpd-38) | 0.03 |
| Dye Image Stabilizer (Cpd-39) | 0.04 |
| Solvent (Solv-32) | 0.65 |
| 4th Layer: Ultraviolet Absorbing Layer | |
| Gelatin | 1.58 |
| Ultraviolet Absorbent (UV-1) | 0.47 |
| Color Stain Inhibitor (Cpd-35) | 0.05 |
| Solvent (Solv-35) | 0.24 |
| 5th Layer: Red-Sensitive Layer | |
| Silver Bromochloride (AgBr: 70 mol % cubic, ½ (Ag molar ratio) mixture of grains having a mean grain size of 0.49 μm and grains having a mean grain size of 0.34 μm, coefficient of fluctuation: 0.08 and 0.10) | 0.23 |
| Gelatin | 1.34 |
| Cyan Coupler (ExC) | 0.30 |
| Dye Image Stabilizer (Cpd-36) | 0.17 |
| Dye Image Stabilizer (Cpd-37) | 0.40 |
| Solvent (Solv-36) | 0.20 |
| Comparative Compounds and Invention Compounds | Set forth in Table 3 |
| 6th Layer: Ultraviolet Absorbing Layer | |
| Gelatin | 0.53 |
| Ultraviolet Absorbent (UV-1) | 0.16 |
| Color Stain Inhibitor (Cpd-35) | 0.02 |
| Solvent (Solv-35) | 0.08 |
| 7th Layer: Protective Layer | |
| Gelatin | 1.33 |
| Acryl-Modified Copolymer of Polyvinyl Alcohol (modification degree: 17%) | 0.17 |
| Liquid Paraffin | 0.03 |

The compounds used were as follows:

Dye Image Stabilizer (Cpd-31)
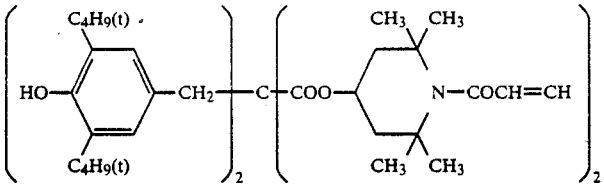
Dye Image Stabilizer
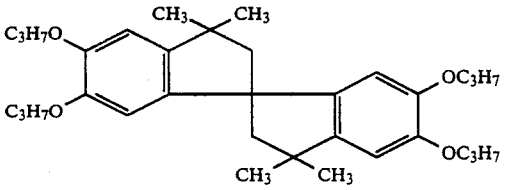
Color Stain Inhibitor (Cpd-35)
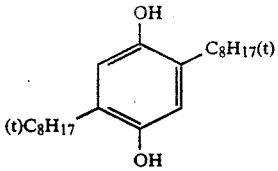
Dye Image Stabilizer (Cpd-36)
2/4/4 (weight ratio) mixture of:
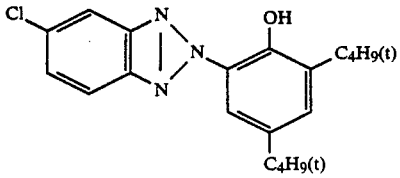
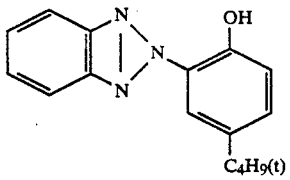
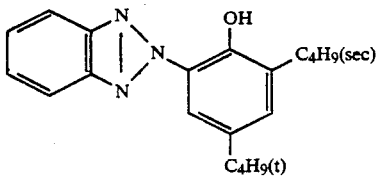
Dye Image Stabilizer (Cpd-37)
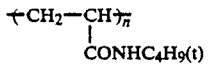
Mean molecular weight: 80,000
Dye Image Stabilizer -continued
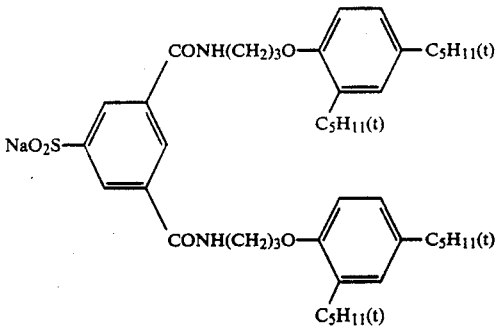
Dye Image Stabilizer (Cpd-39)
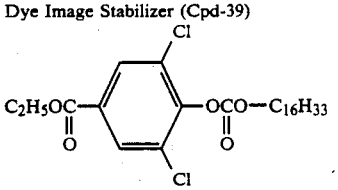
Ultraviolet Absorbent (UV-1)
4/2/4 (weight ratio) mixture of:
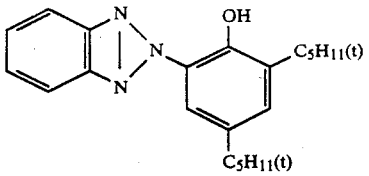
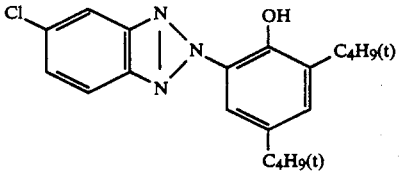
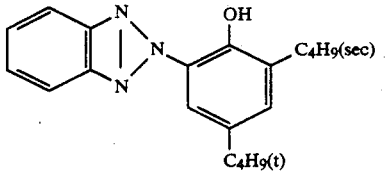
Solvent (Solv-31)
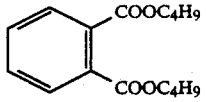
Solvent (Solv-32)
2/1 (volume ratio) mixture of:
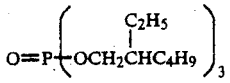
and
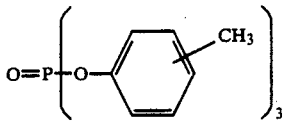
Solvent (Solv-33)

-continued
$O{=}P{+}O{-}C_9H_{19}(iso))_3$
Solvent (Solv-34)
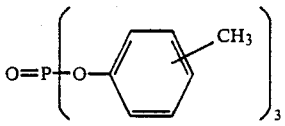
Solvent (Solv-35)
$COOC_8H_{17}$
|
$(CH_2)_8$
|
$COOC_8H_{17}$
Solvent (Solv-36)
$C_8H_{17}CHCH(CH_2)_7COOC_8H_{17}$
O
Yellow Coupler (ExY)
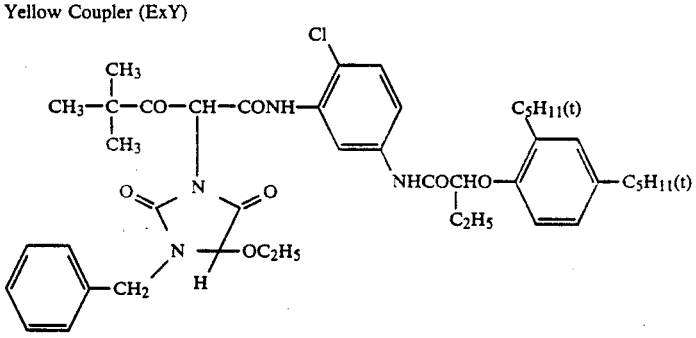
Magenta Coupler (ExM)
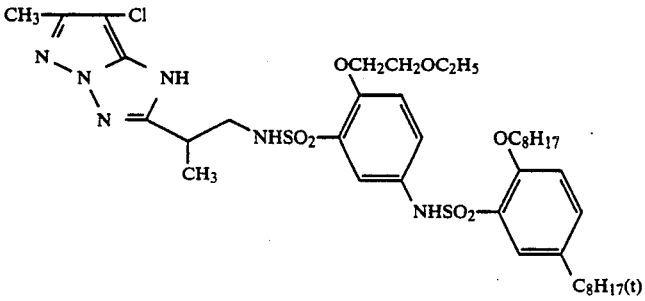
Cyan Coupler (ExC)
1/1 (molar ratio) mixture of:
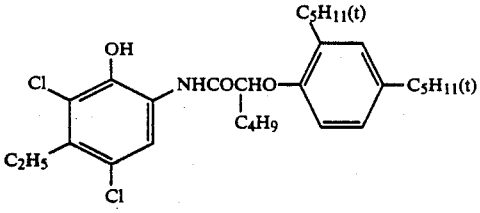
and
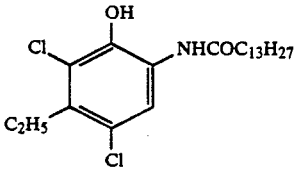
Samples A to L thus prepared (see Table 3) were exposed to light through an optical wedge, and then subjected to the following processing.

| | | |
|---|---|---|
| Color Development | 37 | 210 |
| Blix | 33 | 90 |
| Washing | 24–34 | 180 |
| Drying | 70–80 | 60 |

The respective processing solutions had the following compositions.

| | |
|---|---|
| Color Developer: | |
| Water | 800 ml |
| Diethylenetriaminepentaacetic Acid | 1.0 g |
| Nitrilotriacetic Acid | 2.0 g |
| Benzyl Alcohol | 15 ml |
| Diethylene Glycol | 10 ml |
| Sodium Sulfite | 2.0 g |
| Potassium Bromide | 1.0 g |
| Potassium Carbonate | 30 g |
| N-Ethyl-N-(β-methanesulfonamidoethyl)-3-methyl-4-aminoaniline Sulfate | 4.5 g |
| Hydroxylamine Sulfate | 3.0 g |
| Fluorescent Brightening Agent (WHITEX 4B, produced by Sumitomo Chemicals) | 1.0 g |
| Water to make | 1,000 ml |
| pH (25° C.) | 10.25 |
| Blix Solution: | |
| Water | 400 ml |
| Ammonium Thiosulfate (70%) | 150 ml |
| Sodium Sulfite | 18 g |
| Iron (III) Ammonium Ethylenediaminetetraacetate | 55 g |
| Disodium Ethylenediaminetetraacetate | 5 g |
| Water to make | 1,000 ml |
| pH (25° C.) | 6.70 |

In order to evaluate the photographic properties, these samples were measured for minimum density (Dmin) and gradation. Gradation was in terms of mean gradation between Dmin +0.1 and Dmin +0.6.

The results are set forth in Table 3.

TABLE 3

| Sample No. | Comparative Compound and Invention Compound* | Dmin | Gradation | Remarks |
|---|---|---|---|---|
| A | — | 0.14 | 1.66 | Comparison |
| B | (A-1) | 0.13 | 1.62 | " |
| C | (A-2) | 0.13 | 1.58 | " |
| D | (A-3) | 0.14 | 1.57 | " |
| E | (A-4) | 0.14 | 1.60 | " |
| F | I-(1) | 0.11 | 2.11 | Invention |
| G | I-(8) | 0.12 | 2.21 | " |
| H | I-(9) | 0.11 | 2.23 | " |
| I | I-(10) | 0.11 | 1.19 | " |
| J | I-(14) | 0.11 | 2.18 | " |
| K | I-(19) | 0.11 | 2.19 | " |
| L | I-(22) | 0.12 | 2.20 | " |

*Incorporated in an amount of 5.0 mol % based on coupler

The results set forth in Table 3 show that the samples containing the present compounds exhibited excellent gradation.

EXAMPLE 4

A light-sensitive material was prepared in the same manner as in Example 3 except that the compound set forth in Table 4 was used in an equimolecular amount instead of Color Stain Inhibitor (Cpd-35) incorporated in the second layer (color stain inhibiting layer). The sample thus prepared was subjected to the same processing as in Example 3. The comparative compounds were the same as in Example 1.

In order to evaluate the photographic properties, the sample was measured for minimum density (Dmin) and maximum density (Dmax) of magenta image portion. In order to evaluate the degree of color stain, the sample was measured for yellow density at the point where the magenta image density was 1.0.

The results are set forth in Table 4.

TABLE 4

| Sample No. | Comparative Compound and Invention Compound | Photographic Properties Dmin | Dmax | D B/G | Remarks |
|---|---|---|---|---|---|
| A | — | 0.14 | 2.52 | 0.32 | Comparison |
| B | (A-1) | 0.13 | 2.39 | 0.18 | " |
| C | (A-2) | 0.14 | 2.42 | 0.16 | " |
| D | (A-4) | 0.14 | 2.41 | 0.18 | " |
| E | I-(1) | 0.11 | 2.49 | 0.08 | Invention |
| F | I-(2) | 0.12 | 2.48 | 0.07 | " |
| G | I-(6) | 0.12 | 2.49 | 0.07 | " |
| H | I-(8) | 0.10 | 2.48 | 0.08 | " |
| I | I-(9) | 0.11 | 2.49 | 0.07 | " |
| J | I-(18) | 0.12 | 2.49 | 0.07 | " |
| K | I-(19) | 0.10 | 2.48 | 0.08 | " |
| L | I-(20) | 0.12 | 2.49 | 0.07 | " |

The results set forth in Table 4 show that the incorporation of the invention compounds in the color stain inhibiting layer remarkably prevented color stain without lowering the coloring properties.

EXAMPLE 5

Multilayer color photographic papers were prepared by coating the following layer compositions on a paper support laminated with polyethylene on both sides thereof. The coating solutions were prepared as follows:

Preparation of First Layer Coating Solution 19.1 g of Yellow Coupler (ExY-1), 4.4 g of Dye Image Stabilizer (Cpd-51) and 0.7 g of Dye Image Stabilizer (Cpd-57) were dissolved in 27.2 cc of ethyl acetate and 8.2 g of Solvent (Solv-53). The solution was then emulsion-dispersed in 185 cc of a 10% aqueous solution of gelatin containing 8 cc of 10% sodium dodecylbenzenesulfonate. To a silver bromochloride emulsion (cubic grains having a grain size of 0.85 μm and a fluctuation coefficient of 0.07, 1 mol % of silver bromide being locally contained in part of the surface of grains) were added the following two blue-sensitive sensitizing dyes in amounts of $2.0\times10^{-4}$ mol per mol of AgX each. The emulsion was then sensitized with sulfur. The emulsion thus prepared and the previously prepared emulsion dispersion were mixed to prepare the first layer coating solution containing the following composition. The coating solutions for the second to seventh layers were prepared in the same manner as the first layer coating solution. As a gelatin hardener for each layer there was used 1-oxy-3,5-dichloro-s-triazine sodium salt.

As spectral sensitizing dyes for each layer there were used the following compounds:

-continued

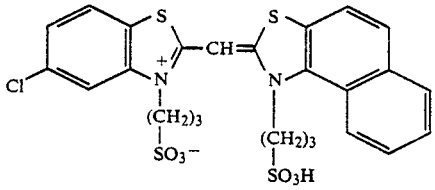

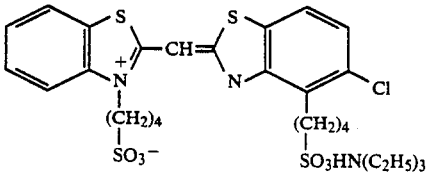

(2.0 × $10^{-4}$ mol per mol of silver halide each)

Green-Sensitive Emulsion Layer

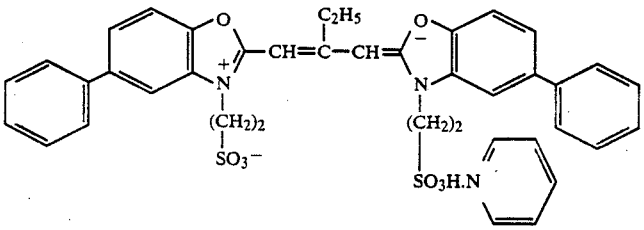

(4.0 × $10^{-4}$ mol per mol of silver halide)

and

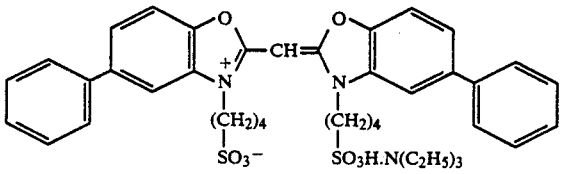

(7.0 × $10^{-5}$ mol per mol of silver halide)

Red-Sensitive Emulsion Layer

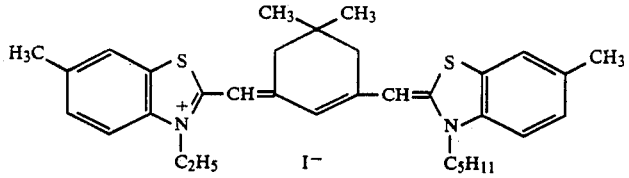

(0.9 × $10^{-4}$ mol per mol of silver halide)

To the red-sensitive emulsion layer was added the following compound in an amount of $2.6\times10^{-3}$ mol per mol of silver halide.

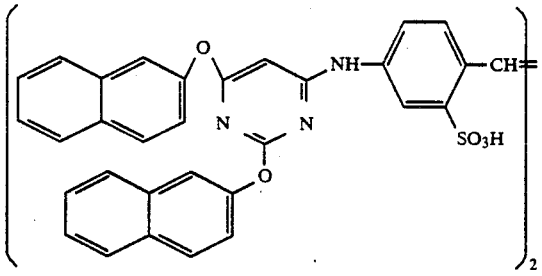

To the blue-sensitive emulsion layer, green-sensitive emulsion layer and red-sensitive emulsion layer were added 1-(5-methylureidophenyl)-5-mercaptotetrazole in amounts of $8.5\times10^{-5}$ mol, $7.7\times10^{-4}$ mol and $2.5\times10^{-4}$ mol per mol of silver halide, respectively.

In order to inhibit irradiation, the following dyes were incorporated in the emulsion layers.

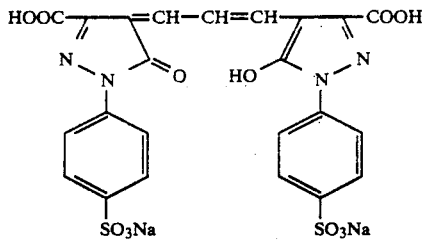

and

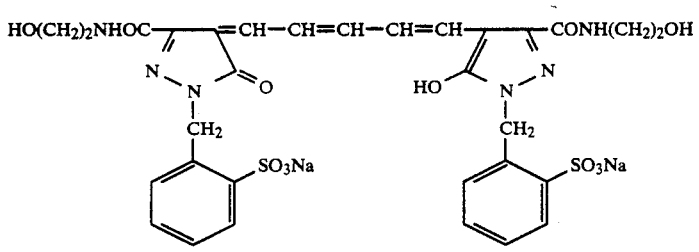

Layer Structure:

The composition of each layer is shown below. The figures indicate the respective coating amounts (g/m$^2$). The coating amount of the silver halide emulsion is expressed in terms of the amount of silver.

Support:

Polyethylene Laminated Paper (containing a white pigment ($TiO_3$) and a bluing dye (ultramarine) in the polyethylene layer on the side coated with the first layer)

| | |
|---|---|
| 1st Layer: Blue-Sensitive Layer | |
| Silver Bromochloride Emulsion Set Forth Above | 0.30 |
| Gelatin | 1.86 |
| Yellow Coupler (ExY*) | 0.82 |
| Dye Image Stabilizer (Cpd-51) | 0.19 |
| Dye Image Stabilizer (Cpd-57) | 0.03 |
| Solvent (Solv-53) | 0.35 |
| 2nd Layer: Color Stain Inhibiting Layer | |
| Gelatin | 0 99 |
| Color Stain Inhibitor (Cpd-55) | 0.08 |
| Solvent (Solv-51) | 0.16 |
| Solvent (Solv-54) | 0.08 |
| 3rd Layer: Green-Sensitive Layer | |
| Silver Bromochloride Emulsion (cubic, mean grain size: 0.40 μm, coefficient of fluctuation: 0.09, 1 mol % of silver bromide being locally present in part of the surface of the grains) | 0.2 |
| Gelatin | 1.24 |

-continued

| | |
|---|---|
| Magenta Coupler (ExM*) | 0.31 |
| Dye Image Stabilizer (Cpd-53) | 0.12 |
| Comparative Compound and Invention Compound | Set forth in Table 5 |
| Dye Image Stabilizer (Cpd-58) | 0.09 |
| Solvent (Solv-52) | 0.42 |
| 4th Layer: Ultraviolet Absorbing Layer | |
| Gelatin | 1.58 |
| Ultraviolet Absorbent (UV-1) | 0.47 |
| Color Stain Inhibitor (Cpd-55) | 0.05 |
| Solvent (Solv-55) | 0.24 |
| 5th Layer: Red-Sensitive Layer | |
| Silver Bromochloride Emulsion (cubic, mean grain size: 0.36 μm, coefficient of fluctuation: 0.11, 1.6 mol % of silver bromide being locally present in part of the surface of the grains) | 0.21 |
| Gelatin | 1.34 |
| Cyan Coupler (ExC*) | 0.34 |
| Dye Image Stabilizer (Cpd-56) | 0.17 |
| Dye Image Stabilizer (Cpd-57) | 0.34 |
| Solvent (Solv-54) | 0.37 |
| 6th Layer: Ultraviolet Absorbing Layer | |
| Gelatin | 0.53 |
| Ultraviolet Absorbent (UV-1) | 0.16 |
| Color Stain Inhibitor (Cpd-55) | 0.02 |
| Solvent (Solv-55) | 0.08 |
| 7th Layer: Protective Layer | |
| Gelatin | 1.33 |
| Acryl-Modified Copolymer of Polyvinyl Alcohol (modification degree: 17%) | 0.17 |
| Liquid Paraffin | 0.03 |

Yellow Coupler (ExY*)

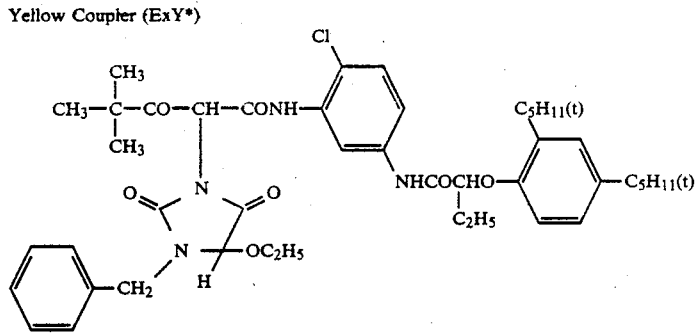

-continued
Magenta Coupler (ExM*)
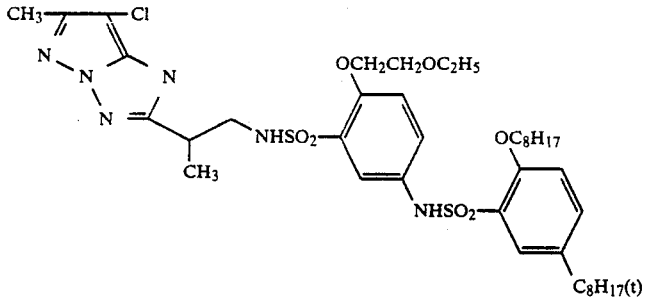
Cyan Coupler (ExC*)
1/3/6 (weight ratio) of the following three compounds
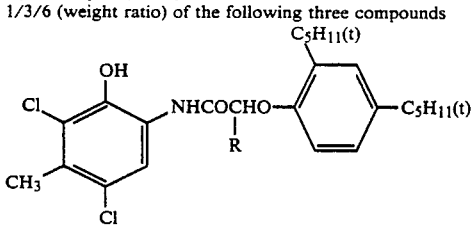
wherein R = H, $C_2H_5$ and $C_4H_9$
Dye Image Stabilizer (Cpd-51)
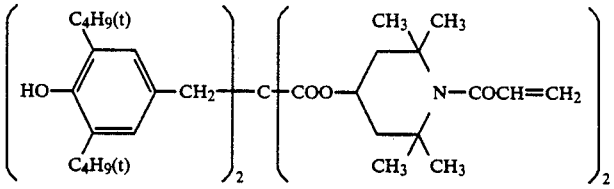
Dye Image Stabilizer (Cpd-53)
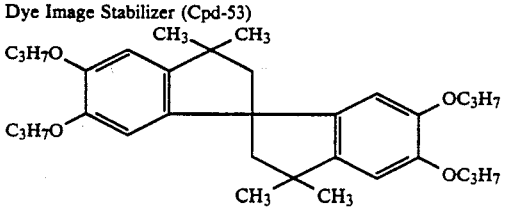
Color Stain Inhibitor (Cpd-55)
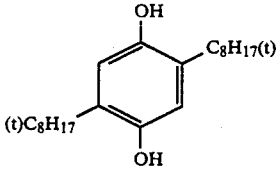
Dye Image Stabilizer (Cpd-56)
2/4/4 (weight ratio) mixture of:
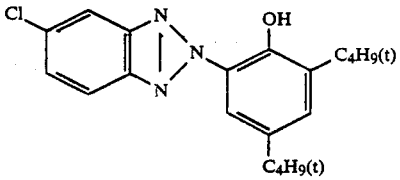
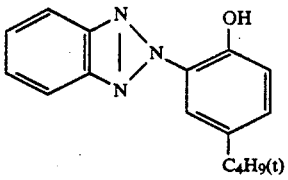

-continued
and
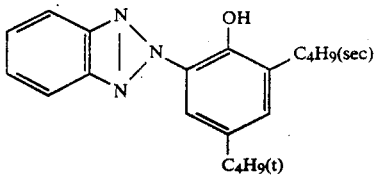
Dye Image Stabilizer (Cpd-57)
$$\left(CH_2-\underset{\underset{CONHC_4H_9(t)}{|}}{CH}\right)_n$$
Mean molecular weight: 60,000
Dye Image Stabilizer (Cpd-58)
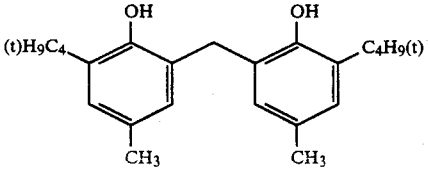
Ultraviolet Absorbent (UV-1)
4/2/4 (weight ratio) mixture of:
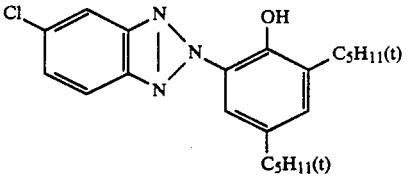
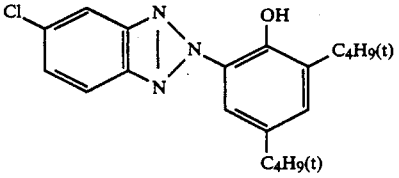
and
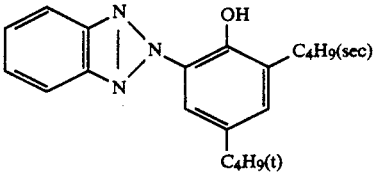
Solvent (Solv-51)
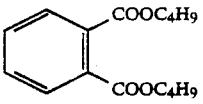
Solvent (Solv-52)
1/1 (weight ratio) mixture of:
$$O{=}P\left(-OCH_2\overset{\overset{C_2H_5}{|}}{C}HC_4H_9\right)_3$$
and -continued

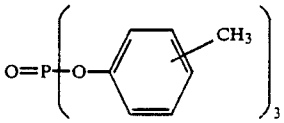

Solvent (Solv-53)
$O{=}P{+}O{-}C_9H_{19}(iso))_3$

Solvent (Solv-54)

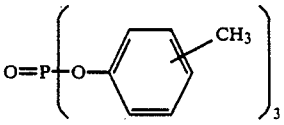

Solvent (Solv-55)

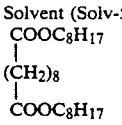

Solvent (Solv-56)

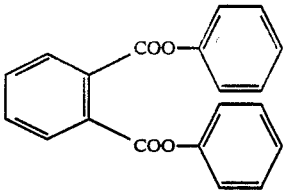

Samples M to X thus prepared (see Table 5) were them imagewise exposed to light, and subjected to continuous processing (running test) in a paper processor (Lucky Image Processor CP-303H, produced by Fujimoto Shashin Kogyo) according to the following processing procedure until the processing solution was replenished twice the volume of the tank.

| Processing Step | Time (sec) | Temperature (°C.) | Tank Volume for Running Solution (liter) | Replenishment Rate* (ml) |
|---|---|---|---|---|
| Color Development | 45 | 35 | 1.7 | 16.1 |
| Blix | 45 | 30–35 | 1.7 | 21.5 |
| Washing (1) | 60 | 30–35 | 1.7 | |
| Drying | 60 | 70–80 | | |

*per $m^2$ of light-sensitive material

The washing process was effected in a countercurrent process in which the washing water was fed from tank (3) to tank (1) through tank (2).

The various processing solutions had the following compositions:

| | Running Solution | Replenisher |
|---|---|---|
| Color Developer: | | |
| Water | 800 ml | 800 ml |
| Ethylenediamine-N,N,N-methylenesulfonic acid | 1.5 g | 2.0 g |
| Triethanolamine | 8.0 g | 12.0 g |
| Sodium Chloride | 1.4 g | — |
| Potassium Carbonate | 25 g | 25 g |
| N-Ethyl-N-(β-methanesulfonamidoethyl)-3-methyl-4-aminoaniline Sulfate | 5.0 g | 7.0 g |
| N,N-Bis(carboxymethyl)-hydrazine | 5.5 g | 7.0 g |

-continued

| | Running Solution | Replenisher |
|---|---|---|
| Fluorescent Brightening Agent (WHITEX 4B, produced by Sumitomo Chemicals) | 1.0 g | 2.0 g |
| Water to make | 1,000 ml | 1,000 ml |
| pH (25° C.) | 10.05 | 10.45 |
| Blix Solution | | |
| Water | 400 ml | Same as running solution |
| Ammonium Thiosulfate (70%) | 100 ml | Same as running solution |
| Sodium Sulfite | 17 g | Same as running solution |
| Iron (III) Ammonium Ethylenediaminetetraacetate | 55 g | Same as running solution |
| Disodium Ethylenediaminetetraacetate | 5 g | Same as running solution |
| Ammonium Bromide | 40 g | Same as running solution |
| Water to make | 1,000 ml | Same as running solution |
| pH (25° C.) | 6.0 | |

Washing Water

Ion exchanged water was used (calcium and magnesium concentration: 3 ppm or less each). (The running solution was also used as replenisher.)

The results of the photographic properties obtained when Samples M to X were processed with a processing solution which had been newly prepared and with a running solution which had completed continuous processing are set forth in Table 5.

TABLE 5

| Light-Sensitive Material | Comparative Compound and Invention Compound | Fresh Solution Dmin | Fresh Solution Dmax | Fresh Solution Gradation | Running Solution Dmin | Running Solution Dmax | Running Solution Gradation | Remarks |
|---|---|---|---|---|---|---|---|---|
| M | — | 0.12 | 2.49 | 1.67 | 0.12 | 2.48 | 1.62 | Comparison |
| N | (A-1) | 0.12 | 2.48 | 1.68 | 0.12 | 2.02 | 1.31 | " |
| O | (A-2) | 0.13 | 2.50 | 1.70 | 0.13 | 2.01 | 1.20 | " |
| P | (A-3) | 0.12 | 2.51 | 1.71 | 0.12 | 2.03 | 1.30 | " |
| Q | (A-4) | 0.12 | 2.51 | 1.72 | 0.13 | 1.92 | 1.28 | " |
| R | I-(1) | 0.11 | 2.51 | 2.11 | 0.12 | 2.49 | 2.08 | Invention |
| S | I-(2) | 0.10 | 2.49 | 2.21 | 0.11 | 2.51 | 2.17 | " |
| T | I-(4) | 0.11 | 2.50 | 2.19 | 0.10 | 2.51 | 2.21 | " |
| U | I-(9) | 0.10 | 2.49 | 2.19 | 0.10 | 2.49 | 2.21 | " |
| V | I-(12) | 0.10 | 2.50 | 2.18 | 0.11 | 2.49 | 2.31 | " |
| W | I-(20) | 0.10 | 2.51 | 2.21 | 0.10 | 2.50 | 2.16 | " |
| X | I-(22) | 0.10 | 2.51 | 2.21 | 0.10 | 2.50 | 2.19 | " |

(The comparative compounds were the same as in Example 1.)

The results set forth in Table 5 show that the samples according to the present invention exhibited not only excellent photographic properties but also little change in the photographic properties after running as compared to the comparative samples.

EXAMPLE 6

The same effect as in Example 2 were obtained also when the invention compounds were incorporated in the first layer and/or the fifth layer.

EXAMPLE 7

Sample 301 was prepared in the same manner as in Example 1 except that a 1/1 mixture of Cyan Couplers (C-2) and (C-9) were incorporated in the third and fourth layers in an amount of 0.30 g/m$^2$; Magenta Coupler I-(1) was incorporated in the sixth layer in an amount of 0.10 g/m$^2$, Magenta Coupler I-(1) was incorporated in the seventh layer in an amount of 0.11 g/m$^2$; a 1/1 mixture of Yellow Couplers (Y-5) and (Y-7) was incorporated in the eleventh layer in an amount of 0.35 g/m$^2$; and a 1/1 mixture of Yellow Couplers (Y-5) and (Y-7) was incorporated in the twelfth layer in an amount of 0.30 g/m$^2$.

Samples 302 and 317 were prepared containing the magenta couplers and additives set forth in Table 6 in the sixth and seventh layers.

TABLE 6

| Sample No. | Magenta Coupler | Compound Added |
|---|---|---|
| 301 | III-(1) | — |
| 302 | III-(5) | — |
| 303 | III-(42) | — |
| 304 | Comparative Compound MR-1 | — |
| 305 | Comparative Compound MR-2 | — |
| 306 | Comparative Compound MR-1 | I-(31) |
| 307 | Comparative Compound MR-2 | " |
| 308 | III-(1) | " |
| 309 | III-(5) | " |
| 310 | III-(42) | " |
| 311 | III-(6) | " |
| 312 | " | I-(38) |
| 313 | " | I-(41) |
| 314 | " | I-(42) |
| 315 | " | Comparative Compound (A-1) |
| 316 | " | Comparative Compound (A-2) |
| 317 | " | Comparative Compound (A-3) |

These couplers were used instead of III-(1) used in Sample 301 in the equimolecular amount. The amount of these additives incorporated in the sixth and seventh layers were $9.0\times10^{-7}$ mol/m$^2$ each.

Comparative Compounds MR-1 and MR-2 set forth in Table 6 are conventionally used in silver halide color light-sensitive materials, as follows:

MR-1

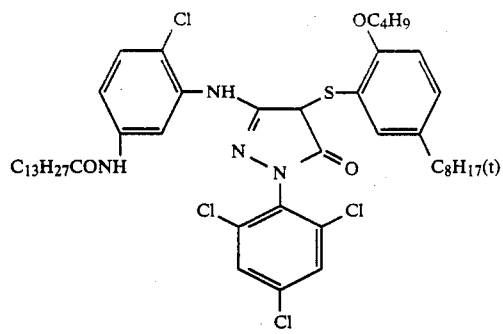

-continued

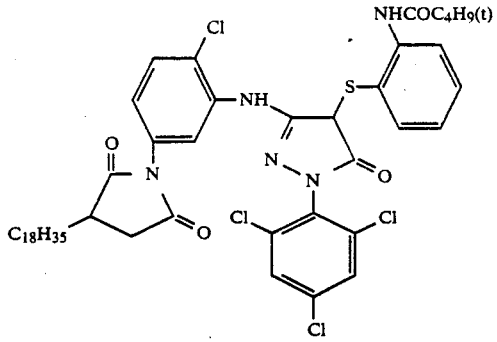

MR-2

Silver Halide Color Photographic Material Samples 301 to 317 thus prepared were then exposed to light (3,200° K., 1/10 sec, 10 CMS), and subjected to the same continuous processing as in Example 1 in an automatic developing machine with the same processing composition as in Example 1 according to the same processing procedure as in Example 1, except that the pH value (25° C.) of the running solution and the replenisher were 10.25 and 10.75, respectively.

The results of magenta color image density obtained when processed with a fresh processing solution are set forth in Table 7.

TABLE 7

| Sample No. | Remarks | Toe Gradation* | Minimum Image Density (Dmin) |
|---|---|---|---|
| 301 | Comparison | 1.33 | 0.15 |
| 302 | " | 1.38 | 0.14 |
| 303 | " | 1.35 | 0.15 |
| 304 | " | 1.40 | 0.13 |
| 305 | " | 1.41 | 0.13 |
| 306 | " | 1.62 | 0.12 |
| 307 | " | 1.67 | 0.11 |
| 308 | Invention | 2.10 | 0.10 |
| 309 | " | 2.21 | 0.11 |
| 310 | " | 2.14 | 0.11 |
| 311 | " | 2.30 | 0.10 |
| 312 | " | 2.18 | 0.10 |
| 313 | " | 2.23 | 0.11 |

TABLE 7-continued

| Sample No. | Remarks | Toe Gradation* | Minimum Image Density (Dmin) |
|---|---|---|---|
| 314 | " | 2.17 | 0.10 |
| 315 | Comparison | 1.84 | 0.12 |
| 316 | " | 1.79 | 0.13 |
| 317 | " | 1.82 | 0.12 |

*Mean gradation between Dmin +0.1 and Dmin +0.6

The results set forth in Table 7 show that Samples 308 to 314 according to the present invention were excellent in high toe gradation and low Dmin. Thus, it is clear that the combination of the present magenta coupler and the present additive compound was unexpectedly superior. As to the photographic properties after continuous processing, Samples 315 to 317 with the comparative compounds exhibited a low toe gradation, while Samples 308 to 314 according to the present invention exhibited little or no change in toe gradation and little deterioration in the processing solution.

EXAMPLE 8

Samples 401 to 406 were prepared in the same manner as Sample 308 except that the cyan couplers incorporated in the third and fourth layers and the yellow couplers incorporated in the eleventh and twelfth layers were replaced by those set forth in Table 8.

TABLE 8

| Sample No. | Cyan Coupler | Yellow Coupler |
|---|---|---|
| 308 | (C-2), (C-9) in equal ratio | (Y-5), (Y-7) in equal ratio |
| 401 | (C-1) | (Y-2) |
| 402 | " | YR-1 |
| 403 | CR-1 | (Y-2) |
| 404 | " | YR-1 |
| 405 | CR-2 | " |
| 406 | " | YR-2 |

These couplers were used instead of those in Sample 308 in equimolecular amounts.

The chemical structures of the couplers used are shown below:

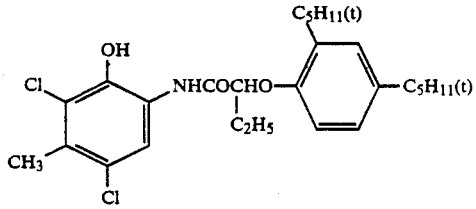

CR-1

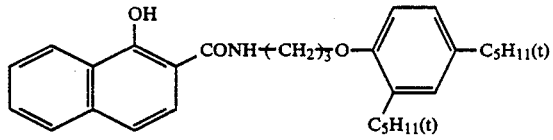

CR-2

-continued

YR-1

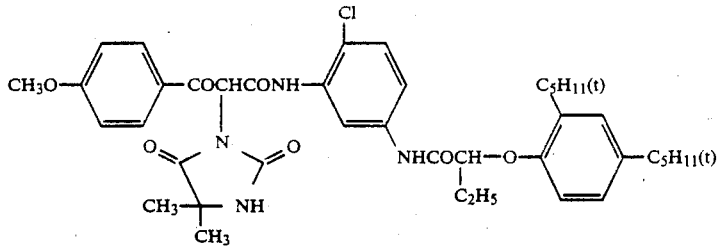

YR-2

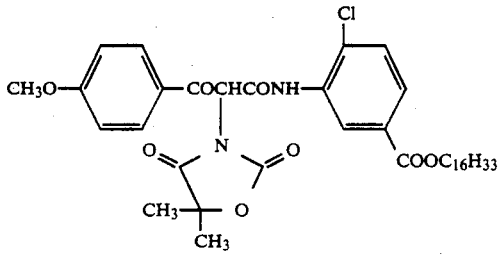

Samples 308 and 401 to 406 were then subjected to the same processing as in Example 1. Comparison of toe gradation was made when these samples were processed with a fresh processing solution and when these samples were processed with a processing solution which had completed the continuous processing.

The results are set forth in Table 9.

TABLE 9

| Sample No. | Toe Gradation with Fresh Processing Solution | Toe Gradation with Exhausted Processing Solution |
|---|---|---|
| 308 | 2.10 | 2.02 |
| 401 | 2.21 | 1.98 |
| 402 | 2.08 | 1.77 |
| 403 | 2.12 | 1.69 |
| 404 | 2.07 | 1.53 |
| 405 | 2.12 | 1.48 |
| 406 | 2.05 | 1.56 |

The results set forth in Table 9 show that the use of yellow couplers of formula (IV) and cyan couplers of formula (V) effectively inhibited fluctuation in the photographic properties due to the deterioration of the processing solution, when the present light-sensitive material was subjected to continuous processing.

EXAMPLE 9

Samples A to L were prepared in the same manner as in Example 3 except that the present compounds and the comparative compounds set forth in Table 10 were incorporated in the fifth layer (red-sensitive layer). These samples were then exposed to light and processed in the same manner as in Example 3.

TABLE 10

| Sample No. | Comparative Compound and Invention Compound* | Dmin | Gradation | Remarks |
|---|---|---|---|---|
| A | — | 0.14 | 1.43 | Comparison |
| B | (A-1) | 0.12 | 1.71 | " |
| C | (A-2) | 0.13 | 1.62 | " |
| D | (A-3) | 0.14 | 1.57 | " |
| E | I-(24) | 0.10 | 1.96 | Invention |
| F | I-(31) | 0.10 | 2.20 | " |
| G | I-(8) | 0.11 | 2.05 | " |
| H | I-(36) | 0.10 | 2.28 | " |
| I | I-(10) | 0.10 | 2.21 | " |

TABLE 10-continued

| Sample No. | Comparative Compound and Invention Compound* | Dmin | Gradation | Remarks |
|---|---|---|---|---|
| J | I-(40) | 0.11 | 2.12 | " |
| K | I-(42) | 0.11 | 2.01 | " |
| L | I-(48) | 0.10 | 2.21 | " |

*Incorporated in an amount of 5.0 mol % based on coupler

The results set forth in Table 10 show that the use of the invention compounds of formula (II) provided a better white background, taking advantage of the excellent color reproducibility of pyrazoloazole couplers.

EXAMPLE 10

Samples were prepared in the same manner as in Example except that Color Stain Inhibitor (Cpd-55) incorporated in the second layer (color stain inhibiting layer) was replaced by the compounds set forth in Table 11 in an equimolecular amount, and Magenta Coupler I-(6) incorporated in the third layer was replaced by Magenta Coupler I-(1) in an equimolecular amount. These samples were then subjected to the same processing as in Example 3.

In order to evaluate the photographic properties, these samples were then measured for minimum density (Dmin) and maximum density (Dmax) in the magenta color image portion. In order to evaluate the degree of color stain, these samples were measured for yellow density at the point where the magenta image density was 1.0.

The results are set forth in Table 11.

TABLE 11

| Sample No. | Comparative Compound and Invention Compound | Photographic Properties | | | Remarks |
|---|---|---|---|---|---|
| | | Dmin | Dmax | D B/G | |
| A | — | 0.14 | 2.52 | 0.32 | Comparison |
| B | (A-1) | 0.13 | 2.39 | 0.18 | " |
| C | (A-2) | 0.14 | 2.42 | 0.16 | " |
| D | (A-3) | 0.14 | 2.45 | 0.21 | " |
| E | I-(24) | 0.11 | 2.48 | 0.10 | Invention |
| F | I-(31) | 0.11 | 2.43 | 0.09 | " |
| G | I-(8) | 0.12 | 2.45 | 0.10 | " |
| H | I-(36) | 0.11 | 2.42 | 0.11 | " |
| I | I-(38) | 0.12 | 2.43 | 0.09 | " |

TABLE 11-continued

| Sample No. | Comparative Compound and Invention Compound | Photographic Properties Dmin | Dmax | D B/G | Remarks |
|---|---|---|---|---|---|
| J | I-(40) | 0.12 | 2.46 | 0.10 | " |
| K | I-(42) | 0.11 | 2.42 | 0.10 | " |
| L | I-(48) | 0.12 | 2.41 | 0.11 | " |

The results set forth in Table 11 show that the use of the invention compounds of formula (II) as color stain inhibitors provided an excellent white background taking advantages of the excellent color reproducibility of pyrazoloazole couplers.

EXAMPLE 11

Sample M was prepared in the same manner as in Example 5 except that the invention compounds and the comparative compounds set forth in Table 10 were incorporated in the fifth layer (red-sensitive layer).

Samples N to Z were prepared in the same manner as in Sample M except that the magenta coupler and toe cutting agent incorporated in the third layer were replaced by those set forth in Table 12.

Samples M to Z (see Table 12) thus obtained were subjected to the same processing as in Example 5. The results of the photographic properties of these samples are set forth in Table 12.

TABLE 12

| Sample No. | Magenta Coupler* | High Toe Gradation-Imparting Agent** | Fresh Solution Dmin | Fresh Solution Gradation | Running Solution Dmin | Running Solution Gradation*** | Remarks |
|---|---|---|---|---|---|---|---|
| M | III-(6) | — | 0.13 | 1.67 | 0.13 | 1.67 | Comparison |
| N | MR-1 | — | 0.12 | 1.59 | 0.12 | 1.55 | " |
| O | MR-2 | — | 0.12 | 1.65 | 0.12 | 1.60 | " |
| P | MR-1 | (A-1) | 0.11 | 2.01 | 0.11 | 1.61 | " |
| Q | " | (A-2) | 0.11 | 1.92 | 0.12 | 1.56 | " |
| R | MR-2 | " | 0.11 | 1.90 | 0.11 | 1.59 | " |
| S | " | (A-3) | 0.11 | 1.83 | 0.11 | 1.55 | " |
| T | MR-1 | I-(24) | 0.11 | 2.05 | 0.11 | 1.92 | " |
| U | MR-2 | I-(31) | 0.11 | 2.03 | 0.12 | 1.96 | " |
| V | III-(1) | (A-1) | 0.12 | 1.85 | 0.12 | 1.47 | " |
| W | III-(6) | (A-2) | 0.12 | 1.94 | 0.12 | 1.52 | " |
| X | III-(1) | I-(24) | 0.10 | 2.11 | 0.10 | 2.04 | Invention |
| Y | III-(6) | I-(31) | 0.10 | 2.18 | 0.10 | 2.05 | " |
| Z | III-(42) | I-(38) | 0.11 | 2.21 | 0.11 | 2.10 | " |

*These couplers were used in an equimolecular amount to those in Sample M.
**High toe gradation-imparting agents were used in an amount of 5 mol % based on coupler.
***Gradation: as defined in Table 2.

The comparative compounds were the same as used above.

The results set forth in Table 12 show that the use of the invention magenta couplers and toe cutting agents makes it possible to not only obtain both excellent color reproducibility of pyrazoloazole couplers and excellent white background, but also little deterioration in the properties of the processing solution due to the continuous processing.

EXAMPLE 12

A color photographic light-sensitive material comprising a polyethylene laminated (on both sides) paper support (thickness: 100 μm) having coated on the surface side thereof the first to fourteenth layers shown below and on the back side thereof the fifteenth to sixteenth layers shown below was prepared. The polyethylene layer on the side coated with the first layer contained titanium oxide as a white pigment and a trace amount of ultramarine as a bluing dye (the chromaticity of the surface of the support according to L*, a*, b* system was 88.0, −0.20 and −0.75).

Composition of Light-Sensitive Layers:

The components and coated amounts (unit: g/m$^2$, hereinafter the same) are shown below. The emulsion used in each layer was prepared in accordance with the method for preparing Emulsion EM1 described later, but the emulsion used in the fourteenth layer was a Lippmann emulsion not subjected to surface chemical sensitization.

| | |
|---|---|
| 1st Layer: Antihalation Layer | |
| Black Colloidal Silver | 0.10 |
| Gelatin | 0.70 |
| 2nd Layer: Intermediate Layer | |
| Gelatin | 0.70 |
| 3rd Layer: Low Sensitivity Red-Sensitive Layer | |
| Silver Bromide (mean grain size: 0.25 μm, size distribution (coefficient of variation): 8%, octahedral) Spectrally Sensitized with Red Sensitizing Dyes (ExS-1, ExS-2 and ExS-3) | 0.04 |
| Silver Bromochloride (silver chloride: 5 mol %, mean grain size: 0.40 μm, size distribution: 10%, octahedral) Spectrally Sensitized with Red Sensitizing Dyes (ExS-1, ExS-2 and ExS-3) | 0.08 |
| Gelatin | 1.00 |
| Cyan Coupler (1/1/0.2 mixture of ExC-1, ExC-2, ExC-3) | 0.30 |
| Discoloration Inhibitor (Cpd-1, Cpd-2, Cpd-3 and Cpd-4 in equal ratios) | 0.18 |
| Stain Inhibitor (Cpd-5) | 0.003 |
| Coupler Dispersing Medium (Cpd-6) | 0.03 |
| Coupler Solvent (Solv-1, Solv-2 and Solv-3 in equal ratios) | 0.12 |
| 4th Layer: High Sensitivity Red-Sensitive Layer | |
| Silver Bromide (mean grain size: 0.60 μm, size distribution: 15%, octahedral) Spectrally Sensitized with Red Sensitizing Dyes (ExS-1, ExS-2 and ExS-3) | 0.14 |
| Gelatin | 1.00 |
| Cyan Coupler (1/1/0.2 mixture of ExC-1, ExC-2, ExC-3) | 0.30 |
| Discoloration Inhibitor (Cpd-1, Cpd-2, Cpd-3 and Cpd-4 in equal ratios) | 0.18 |
| Coupler Dispersing Medium (Cpd-5) | 0.03 |
| Coupler Solvent (Solv-1, Solv-2 and Solv-3 in equal ratios) | 0.12 |
| 5th Layer: Intermediate Layer | |
| Gelatin | 1.00 |
| Discoloration Inhibitor (Cpd-7) | 0.08 |
| Color Stain Inhibitor Solvent (Solv-4 and Solv-5 in equal ratios) | 0.16 |

-continued

| | |
|---|---|
| Polymer Latex (Cpd-8) | 0.10 |
| 6th Layer: Low Sensitivity Green-Sensitive Layer | |
| Silver Bromide (mean grain size: 0.25 μm, size distribution: 8%, octahedral) Spectrally Sensitized with Green Sensitizing Dye ExS-4) | 0.04 |
| Silver Bromide (mean grain size: 0.5 μm, size distribution: 10%, octahedral) Spectrally Sensitized with Green Sensitizing Dye (ExS-4) | 0.06 |
| Gelatin | 0.80 |
| Magenta Coupler (ExM-1, ExM-2 and ExM-3 in equal ratios) | 0.11 |
| Discoloration Inhibitor (Cpd-9, Cpd-26 in equal ratios) | 0.15 |
| Stain Inhibitor (1.4/1/1 mixture of Cpd-10, Cpd-11, Cpd-12) | 0.025 |
| Coupler Dispersing Medium (Cpd-6) | 0.05 |
| Coupler Solvent (Solv-4 and Solv-6 in equal ratios) | 0.15 |
| 7th Layer: High Sensitivity Green-Sensitive Layer | |
| Silver Bromide (mean grain size: 0.65 μm, size distribution: 16%, octahedral) Spectrally Sensitized with Green Sensitizing Dye (ExS-4) | 0.10 |
| Gelatin | 0.80 |
| Magenta Coupler (ExM-1, ExM-2 and ExM-3 in equal ratios) | 0.11 |
| Stain Inhibitor (1.4/1/1 mixture of Cpd-10, Cpd-11, Cpd-12) | 0.025 |
| Coupler Dispersing Medium (Cpd-6) | 0.05 |
| Coupler Solvent (Solv-4 and Solv-6 in equal ratios) | 0.5 |
| 8th Layer: Intermediate Layer | |
| The same as 5th layer. | |
| 9th Layer: Yellow Filter Layer | |
| Yellow Colloidal Silver | 0.12 |
| Gelatin | 0.07 |
| Discoloration Inhibitor (Cpd-7) | 0.03 |
| Discoloration Inhibitor Solvent (Solv-4 and Solv-5 in equal ratios) | 0.10 |
| Polymer Latex (Cpd-8) | 0.07 |
| 10th Layer: Intermediate Layer | |
| The same as the 5th layer. | |
| 11th Layer: Low Sensitivity Blue-Sensitive Layer | |
| Silver Bromide (mean grain size: 0.40 μm, size distribution: 8%, octahedral) Spectrally Sensitized with Blue Sensitizing Dyes (ExS-5 and ExS-6) | 0.07 |
| Silver Bromide (mean grain size: 0.60 μm, size distribution: 11%, octahedral) Spectrally Sensitized with Blue Sensitizing Dyes (ExS-5 and ExS-6) | 0.14 |
| Gelatin | 0.80 |
| Yellow Coupler (ExY-1 and ExY-2 in equal ratios) | 0.35 |
| Discoloration Inhibitor (Cpd-14) | 0.10 |
| Stain Inhibitor (1/5 mixture of Cpd-5 and Cpd-15) | 0.007 |
| Coupler Dispersing Medium (Cpd-6) | 0.05 |
| Coupler Dispersing Medium | 0.05 |
| Coupler Solvent (Solv-2) | 0.10 |
| 12th Layer: High Sensitivity Blue-Sensitive Layer | |
| Silver Bromide (mean grain size: 0.85 μm, size distribution: 18%, octahedral) Spectrally Sensitized with Blue Sensitizing Dyes (ExS-5 and ExS-6) | 0.15 |
| Gelatin | 0.60 |
| Yellow Coupler (ExY-1 and ExY-2 in equal ratios) | 0.30 |
| Discoloration Inhibitor (Cpd-14) | 0.10 |
| Stain Inhibitor (1/5 mixture of Cpd-5 and Cpd-15) | 0.007 |
| Coupler Dispersing Medium (Cpd-5) | 0.05 |
| Coupler Solvent (Solv-2) | 0.10 |
| 13th Layer: Ultraviolet Absorbing Layer | |
| Gelatin | 1.00 |
| Ultraviolet Absorbent (Cpd-2, Cpd-4 and Cpd-16 in equal ratios) | 0.50 |
| Discoloration Inhibitor (Cpd-7 and Cpd-17 in equal ratios) | 0.03 |
| Dispersing Medium (Cpd-6) | 0.02 |
| Ultraviolet Absorbent Solvent (Solv-2 and Solv-7 in equal ratios) | 0.08 |
| Antirradiation Dye (10/10/13/15/20 mixture of Cpd-18, Cpd-19, Cpd-20, Cpd-21 and Cpd-27) | 0.02 |
| 14th Layer: Protective Layer | |
| Fine Silver Chlorobromide Grains (silver chloride: 97 mol %, mean grain size: 0.2 μm) | 0.03 |
| Acryl-Modified Copolymer of Polyvinyl Alcohol | 0.01 |
| Polymethyl Methacrylate Particles (mean particle size: 2.4 μm) and Silicon Oxide (mean particle size: 5 μm) | 0.05 |
| Gelatin | 1.80 |
| Gelatin Hardening Agent (H-1 and H-2) | 0.18 |
| 15th Layer: Backing Layer | |
| Gelatin | 2.50 |
| Ultraviolet Absorbent (Cpd-2, Cpd-4 and Cpd-16 in equal ratios) | 0.50 |
| Dye (Cpd-18, Cpd-19, Cpd-20, Cpd-21 and Cpd-27 in equal ratios) | 0.06 |
| 16th Layer: Backing Protective Layer | |
| Polymethyl Methacrylate Particles (average particle size: 2.4 μm) and Silicon Oxide (mean particle size: 5 μm in equal ratios) | 0.05 |
| Gelatin | 2.00 |
| Gelatin Hardening Agent (H-1 and H-2 in equal ratios) | 0.14 |

Each of the light-sensitive layers further contained $10^{-3}$% by weight of ExZK-1 and $10^{-2}$% by weight of ExZK-2 as nucleating agents based on silver halide and $10^{-2}$% by weight of Cpd-22 as a nucleation accelerator. Furthermore, each layer contained Alkanol XC (produced by Du Pont) and a sodium alkylbenzenesulfonate as emulsifying and dispersing assistant, a succinic ester and Magefac F-120 (produced by Dai-Nippon Ink & Chemicals, Inc.) as coating aid. In the silver halide- and colloidal silver-containing layers, Cpd-23, Cpd-24 and Cpd-25 were used as stabilizer. The sample was used as Sample 501. The compounds used in this example are shown below.

Samples 502 to 514 were prepared in the same manner as Sample 501 except that the compounds set forth in Table 13 were incorporated in the eleventh and twelfth layers.

Comparative Compounds (A-5) to (A-6) set forth in Table 13 are conventionally used in silver halide light-sensitive materials as follows:

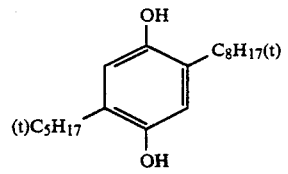

(A-5)

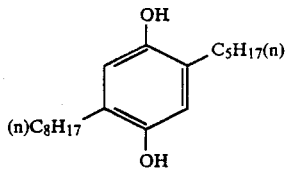

(A-6)

TABLE 13

| Sample No. | Compound Incorporated in 11th and 12th Layers |
|---|---|
| 502 | Comparative Compound (A-5) |
| 503 | Comparative Compound (A-2) |
| 504 | Comparative Compound (A-6) |

TABLE 13-continued

| Sample No. | Compound Incorporated in 11th and 12th Layers |
|---|---|
| 505 | Comparative Compound (A-3) |
| 506 | Invention Compound I-(23) |
| 507 | Invention Compound I-(26) |
| 508 | Invention Compound I-(8) |
| 509 | Invention Compound I-(35) |
| 510 | Invention Compound I-(36) |
| 511 | Invention Compound I-(38) |
| 512 | Invention Compound I-(41) |
| 513 | Invention Compound I-(46) |
| 514 | Invention Compound I-(53) |

The amount of each of the compounds incorporated in the eleventh and twelfth layers was $1.2\times10^{-5}$ mol/m$^2$.

Silver Halide Color Photographic Material Samples 501 to 514 thus prepared were then exposed to light (3,200° K., 1/10 sec, 10 CMS), and continuously processed in an automatic developing machine in the following manner until the accumulated replenished amount of the processing solution reached 3 times the tank value:

| Processing Step | Time (sec) | Temperature (°C.) | Tank Volume for Running Solution (liter) | Replenishment Rate* (ml/m$^2$) |
|---|---|---|---|---|
| Color Development | 135 | 38 | 15 | 300 |
| Blix | 40 | 33 | 3 | 300 |
| Washing (1) | 40 | 33 | 3 | — |
| Washing (2) | 40 | 33 | 3 | 320 |
| Drying | 30 | 80 | | |

The washing water was replenished by a counter flow system in which the overflow from the washing bath (2) was fed to washing bath (1). In this case, the amount of the blix solution which was carried over from the blix bath to the washing bath (1) was 35 ml/m$^2$, the replenishment rate of the washing water being 9.1 times the amount of the blix solution carried over.

The respective processing solutions had the following compositions.

| | Running Solution | Replenisher |
|---|---|---|
| Color Developer: | | |
| D-Sorbitol | 0.15 g | 0.20 g |
| Sodium Naphthalenesulfonate-Formalin Condensate | 0.15 g | 0.20 g |
| Ethylenediaminetetrakis-methylenesulfonic acid | 1.5 g | 1.5 g |
| Diethylene Glycol | 12.0 ml | 12.0 ml |
| Benzyl Alcohol | 13.5 ml | 18.0 ml |
| Potassium Bromide | 0.80 g | 0.80 g |
| Benzotriazole | 0.003 g | 0.004 g |
| Sodium Sulfite | 2.4 g | 3.2 g |
| N,N-Bis(carboxymethyl)-hydrazine | 6.0 g | 8.0 g |
| D-Glucose | 2.0 g | 2.4 g |
| Triethanolamine | 6.0 g | 8.0 g |
| N-Ethyl-N-(methanesulfonamidoethyl)-3-methyl-4-aminoaniline Sulfate | 30.0 g | 25.0 g |
| Potassium Carbonate | 30.0 g | 25.0 g |
| Fluorescent Brightening Agent (diaminostilbene type) | 1.0 g | 1.2 g |
| Water to make | 1,000 ml | 1,000 ml |
| pH (25° C.) | 10.25 | 10.75 |

-continued

| | Running Solution | Replenisher |
|---|---|---|
| Blix Solution: | | |
| Disodium Ethylenediamine-tetraacetate Dihydrate | 4.0 g | Same as running solution |
| Ammonium (Ethylenediamine-tetraacetato)Iron (III) (dihydrate) | 70.0 g | Same as running solution |
| Ammonium Thiosulfate (700 g/liter) | 180 ml | Same as running solution |
| Sodium p-Toluenesulfonate | 20.0 g | Same as running solution |
| Sodium Bisulfite | 20.0 g | Same as running solution |
| 5-Mercapto-1,3,4-triazole | 0.5 g | Same as running solution |
| Ammonium Sulfate | 10.0 g | Same as running solution |
| Water to make | 1,000 ml | Same as running solution |
| pH (25° C.) | 6.20 | |

Washing Water:

Prepared for both the running solution and the replenisher by passing tap water through a mixed bed column packed with an H-type strongly acidic cation exchange resin ("Amberlite IR-120B", produced by Rohm & Haas Co.) and an OH-type anion exchange resin ("Amberlite IR-400", produced by the same company) to reduce calcium and magnesium ion concentrations each to 3 ml/liter, and then adding to the resulting water 20 mg/liter of sodium dichloroisocyanurate and 1.5 g/liter of sodium sulfate. The pH of the resulting solution was in the range of from 6.5 to 7.5.

These samples thus processed were measured for yellow color image density. The results are set forth in Table 14,

TABLE 14

| Sample No. | Remarks | Dmax | Dmin | Toe Gradation* |
|---|---|---|---|---|
| 501 | Comparison | 2.24 | 0.15 | 1.43 |
| 502 | " | 1.98 | 0.12 | 1.90 |
| 503 | " | 2.05 | 0.13 | 1.83 |
| 504 | " | 2.02 | 0.13 | 1.84 |
| 505 | " | 1.97 | 0.12 | 1.92 |
| 506 | Invention | 2.19 | 0.10 | 2.17 |
| 507 | " | 2.20 | 0.11 | 2.23 |
| 508 | " | 2.25 | 0.11 | 2.21 |
| 509 | " | 2.25 | 0.11 | 2.19 |
| 510 | " | 2.18 | 0.10 | 2.20 |
| 511 | " | 2.21 | 0.11 | 2.25 |
| 512 | " | 2.24 | 0.12 | 2.19 |
| 513 | " | 2.23 | 0.10 | 2.24 |
| 514 | " | 2.22 | 0.10 | 2.23 |

*Mean gradation between density 0.3 and 0.7

The results set forth in Table 14 show that Samples 506 to 514 according to the present invention were excellent in high Dmax, low Dmin and high toe gradation.

EXAMPLE 13

Samples 501 and 602 to 614 were prepared in the same manner as in Example 12 except that the same compounds as used in Example 12 were incorporated in the sixth and seventh layers instead of the eleventh and twelfth layers (the amount of the compounds incorporated in the sixth and seventh layers in Samples 602 to 614 was $1.0\times10^{-5}$ mol/m$^2$ each). These samples were then subjected to the same processing as in Example 12. These samples thus processed were then measured for magenta color image density. The same results as those of Example 12 were obtained.

EXAMPLE 14

Samples 701 to 714 were prepared in the same manner as Samples 501 to 514 except that Nucleating Agent ExZK-1 and EXZK-2 incorporated in each light-sensitive layers were not used. These samples were then subjected to exposure in the same manner as in Example 12, the following processing, and measurement for yellow color image density. The same results as those of Example 12 were obtained.

| Processing Step | Time (sec) | Temperature (°C.) | Replenishment Rate (ml/m$^2$) |
|---|---|---|---|
| Color Development* | 135 | 36 | 320 |
| Blix | 40 | 36 | 320 |
| Washing (1) | 40 | 36 | — |
| Washing (2) | 40 | 36 | 320 |
| Drying | 40 | 70 | |

*The samples were dipped in the color developing solution over 15 seconds, and then color developed while being light-fogged by 1 lux white light over 15 seconds.

| | Running Solution | Replenisher |
|---|---|---|
| Color Developer: | | |
| Hydroxyethyliminodiacetic Acid | 0.5 g | 0.5 g |
| β-Cyclodextrin | 1.5 g | 1.5 g |
| Monoethylene Glycol | 9.0 g | 10.0 g |
| Bensyl Alcohol | 9.0 g | 10.0 g |
| Monoethanolamine | 2.5 g | 2.5 g |
| Sodium Bromide | 2.3 g | 1.5 g |
| Sodium Chloride | 5.5 g | 4.0 g |
| N,N-Diethylhydroxylamine | 5.9 g | 6.5 g |
| 3-Methyl-4-amino-N-ethyl N-(β-methanesulfonamido-ethyl)aniline Sulfate | 2.7 g | 3.0 g |
| 3-Methyl-4-amino-N-ethyl-N-(β-hydroxyethyl)aniline Sulfate | 4.5 g | 5.0 g |
| Potassium Carbonate | 30.0 g | 35.0 g |
| Fluorescent Brightening Agent (stilbene type) | 1.0 g | 1.2 g |
| Pure water to make | 1,000 ml | 1,000 ml |
| pH | 10.30 | 10.70 |
| The pH value was adjusted with potassium hydroxide or hydrochloric acid. | | |
| Blixing Solution: | | |
| Ammonium Thiosulfate | 110 g | Same as running solution |
| Sodium Hydrogensulfite | 12 g | Same as running solution |
| Iron (III) Ammonium Diethylenetriaminepenta-acetate | 80 g | Same as running solution |
| Diethylenetriaminepenta-acetic Acid | 5 g | Same as running solution |
| 2-Mercapto-5-amino-1,3,4-thiadiazole | 0.3 g | Same as running solution |
| Pure water to make | 1,000 ml | Same as running solution |

-continued

| | Running Solution | Replenisher |
|---|---|---|
| pH | 6.80 | |
| The pH value was adjusted with aqueous ammonia or hydrochloric acid. | | |

EXAMPLE 15

Sample 801 was prepared in the same manner as Sample 501 except that Nucleating Agent ExZK-1 incorporated in each light-sensitive layer was replaced by the following compound in an equimolecular amount.

Nucleating Agent:

7-(3-Cyclohexylmethoxythiocarbonylaminobenzamido)-10 -propargyl-1,2,3,4-tetrahydroacylidinium trifluoromethanesulfonate Samples 802 to 811 were prepared in the same manner as Sample 801 except that the compounds set forth in Table 15 were incorporated in the third and fourth layers, respectively.

TABLE 15

| Sample No. | Compound Incorporated in 3rd and 4th Layers* |
|---|---|
| 802 | Comparative Compound (A-5) |
| 803 | Comparative Compound (A-2) |
| 804 | Comparative Compound (A-6) |
| 805 | Comparative Compound (A-3) |
| 806 | Invention Compound I-(8) |
| 807 | Invention Compound I-(36) |
| 808 | Invention Compound I-(38) |
| 809 | Invention Compound I-(41) |
| 810 | Invention Compound I-(19) |
| 811 | Invention Compound I-(50) |

*These compounds were each incorporated in the third or fourth layer in an amount of $1.8\times10^{-5}$ mol.m$^2$.

Samples 801 to 811 thus-prepared were then subjected to exposure and processing in the same manner as in Example 10, and measured for cyan color image density.

The results are set forth in Table 16 .

TABLE 16

| Sample No. | Remarks | Dmax | Dmin | Toe Gradation* |
|---|---|---|---|---|
| 801 | Comparison | 2.38 | 0.18 | 1.54 |
| 802 | " | 2.15 | 0.11 | 1.87 |
| 803 | " | 2.17 | 0.11 | 1.76 |
| 804 | " | 2.10 | 0.12 | 1.80 |
| 805 | " | 2.10 | 0.11 | 1.82 |
| 806 | Invention | 2.32 | 0.10 | 2.24 |
| 807 | " | 2.35 | 0.09 | 2.21 |
| 808 | " | 2.29 | 0.11 | 2.28 |
| 809 | " | 2.37 | 0.10 | 2.19 |
| 810 | " | 2.31 | 0.10 | 2.25 |
| 811 | " | 2.38 | 0.09 | 2.24 |

*Mean gradation between density 0.3 and 0.7

The results set forth in Table 16 show that Samples 806 to 811 according to the present invention were excellent in high Dmax low Dmin and high toe gradation.

EXAMPLE 16

Samples 801 and 902 to 911 were prepared in the same manner as in Example 15 except that the same compounds as used in Example 15 were incorporated in the eleventh and twelfth layers instead of the third and fourth layers (the amount of the compounds incorporated in the eleventh and twelfth layers in Samples 902 to 911 was $1.5\times10^{-5}$ mol/m$^2$ each). These samples were then subjected to the same processing as in Example 12. These samples thus processed were then measured for magenta color image density. The same results as those of Example 15 were obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one light-sensitive silver halide emulsion layer comprising a color coupler, at least one layer of said material comprising a compound represented by formula (I):

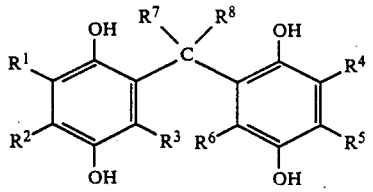

(I)

wherein $R^1$, $R^2$, $R^3$, $R^4$, $R^5$, and $R^6$, which may be the same or different, each represents hydrogen, a halogen atom, a sulfo group, a carboxyl group, a cyano group, an alkyl group, an aryl group, an acylamino group, a sulfonamido group, an alkoxy group, an aryloxy group, an alkylthio group, an arylthio group, an acyl group, an acyloxy group, a sulfonyl group, a carbamoyl group, an alkoxycarbonyl group or a sulfamoyl group; provided that $R^1$ and $R^2$, or $R^4$ and $R^5$ may each be linked to form a carbon ring or a heterocyclic ring; and $R^7$ represents methyl, ethyl, or n-propyl; $R^8$ represents hydrogen, methyl, ethyl or N-propyl; and $R^7$ and $R^8$ may be linked to form a carbon ring on a heterocyclic ring.

2. A silver halide color photographic material comprising a support having thereon at least one light-sensitive silver halide emulsion layer comprising a color coupler, at least one layer of said material comprising a compound represented by formula (II-A) and said coupler being a magenta coupler represented by formula (III):

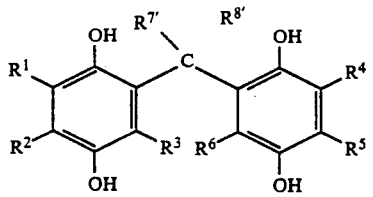

(II-A)

wherein $R^1$, $R^2$, $R^3$, $R^4$, $R^5$ and $R^6$, which may be the same or different, each represents hydrogen, a halogen atom, a sulfo group, a carboxyl group, a cyano group, an alkyl group, an aryl group, an acylamino group, a sulfonamido group, an alkoxy group, an aryloxy group, an alkylthio group, an arylthio group, an acyl group, an acyloxy group, a sulfonyl group, a carbamoyl group, an alkoxycarbonyl group or a sulfamoyl group; provided that $R^1$ and $R^2$, or $R^4$ and $R^5$ may each be linked to form a carbon ring or a heterocyclic ring; $R^{7'}$ and $R^{8'}$ each represents hydrogen, a substituted or unsubstituted alkyl group, a substituted or unsubstituted aryl group, or a substituted or unsubstituted heterocyclic group, and $R^{7'}$ and $R^{8'}$ may be linked to form a carbon ring or a heterocyclic group;

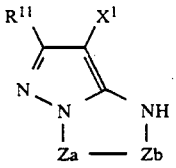

(III)

wherein Za and Zb each represents

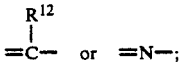

$R^{11}$ and $R^{12}$ each represents hydrogen or a substituent; and $X^1$ represents hydrogen or a coupling-off group.

3. The silver halide color photographic material as claimed in claim 2, wherein said magenta coupler represented by formula (III) is represented by formulae (III*a*), (III*b*), (III*c*), (III*d*) or (III*e*):

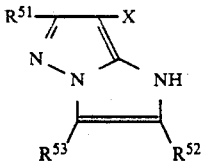

(IIIa)

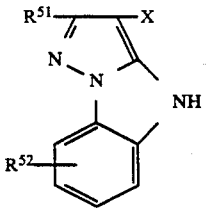

(IIIb)

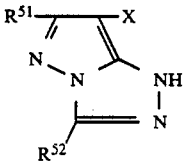

(IIIc)

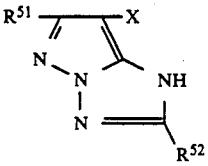

(IIId)

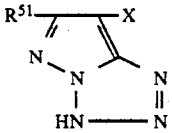

(IIIe)

wherein $R^{51}$, $R^{52}$ and $R^{53}$ each represents hydrogen, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, a silyloxycarbonylamino group, a sulfonamido group, a carbamoyl group, an acyl group, a sulfamoyl group, a sulfonyl group, a sulfinyl group, an alkoxycarbonyl group or an aryloxycarbonyl group; X represents hydrogen, a halogen atom, a carboxyl group or a coupling-off group bonded to the carbon atom in the coupling position by oxygen, nitrogen or sulfur.

4. A silver halide color photographic material comprising a support having thereon at least one light-sensitive silver halide emulsion layer comprising a color coupler, at least one layer of said material being an internal latent image type silver halide emulsion layer which has not been previously fogged, and at least one layer of said material comprising a compound represented by formula (II-A):

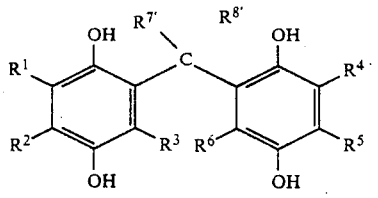

(II-A)

wherein $R^1$, $R^2$, $R^3$, $R^4$, $R^5$ and $R^6$, which may be the same or different, each represents hydrogen, a halogen atom, a sulfo group, a carboxyl group, a cyano group, an alkyl group, an aryl group, an acylamino group, a sulfonamido group, an alkoxy group, an aryloxy group, an alkylthio group, an arylthio group, an acyl group, an acyloxy group, a sulfonyl group, a carbamoyl group, an alkoxycarbonyl group or a sulfamoyl group; provided that $R^1$ and $R^2$, or $R^4$ and R5 may each be linked to form a carbon ring or a heterocyclic ring; $R^{7'}$ and $R^{8'}$ each represents a hydrogen, a substituted or unsubstituted alkyl group, a substituted or unsubstituted aryl group, or a substituted or unsubstituted heterocyclic group, and $R^{7'}$ and $R^{8'}$ may be linked to form a carbon ring or a heterocyclic group.

* * * * *